US007636533B2

(12) United States Patent
Kikuchi et al.

(10) Patent No.: US 7,636,533 B2
(45) Date of Patent: Dec. 22, 2009

(54) COLOR IMAGE FORMING APPARATUS

(75) Inventors: Yoshiteru Kikuchi, Yamatokoriyama (JP); Yoshikazu Harada, Nara (JP); Norio Tomita, Nara (JP); Kengo Matsuyama, Chiba (JP); Yutaka Eba, Tenri (JP); Tetsushi Ito, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 245 days.

(21) Appl. No.: 11/787,149

(22) Filed: Apr. 12, 2007

(65) Prior Publication Data

US 2007/0242980 A1 Oct. 18, 2007

(30) Foreign Application Priority Data

Apr. 14, 2006 (JP) ..... 2006-112585
Dec. 26, 2006 (JP) ..... 2006-349824

(51) Int. Cl.
*G03G 15/00* (2006.01)

(52) U.S. Cl. ..... 399/167; 399/49; 399/301; 399/299

(58) Field of Classification Search ..... 399/167
See application file for complete search history.

(56) References Cited

U.S. PATENT DOCUMENTS 5,111,242 A * 5/1992 Tanimoto et al. ..... 399/167
2003/0021613 A1* 1/2003 Koide ..... 399/167
2005/0063739 A1* 3/2005 Kobayashi et al. ..... 399/299
2005/0238372 A1* 10/2005 Shinohara et al. ..... 399/44
2005/0271429 A1* 12/2005 Tachibana et al. ..... 399/301
2007/0166075 A1* 7/2007 Funamoto et al. ..... 399/167
2008/0231223 A1* 9/2008 Imai et al. ..... 318/683

FOREIGN PATENT DOCUMENTS

| | | |
|---|---|---|
| JP | 63-075759 | 4/1988 |
| JP | 07-261499 | 10/1995 |
| JP | 10-078734 | 3/1998 |
| JP | 2002-108044 | 4/2002 |
| JP | 2003-091126 | 3/2003 |
| JP | 2005-091827 | 4/2005 |

* cited by examiner

*Primary Examiner*—David M Gray
*Assistant Examiner*—Roy Yi
(74) *Attorney, Agent, or Firm*—Edwards Angell Palmer & Dodge LLP; David G. Conlin; David A. Tucker

(57) ABSTRACT

A color image forming apparatus including: a plurality of drum-type photoconductors for forming an image in a different color on each peripheral surface and the photoconductors having at least two different diameters; a plurality of driving sections for driving each photoconductor at a driving speed in accordance with the diameter so that each photoconductor rotates at a predetermined peripheral speed; a correction signal output section for outputting a speed correction signal to correct a periodic pitch fluctuation included in each formed image; and a drive control section for controlling the driving section to correct the driving speed of each photoconductor by the speed correction signal, wherein the speed correction signal is a signal having the same cycle as a rotational cycle of each photoconductor.

14 Claims, 37 Drawing Sheets

Even if two colors are shifted from the reference position, the misregistration is unnoticeable.

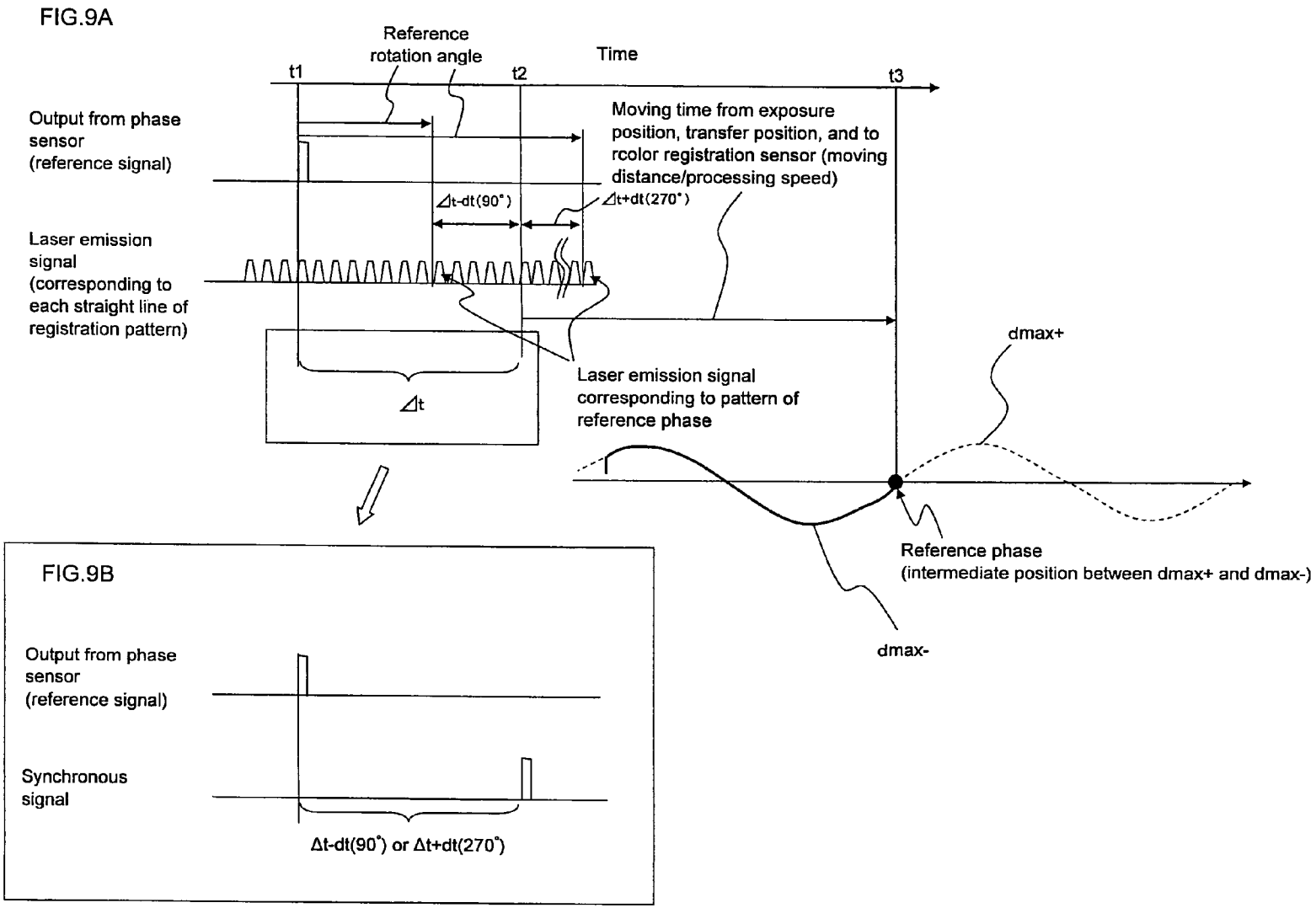
FIG.9A
Output from phase sensor (reference signal)
Laser emission signal (corresponding to each straight line of registration pattern)
Reference rotation angle
Time
t1
t2
t3
Moving time from exposure position, transfer position, and to rcolor registration sensor (moving distance/processing speed)
Δt-dt(90°)
Δt+dt(270°)
Δt
Laser emission signal corresponding to pattern of reference phase
dmax+
dmax-
Reference phase (intermediate position between dmax+ and dmax-)
FIG.9B
Output from phase sensor (reference signal)
Synchronous signal
Δt-dt(90°) or Δt+dt(270°)

Rotational phases of Y, M and C are matched to one another to make a correction with one modulation signal. (M is shifted in the rotating direction by 21.96° from position where phases are matched to one another, and C is shifted in the rotating direction by 21.96°×2 = 43.92° from position where phases are matched to one another)

Rotational phases of Y, M and C are matched to one another to make a correction with one modulation signal. (.) (M is shifted in the reverse rotating direction by 21.96° from position where phases are matched to one another, and Y is shifted in the reverse rotating direction by 21.96° × 2 = 43.92° from position where phases are matched to one another)

FIG.21 As for correction of K

FIG.24

1. In a case where synchronous signal advances from tref

If photoconductor stops at next synchronous signal, rotation angle remains advancing from reference. To adjust rotation angle, photoconductor is controlled to stop at timing of Δdr before synchronous signal.

2. In a case where synchronous signal delays from tref

If photoconductor stops at next synchronous signal, rotation angle remains delaying from reference. To adjust rotation angle, photoconductor is controlled to stop at timing of Δdr after synchronous signal.

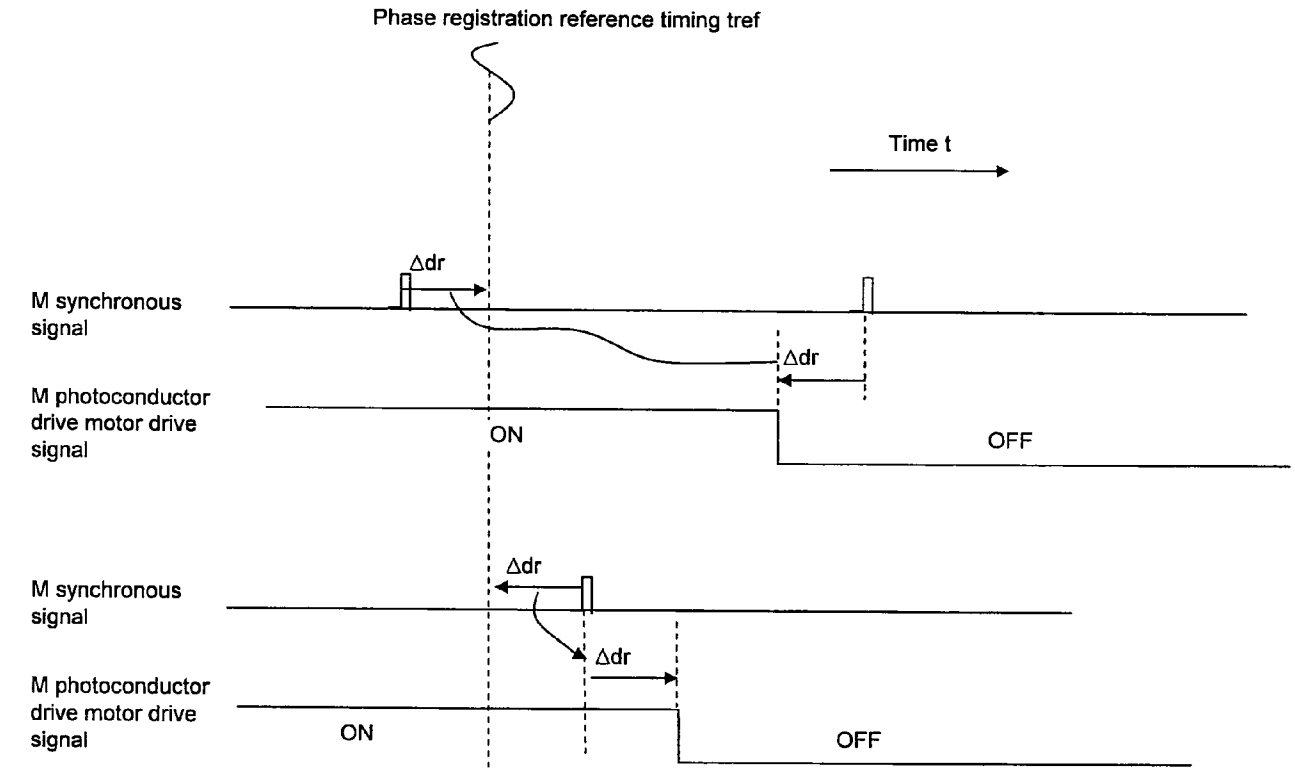

COLOR IMAGE FORMING APPARATUS

CROSS-REFERENCE TO RELATED APPLICATION

This application is related to Japanese patent application Nos. 2006-112585 and 2006-349824 which are filed on Apr. 14, 2006 and Dec. 26, 2006 respectively whose priorities are claimed under 35 USC § 119, the disclosure of which are incorporated by reference in its entirety.

BACKGROUND OF THE INVENTION

1. Field of the Invention

The present invention relates to a color image forming apparatus.

2. Description of the Related Art

There has been known a color image forming apparatus (so-called tandem-type color image forming apparatus) having a plurality of drum-type photoconductors. In the color image forming apparatus, it is important to suppress the positional deviation for every color (color misregistration) to an unnoticeable degree. When the color misregistration is great, it might be evaluated that the image quality is deteriorated. The greatest factor of the color misregistration is a periodic crude density on the output image caused by the eccentricity of each photoconductor. The ideal countermeasure is that the eccentric amount of each photoconductor is sufficiently reduced, but trade-off between cost and mass-productivity should be considered.

In view of this, various ideas have been provided to make the color misregistration unnoticeable even if the eccentric amount is the same. For example, an apparatus in which the peripheral length of each photoconductor drum and the peripheral length of the transfer belt are set to have ratios of whole numbers has been proposed (for example, Japanese Patent Laid-Open No. 7-261499).

When the phases of pitch fluctuations caused by the eccentricity of each photoconductor are not matched on the output image, the color misregistration becomes noticeable. This point is focused, and various ideas have been given for matching the phases of eccentricity of each photoconductor on the output image so as to make the color misregistration unnoticeable. In this case, in order to detect the rotational phase of each photoconductor, a toner pattern (toner image) having lines, parallel to the rotational axis of the photoconductor, arranged at equal spaces in the rotating direction is formed, and the deviation from the expected position is detected.

Alternately, a photoconductor that stores a pulse pattern for canceling a speed fluctuation of its one rotation, thereby driving a stepping motor and reducing the pitch fluctuation caused by the eccentricity, is known (for example, see Japanese Patent Laid Open No. 63-75759).

In addition, a photoconductor that applies fine adjustment individually to the rotation speed of a rotor so as to cancel a fluctuation thereof, by information of vibrating component regarding a periodic rotational fluctuation, is known (for example, see Japanese Patent Laid Open No. 10-78734).

Usually, the color image forming apparatus performs the image formation by using three primary colors of yellow, cyan and magenta, and black. The tandem-type image forming apparatus includes four photoconductors corresponding to each color. In the case of the monochromatic image formation, only the black photoconductor is used.

In such an image forming apparatus, when a ratio of occupancy of the monochromatic image formation to an entire body is large, only black photoconductor is deteriorated rapidly. In this case, unbalance is generated at a maintenance time of each photoconductor of monochromatic color and others (yellow, cyan, and magenta). Therefore, a standard ratio of monochromatic image formation and color image formation is previously estimated at the time of designing, and in accordance with the estimated ratio, the service life of the photoconductor is set.

Further, there is an image forming apparatus that prevents other photoconductors from being actuated, at the time of the monochromatic image formation. By doing so, this image forming apparatus is capable of preventing a deterioration of the photoconductor and a developer not contributing to image formation. In addition, this image forming apparatus is capable of setting a moving speed (process speed) on a photoconductor surface at the time of monochromatic image formation faster than the moving speed at the time of color image formation, thereby also setting its print speed faster.

From the viewpoint of prolonging the service life of the black photoconductor and setting the process speed faster, it is preferable that the diameter of the photoconductor is increased. However, if only the diameter of the black photoconductor is greater than the diameter of the other photoconductors, various subjects involved with the color image formation arise.

The representative one is the subject relating to the color misregistration. Since the rotational cycle of the black photoconductor is different from those of the other photoconductors, the technique for matching the direction of the eccentricity to make the color misregistration unnoticeable cannot be taken. Meanwhile, in the case of generating correction patterns of the number of the photoconductors to cancel a speed fluctuation of one rotation of the photoconductor, the configuration is complicated and the cost is disadvantageously increased in most cases.

A technique for making the color misregistration unnoticeable with a simple configuration has been desired even in case where a plurality of types of photoconductors, each having a different diameter, are used.

SUMMARY OF THE INVENTION

The present invention is accomplished in view of the aforesaid circumstances, and provides a technique for suppressing a variation in an image pitch corresponding to the rotational cycle of each photoconductor with a simple configuration, even if a plurality of types of photoconductors, each having a different diameter, are used, whereby a color misregistration is made unnoticeable.

The present invention provides a color image forming apparatus including: a plurality of drum-type photoconductors for forming an image in a different color on each peripheral surface and the photoconductors having at least two different diameters; a plurality of driving sections for driving each photoconductor at a driving speed in accordance with the diameter so that each photoconductor rotates at a predetermined peripheral speed; a correction signal output section for outputting a speed correction signal to correct a periodic pitch fluctuation included in each formed image; and a drive control section for controlling the driving section to correct the driving speed of each photoconductor by the speed correction signal, wherein the speed correction signal is a signal having the same cycle as a rotational cycle of each photoconductor.

Since the image forming apparatus of the present invention includes the correction signal output section for outputting the speed correction signal to correct a periodic pitch fluctuation included in each formed image and the drive control section for controlling the driving section to correct the driving speed of each photoconductor by the speed correction signal, wherein the speed correction signal is a signal having the same cycle as a rotational cycle of each photoconductor, the pitch fluctuation having the same cycle as a rotational cycle of each photoconductor is corrected, thereby an image having suppressed pitch fluctuation can be obtained. A pitch fluctuation is included in each image of each color respectively, and is recognized as a color misregistration. Accordingly, with the image forming apparatus of the present invention, an image with little color misregistration can be obtained.

BRIEF DESCRIPTION OF THE DRAWINGS

FIGS. 9A and 9B are explanatory views for explaining the relationship between a reference rotation angle and a reference phase with respect to FIG. 8;

FIG. 24 is an explanatory view showing the state in which a control section 40*a* adjusts the rotational phase, in this embodiment;

DESCRIPTION OF THE PREFERRED EMBODIMENT

Figure 1:
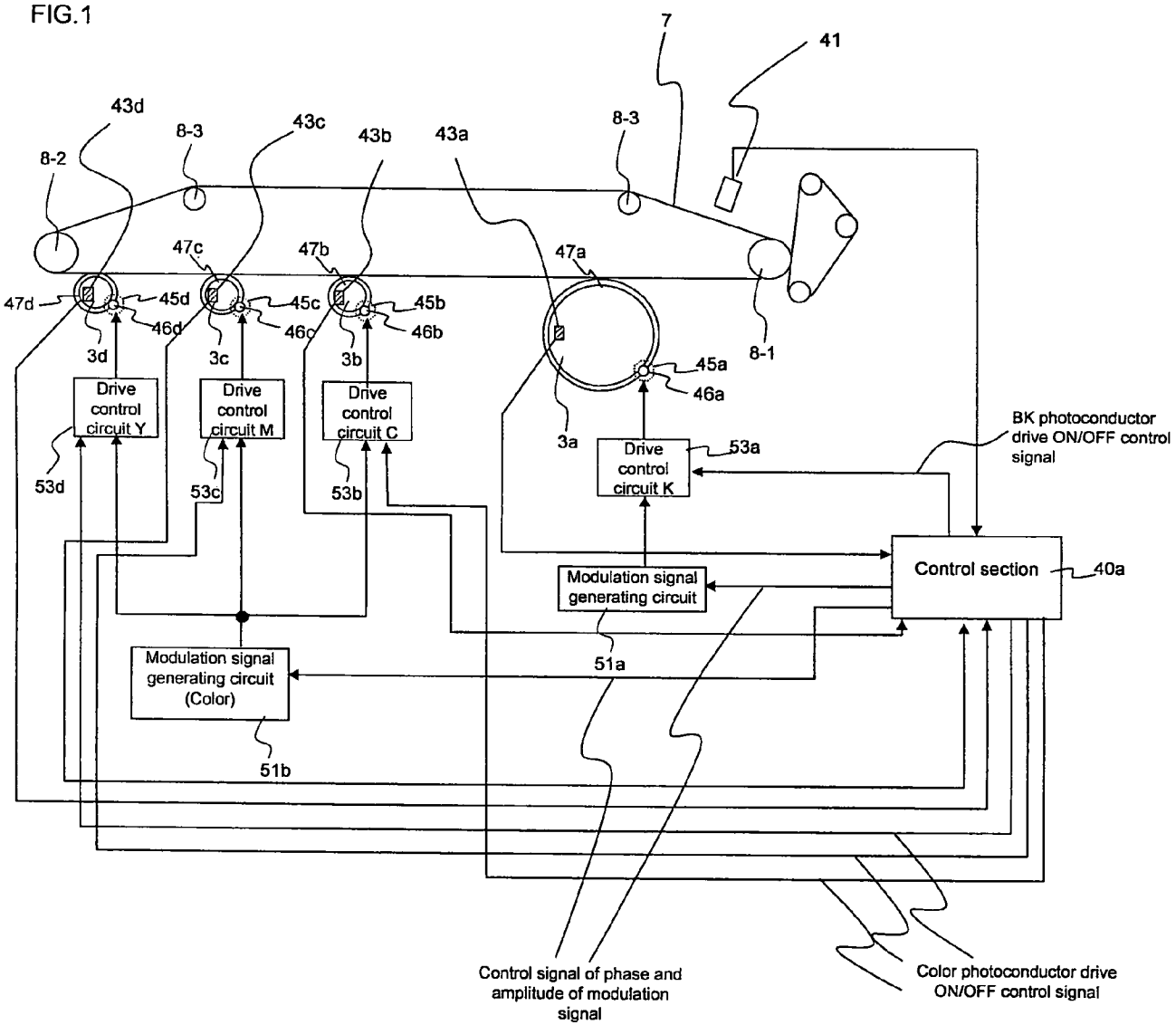
FIG. 1 is an explanatory view showing a block configuration for correcting a pitch fluctuation component in this embodiment.

In the image forming apparatus of the present invention, the image pitch refers to an interval of dots (pixels) constituting the image, and in this specification, particularly, refers to the interval of the pixels along a moving direction of a periphery of each photoconductor drum. Although each pixel must be aligned at a predetermined interval (reference pitches), the image prepared on the image forming apparatus includes partially different image pitches, namely, includes a periodic fluctuation component (pitch fluctuation component). It can be so considered that the fluctuation of the image pitches is mainly generated by an eccentricity of the photoconductor drum or its driving gear. Namely, a peripheral speed of the photoconductor drum is fluctuated by the eccentricity, and this fluctuation is expressed as the fluctuation of the image pitches.

An entire part of or a part of the correction signal output section, the drive control section, and the correction signal generating section may be realized by executing a control program by a microcomputer, for example. Accordingly, an entity of a speed correction signal may not be a physical electric signal, but may be data as a processing object of the microcomputer.

Here, photoconductors for the most general colors such as black, yellow, cyan, and magenta are given as an example, but the number and the kind are not limited thereto.

The speed correction signal may be a common signal of the photoconductors having the same diameter. By doing so, the configuration of the image forming apparatus can be simplified, by using a common speed correction signal.

Further, the image forming apparatus of the present invention may further include: a registration image forming section for forming a registration image including a plurality of patterns on each photoconductor; a measurement section for measuring a position of each pattern of the formed registration image; and a fluctuation component calculation section for calculating an amplitude and a phase of a pitch fluctuation component corresponding to the rotational cycle of the photoconductor based on a measurement result of each pattern, wherein the correction signal output section may include a correction signal generating section for generating the speed correction signal for every kind of the diameters based on the calculated amplitude and phase.

Each photoconductor may be composed of a black image forming photoconductor having a diameter of a first size and a plurality of color image forming photoconductors having diameters of a second size.

Moreover, the color image forming photoconductor may be composed of a yellow image forming photoconductor, a magenta image forming photoconductor, and a cyan image forming photoconductor.

The size of the diameter of the black image forming photoconductor may be larger than the size of the diameter of the color image forming photoconductor.

The speed correction signal may be a common signal of the photoconductors having mutually the same diameter, and the correction signal generating section may calculate an average of a maximum amplitude and a minimum amplitude of the amplitude of the pitch fluctuation of each photoconductor to which the speed correction signal is applied, and may generate the speed correction signal by using the calculated amplitude. By doing so, the image forming apparatus of the present invention is capable of determining an amplitude of the speed correction signal applied to a plurality of photoconductors, suitable for suppressing the pitch fluctuation component of each photoconductor.

Moreover, at least a part of the correction signal output section may further include: a switch section for switching a condition that the generated speed correction signal is outputted or not outputted to the drive control section of each photoconductor; and a switch control section for switching the switch section corresponding to the photoconductor in accordance with the size of the amplitude of the pitch fluctuation component of each photoconductor. By doing so, in the photoconductor with a pitch fluctuation component of smaller amplitude than a predetermined amplitude, by switching the switch section, the speed correction signal is made not to be outputted. Accordingly, an excessive correction can be prevented.

The image forming apparatus of the present invention may further include: a transfer member for transferring an image formed by each photoconductor; and a rotational phase adjustment section for adjusting a rotational phase of the photoconductor, wherein each photoconductor may be composed of a black image forming photoconductor having a diameter of a first size and a plurality of color image forming photoconductors having diameters of a second size, and each photoconductor may be disposed along the transfer member at a predetermined interval; the rotational phase adjustment section may calculate a relative misintegration amount of the phase of the pitch fluctuation component included in the image formed by each color image forming photoconductor and transferred to the transfer member, and may adjust the rotational phase so that periodic phases of the speed fluctuation of each color image forming photoconductor are matched based on the misintegration amount of the calculated phase.

By doing so, since each color image forming photoconductor with mutually matching phases of periodic speed fluctuations is corrected by a common speed correction signal, the speed correction signal of reverse phase that cancels its eccentricity is applied to each of the photoconductors. Accordingly, the pitch fluctuation of each color is efficiently suppressed.

The phase of the periodic speed fluctuation is a rotational phase of the photoconductor, with a reference phase as will be described later as a reference. An adjustment of the rotational phase means the adjustment of a relative rotational phase of each photoconductor with the same diameter size.

Note that a transfer member may be a belt-shaped intermediate transfer member with a toner image formed by each photoconductor transferred to its surface, but the transfer member is not limited thereto, and may be the one supporting and transporting a sheet on which an image is transferred.

Alternately, the image forming apparatus of the present invention may further include: a transfer member for transferring an image formed by each photoconductor; and a rotational phase adjustment section for adjusting a rotational phase of each photoconductor, wherein each photoconductor may be composed of a black image forming photoconductor having a diameter of a first size and a plurality of color image forming photoconductors having diameters of a second size, and each photoconductor may be disposed along the transfer member at a predetermined interval; at least a part of the correction signal output section may further include a delay section for delaying the speed correction signal from the correction signal output section for each photoconductor; the rotational phase adjustment section may adjust the rotational phase of each color image forming photoconductor based on the calculated phase, so that the phases of the pitch fluctuation component included in the image formed by each color image forming photoconductor and transferred to the transfer member are matched; and the delay section may delay each speed correction signal so as to have the phase to cancel the pitch fluctuation component in accordance with a previously defined angle in accordance with the interval.

By doing so, the color misregistration caused by the eccentricity of the photoconductor is unnoticeable, because the rotational phase of each color image forming photoconductor is adjusted so that the phases of the pitch fluctuation components included in the image match to each other. In addition, the pitch fluctuation component of each color is efficiently suppressed, because each speed correction signal is delayed to the phase canceling the pitch fluctuation component.

Each photoconductor may include: a phase sensor for detecting a reference value used in a control of the rotational phase and outputting a reference signal, wherein at least a part of the correction signal output section may further include a delay amount adjustment section for adjusting a delay amount of the delay section; the delay amount adjustment section may compare phases between the reference signal and the generated speed correction signal in the middle of forming the image, and may adjust the delay amount to suppress a time-sequential change of the phase of the speed correction signal with respect to the reference signal based on a comparison result. By doing so, a change with lapse of time is prevented from generating in the phase of the speed correction signal with respect to the rotational phase of each photoconductor during forming the image including a plurality of pages.

Here, even when a common speed correction signal is applied to the photoconductors having mutually the same diameter, it may be so constituted that the phases of the speed correction signal generated in the correction signal generating section are matched to the photoconductor (reference photoconductor) previously defined as a reference, and the phases of the other photoconductor with respect to the reference photoconductor are adjusted by the delay section. A reference photoconductor with a most advancing phase in disposing the photoconductor may be selected.

At least a part of the correction signal output section may further include an amplitude adjustment section for adjusting an amplitude of the generated speed correction signal for each photoconductor. By doing so, even when a common speed correction signal is applied to the photoconductors with mutually the same sized diameter, the speed correction signal of the amplitude corresponding to the amplitude of the pitch fluctuation component of each photoconductor can be outputted.

Moreover, in the image forming apparatus of the present invention, each photoconductor may include: a phase sensor for detecting a reference position used in a control of the rotational phase and outputting a reference signal; and a mark adding section for adding a mark to a registration image in accordance with an output of the reference signal. By doing so, when a registration image is printed and the adjustment of the amplitude and the phase of the speed correction signal is visually performed, a mark can be used as a reference of the phase.

The correction signal generating section may generate a speed correction signal of a reverse phase to the phase of the periodic speed fluctuation of a reference photoconductor, with a photoconductor having a maximum amplitude calculated as a reference photoconductor. By doing so, a largest pitch fluctuation component can be surely suppressed. Accordingly, the color misregistration can be efficiently suppressed.

The rotational phase adjustment section may determine each rotational phase so that a rotational phase of other color image forming photoconductor is matched to the rotational phase of the reference photoconductor.

In the image forming apparatus of the present invention, the interval may be an interval between positions of adjacent color image forming photoconductors in contact with the transfer member, respectively, and the interval may be a distance different from the integral multiple of a peripheral length of the color image forming photoconductor.

Alternatively, in the image forming apparatus of the present invention, the patterns of the registration image may include a plurality of straight lines extending orthogonal to a rotating direction of the photoconductor, and the amplitude and the phase of the pitch fluctuation component may be calculated by the measurement section by measuring a deviation of a position of each straight line from a reference position.

Note that a stepping motor can be used as a photoconductor drive motor, but the photoconductor drive motor is not limited thereto, and a servo-controlled DC motor, for example, may be used.

In addition, each photoconductor has a drum shape, but the photoconductor may have a belt-shape also. In this case, the eccentricity of a drive roller for driving the belt-shaped photoconductor appears as a main fluctuation component of the image pitches. Accordingly, the present invention may be applied to the drive roller of a photoconductor.

The present invention will be explained in detail with reference to drawings. It is possible to better understand the present invention from the explanation described below. Notably, the explanation described below should be considered to be only illustrative, and not restrictive in all aspects.

(Outline of Image Forming Apparatus)

In the present embodiment, the outline of the mechanical structure of a color image forming apparatus according to one embodiment of the present invention will be explained.

Figure 2:
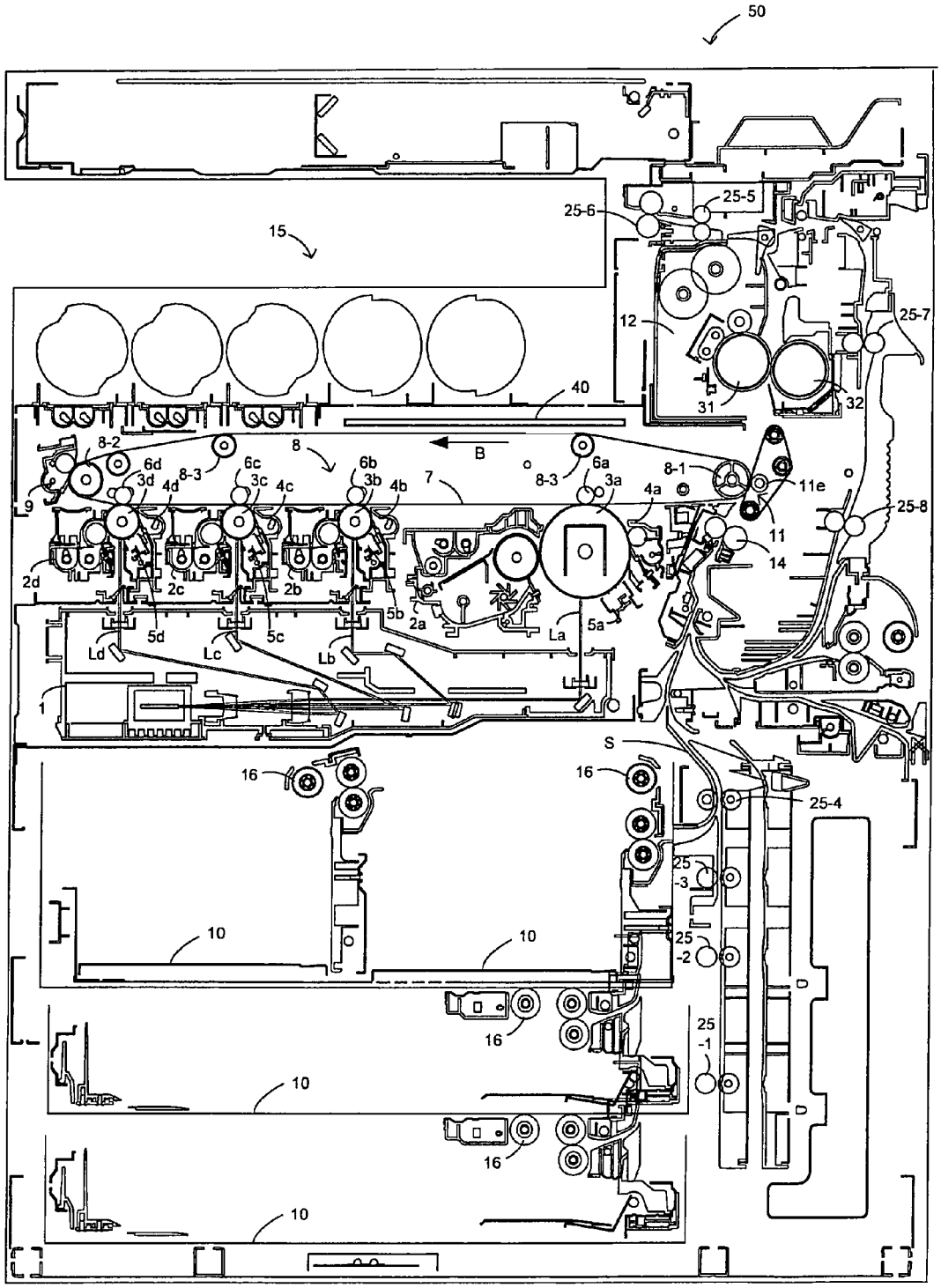
FIG. 2 is a sectional view showing a configuration of an image forming apparatus according to the present invention.

FIG. 2 is a sectional view showing the configuration of the image forming apparatus according to the present invention. The image forming apparatus 50 forms a multicolor image or monochrome image to a predetermined sheet in accordance with image data externally transmitted. As shown in the figure, the image forming apparatus 50 is an electrophotographic image forming apparatus composed of an exposure unit 1, developing units 2, photoconductor drums 3, chargers 5, cleaner units 4, an intermediate transfer belt unit 8, a fuser unit 12, a sheet transporting path S, a sheet feeding tray 10, a sheet exit tray 15, and the like.

The image data handled by the image forming apparatus is in accordance with a color image using each of black (K or BK), cyan (C), magenta (M), and yellow (Y). Therefore, four developing units 2 (2*a*, 2*b*, 2*c*, 2*d*), four photoconductor drums 3 (3*a*, 3*b*, 3*c*, 3*d*), four chargers 5 (5*a*, 5*b*, 5*c*, 5*d*), and four cleaner units 4 (4*a*, 4*b*, 4*c*, 4*d*) are provided according to each color. The alphabets appended to each numeral represent such that a corresponds to black, b corresponds to cyan, c corresponds to magenta, and d corresponds to yellow. Four types of latent images are formed at the peripheral surface of each of the photoconductor drums 3. Specifically, four image stations are provided corresponding to each color.

The configuration of one of the image stations will be explained as the representative of four image stations. The other image stations have the same configuration. Accordingly, the alphabets appended to each numeral are omitted. The charger 5 is a charging means for uniformly charging the surface of the photoconductor drum 3 with a predetermined potential. Examples of the charging means include a brush-type charger and a charger-type charger in addition to a contact-type roller as shown in FIG. 2.

The exposure unit 1 is an exposure means for selectively exposing the surface of the charged photoconductor. As the exposure means, a writing head in which light-emitting devices such as EL or LED are arranged in an array may be used instead of the laser scanning unit (LSU) shown in FIG. 2. The LSU 1 has a laser irradiating section and a polygon mirror. The LSU 1 reflects a laser beam L from the laser irradiating section to the rotating polygon mirror so as to deflect the laser beam L, thereby scanning the surface of the photoconductor. The laser beam L is modulated in accordance with the image data produced by reading a document or produced by an external computer.

The photoconductor drum 3 charged by the laser beam L modulated with the image data is scanned and exposed, whereby an image having a potential corresponding to the image data (electrostatic latent image) is formed on the surface of the photoconductor drum 3. The developing unit 2 develops the latent image formed on the photoconductor drum 3 (makes the latent image formed on the photoconductor drum 3 visible) with a toner of any one of colors of K, C, M, and Y. The cleaner unit 4 removes and collects the residual toner on the surface of the photoconductor drum 3 after the image is developed and transferred as described below.

The intermediate transfer belt unit 8 is arranged above the photoconductor drum 3. The intermediate transfer belt unit 8 includes an intermediate transfer belt 7, an intermediate transfer belt drive roller 8-1, an intermediate transfer belt tension mechanism 8-3, an intermediate transfer belt driven roller 8-2, an intermediate transfer roller 6 (6*a*, 6*b*, 6*c*, 6*d*), and an intermediate transfer belt cleaning unit 9.

The intermediate transfer belt drive roller 8-1, the intermediate transfer belt tension mechanism 8-3, the intermediate transfer roller 6, the intermediate transfer belt driven roller 8-2, and the like stretch the intermediate transfer belt 7 and drive the same so as to rotate in the direction shown by an arrow B.

The intermediate transfer roller 6 is rotatably supported at an intermediate transfer roller mounting section of the intermediate transfer belt tension mechanism 8-3 at the intermediate transfer belt unit 8. A transferring bias voltage for transferring the toner image formed on the photoconductor drum 3 to the intermediate transfer belt 7 is applied to the intermediate transfer roller 6.

The intermediate transfer belt 7 is provided to be in contact with the respective photoconductor drums 3 for each color. The toner image of each color formed on the surface of the photoconductor drum 3 is successively transferred to the intermediate transfer belt 7 by the transferring bias voltage applied to the intermediate transfer roller 6. Thus, a color toner image (multi-color toner image) is transferred onto the intermediate transfer belt 7 in a multi-layered manner. The intermediate transfer belt 7 is made by forming a film having a thickness of about 100 μm to 150 μm into an endless shape.

As described above, the intermediate transfer roller 6 is in contact with the back side of the intermediate transfer belt 7, and it is a transferring means for transferring the toner image onto the intermediate transfer belt 7 from the photoconductor drum 3. A transferring bias voltage of about several hundred volts (the voltage having a polarity (+) opposite to the charging polarity (−) of toner) for transferring the toner image is applied to the intermediate transfer roller 6.

The intermediate transfer roller 6 has a metallic (for example, stainless) shaft having a diameter of 8 to 10 mm as a base. A conductive elastic member (for example, EPDM, urethane foam) is covered on its surface. The conductive elastic member makes it possible to apply a generally uniform voltage to the intermediate transfer belt. In this embodiment, a manual transfer roller is used as the transferring means. However, in addition to this configuration, a brush-type transfer electrode (transfer brush) may be brought into contact with the back side of the intermediate transfer belt 7 for use as the transferring means.

The toner image transferred onto the intermediate transfer belt 7 moves to a transfer section 11, where the transfer roller 11*e* is arranged, with the rotation of the intermediate transfer belt 7.

The intermediate transfer belt 7 and the transfer roller 11*e* are brought into pressing contact with each other with a predetermined nip width. Further, a bias voltage (high voltage having a polarity (+) opposite to the charging polarity (−) of toner) for transferring the toner image onto a later-described sheet is applied to the transfer roller 11*e*. Either one of the transfer roller 11*e* and the intermediate transfer belt drive roller 8-1 is made of a hard material (metal or the like), and the other one is an elastic roller in which the surface of a core metal is covered by a soft material (elastic rubber roller, foaming-resin roller or the like). This can constantly provide a nip of a predetermined width.

The toner is adhered onto the intermediate transfer belt 7 at an area other than the area where the image is transferred onto the sheet by the contact with the photoconductor drum 3. Further, there exists a toner that is not transferred onto the sheet by the transfer roller 11*e* to remain on the intermediate transfer belt 7. These toners might cause the toner colors to be mixed in the subsequent processes. Thus, the intermediate transfer belt cleaning unit 9 is provided to remove and collect the toners on the intermediate transfer belt 7. The intermediate transfer belt cleaning unit 9 is provided with a cleaning blade serving as a cleaning member, the end of which is in contact with the intermediate transfer belt 7 for removing the toners. The portion of the intermediate transfer belt 7 in a portion where the intermediate transfer belt cleaning unit 9 is in contact with the intermediate transfer belt 7 is supported by the intermediate transfer belt driven roller 8-2 from the back side.

On the sheet feeding tray 10, sheets used for the image formation are stacked. The sheet feeding tray 10 is disposed below the exposure unit 1 of the image forming apparatus 50. On the other hand, the sheet exit tray 15 is disposed at an upper part of the image forming apparatus 50. On the sheet exit tray 15, printed sheets are ejected and stacked in such a way that the printed sides face downward.

Further, the image forming apparatus 50 is provided with the sheet transporting path S, having generally a perpendicular shape, through which a sheet on the sheet feeding tray 10 is conveyed to the sheet exit tray 15 via the transfer section 11 and the fuser unit 12. In the vicinity of the sheet transporting path S between the sheet feeding tray 10 and the sheet exit tray 15, for example a pick-up roller 16, a registration roller 14, the transfer section 11, the fuser unit 12, and transport rollers 25 (25-1 to 25-8) for transporting the sheet are disposed.

A plurality of transport rollers 25-1 to 25-4 are small rollers that facilitate and support conveying of the sheets and are provided along the sheet transporting path S. The pick-up roller 16 is disposed at an end portion of the sheet feeding tray 10, and conveys sheets, one by one, from the sheet feeding tray 10 to the sheet transporting path S.

The registration roller 14 temporarily holds the sheet being conveyed through the sheet transporting path S at a predetermined position. The registration roller 14 has a function of conveying the sheet to the transfer section 11 at such a timing that the front end of the toner image formed on the intermediate transfer belt 7 is synchronized with the front end of the sheet.

The fuser unit 12 is provided with, for example, a heat roller 31 and a pressure roller 32. The heat roller 31 and the pressure roller 32 rotate with a sheet sandwiched therebetween.

The heat roller 31 is controlled by a control section of a control substrate 40 such that an unillustrated heater arranged in the heat roller 31 has a predetermined fusing temperature on the basis of a signal from a temperature detection unit (not illustrated). The heat roller 31 and the pressure roller 32 apply heat and pressure to the sheet, which is passed between the heat roller 31 and the pressure roller 32, so that the color toner images transferred onto the sheet are melted, mixed, and pressed. As a result, the color toner images are heat fused with the sheet.

The sheet with the fixed multi-color toner image is transported, by the transport rollers 25-5 and 25-6, to a reversed-sheet exit path of the sheet transporting path S. Then, the sheet, which has been reversed upside down (the multi-color toner image is facing downward), is ejected to the sheet exit tray 15.

Next, the sheet transporting path will be explained in detail. A sheet cassette 10 for accommodating sheets beforehand is provided in the image forming apparatus.

The sheet feeding tray 10 is provided with the corresponding pick-up roller 16, at its end portion, that supplies the sheets, one by one, to the sheet transporting path.

The sheet conveyed from the sheet feeding cassette 10 is conveyed to the registration roller 14 by the transport rollers 25-1 to 25-4 disposed on the sheet transporting path and then stops. The registration roller 14 sends the sheet to the transfer section 11 at such a timing that the front end of the sheet meets the front end of the toner image on the intermediate transfer belt 7. At the transfer section 11, the toner image on the intermediate transfer belt 7 is transferred onto the sent sheet. Thereafter, the toner image passes the fuser unit 12. At this time, the non-fixed toner on the sheet is fused by heat, naturally cooled after passing through the fuser unit 12, and then, fixed onto the sheet. Then, the sheet is conveyed to the transport roller 25-5, then, to the sheet exit roller 25-6 and finally, ejected to the sheet exit tray 15.

The control substrate 40 is arranged below the sheet exit tray 15. The control substrate 40 has a microcomputer for controlling the operation of each section of the image forming apparatus 50, a ROM that stores a control program executed by the microcomputer, and a RAM that provides a working area for the process of the microcomputer and a storage area of image data. The microcomputer executes the control program to function as a control section. The above-described image formation, transfer of toner image, transport of sheet, temperature control of the fuser unit, and the like are realized by the function of the control section.

The control substrate 40 has an input circuit and an output circuit. Inputted to the input circuit are signals from the sensors arranged at each section in the image forming apparatus 50, whereby the microcomputer can perform the processing by using the inputted signals. The output circuit is the one for outputting a signal for driving loads arranged at each section.

As described above, it is considered that the largest cause of the color misregistration is the eccentricity between the photoconductor drum 3 and a driven gear 47. The pitch fluctuation component by the eccentricity of each photoconductor is included in the image formed by each photoconductor for each color. When a mismatch occurs in this pitch fluctuation, this mismatch is recognized as the color misregistration of the image.

Figure 5B:
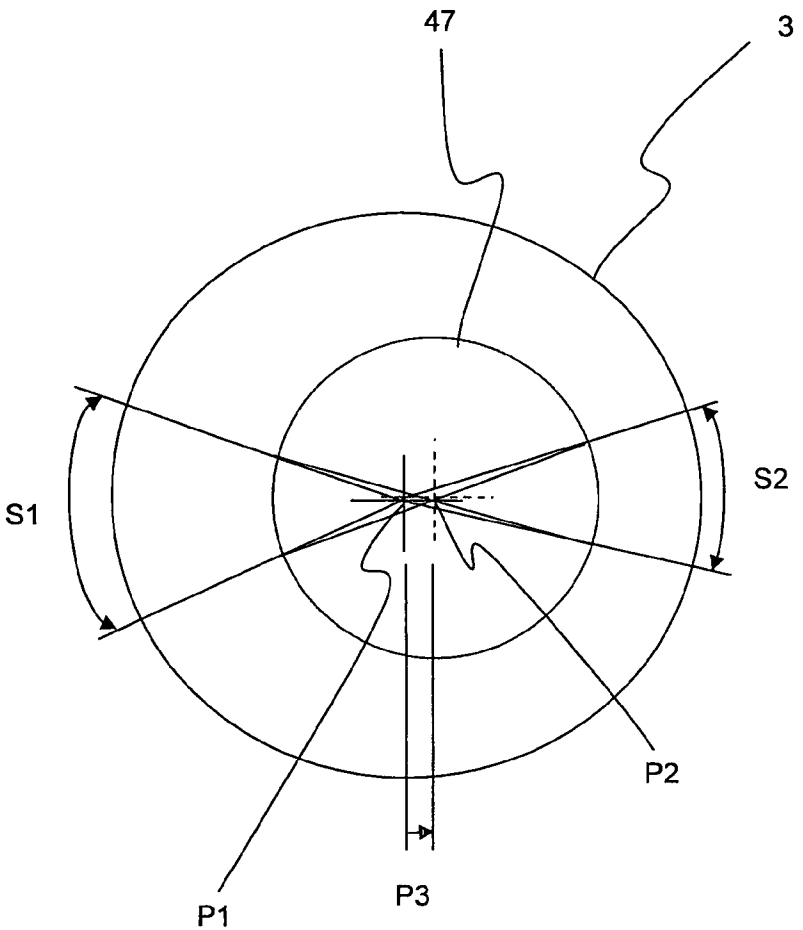
FIGS. 5A and 5B are explanatory views showing a photoconductor drum 3 in the image forming apparatus shown in FIG. 3 and a drive mechanism of a photoconductor drive motor 45 for driving the photoconductor drum 3.
Figure 5A:
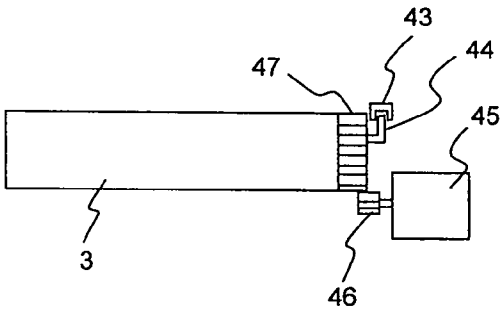

FIGS. 5A and 5B are explanatory views showing a drive mechanism of the photoconductor drum 3 and a photoconductor drive motor 45 for driving the same. FIG. 5A is a side view of the photoconductor drum 3 and the photoconductor drive motor 45 seen from the direction orthogonal to the rotational axis of the photoconductor drum 3. At one end of the photoconductor drum 3, a flange of the photoconductor drum 3 is provided, and a driven gear 47 is provided integrally with the flange.

Each photoconductor drum 5 is driven by the corresponding photoconductor drive motor 45. The rotation of the drive motor 45 is controlled by the control section. A drive gear 46 is fitted to the output axis of the photoconductor drive motor 45. The drive gear 46 is engaged with the driven gear 47.

As shown in FIG. 5A, a phase sensor 43 for producing a reference signal to control the rotational phase is disposed to correspond to each photoconductor drum 3. A projection 44 is provided at the side of the photoconductor drum 3. The phase sensor 43 outputs the reference signal every time the projection 44 passes its detection portion by one rotation of the photoconductor drum 3. A photointerrupter can be used for the phase sensor, for example. Each of the reference signals is inputted to the input circuit of the control substrate 40. The control section adjusts the phase of each photoconductor by using the inputted reference signal, and controls driving of each photoconductor drive motor 45.

FIG. 5B is an explanatory view conceptually showing the state of the eccentricity between the photoconductor drum 3 and the driven gear 47. FIG. 5B shows the state that a shaft center P2 for fitting the driven gear 47 is decentered from the rotational axis (shaft center) P1 of the photoconductor drum 3, and a shaft center P3 exists between these shaft centers. A region S1 where the moving speed involved in the rotation (peripheral speed) becomes faster, and a region S2 where it becomes slower, exist on a peripheral surface of the photoconductor drum 3. Namely, when a distance is long between a point where a driving gear 46 and the driven gear 47 are engaged with each other and the aforementioned rotational axis, the peripheral speed becomes slower. Reversely, when a distance between the point where the driving gear 46 and the driven gear 47 are engaged with each other and the aforementioned rotational axis is short, the peripheral speed becomes faster. Thus, the peripheral speed fluctuates, along with an eccentric direction of the driven gear 47, namely, a rotational phase of the photoconductor drum 3.

FIGS. 10A to 10E are explanatory views for explaining that the image pitch varies with respect to the reference pitch at the exposure position and the transfer position due to the eccentricity of the photoconductor in this embodiment.

Figure 10A:
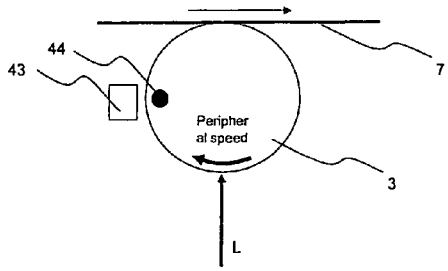
FIGS. 10A to 10E are explanatory views for explaining that the image pitch is fluctuated with respect to the reference pitch at an exposure position and a transfer position due to an eccentricity of the photoconductor, in this embodiment.

As shown in FIG. 10A, a scanning exposure is performed by laser beam to the peripheral surface of the photoconductor drum 3 at its generally lowermost point, whereby an electrostatic latent image is formed. The formed electrostatic latent image is developed by toner. When the peripheral surface reaches the transfer position at generally the uppermost position, which is after the half rotation of the photoconductor drum 3 after the scanning exposure, the developed toner image is transferred onto the intermediate transfer belt 7.

Figure 10B:
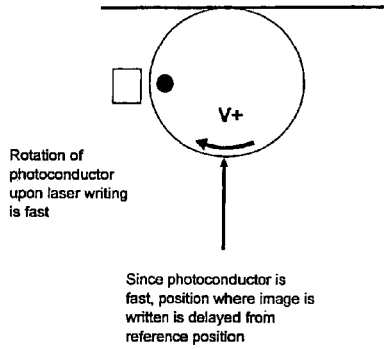
Figure 10C:
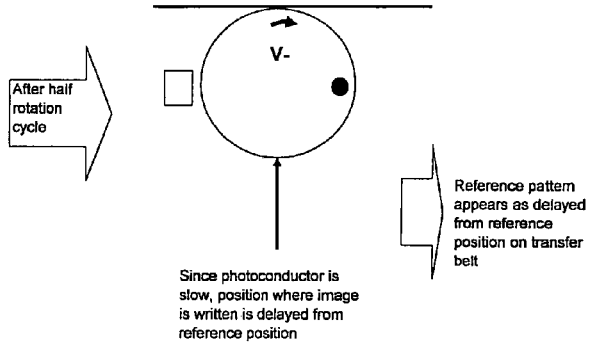

As shown in FIG. 10B, when the peripheral speed at the exposure position is faster than the reference speed, the pitch of the electrostatic latent image formed by the exposure increases than the reference pitch. As shown in FIG. 10C, when the exposed peripheral surface reaches the transfer position, the rotational phase of the photoconductor drum 3 increases by about 180 degrees, so that the peripheral speed is slower than the reference speed. Therefore, the pitch of the toner image transferred onto the intermediate transfer belt 7 increases more than the pitch of the toner image before the transfer.

Figure 10D:
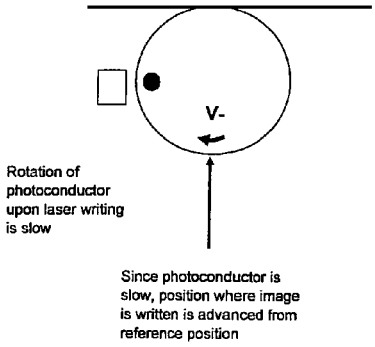
Figure 10E:
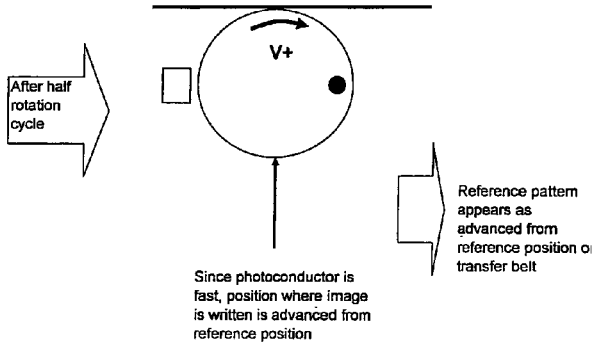

On the contrary, when the peripheral speed at the exposure position is slower than the reference speed as shown in FIG. 10D, the peripheral speed at the transfer position becomes fast, so that the image pitch of the transferred toner image is decreased as shown in FIG. 10E.

In FIG. 5B, an eccentric amount is shown in an extremely large size for easy understanding. The actual eccentric amount of each photoconductor drum 3 is a trace amount not understandable only by visual observation of the state of rotation of the photoconductor drum 3. Therefore, by preparing a toner pattern for color registration, then measuring its pitch fluctuation component, and calculating its amplitude and phase, the control for suppressing the color misregistration is performed.

In addition, the direction of eccentricity of each photoconductor is not previously known, but is found by a measurement of the registration toner pattern. However, in order to control the rotational phase of each photoconductor, the projection 44 needs to be previously provided. The control section controls the rotational phase of each photoconductor drum 3 by using a reference signal from each phase sensor 43 and each stored reference phase.

(Explanation 1 of Color Registration—Measurement of Misregistration Amount)

Figure 3:
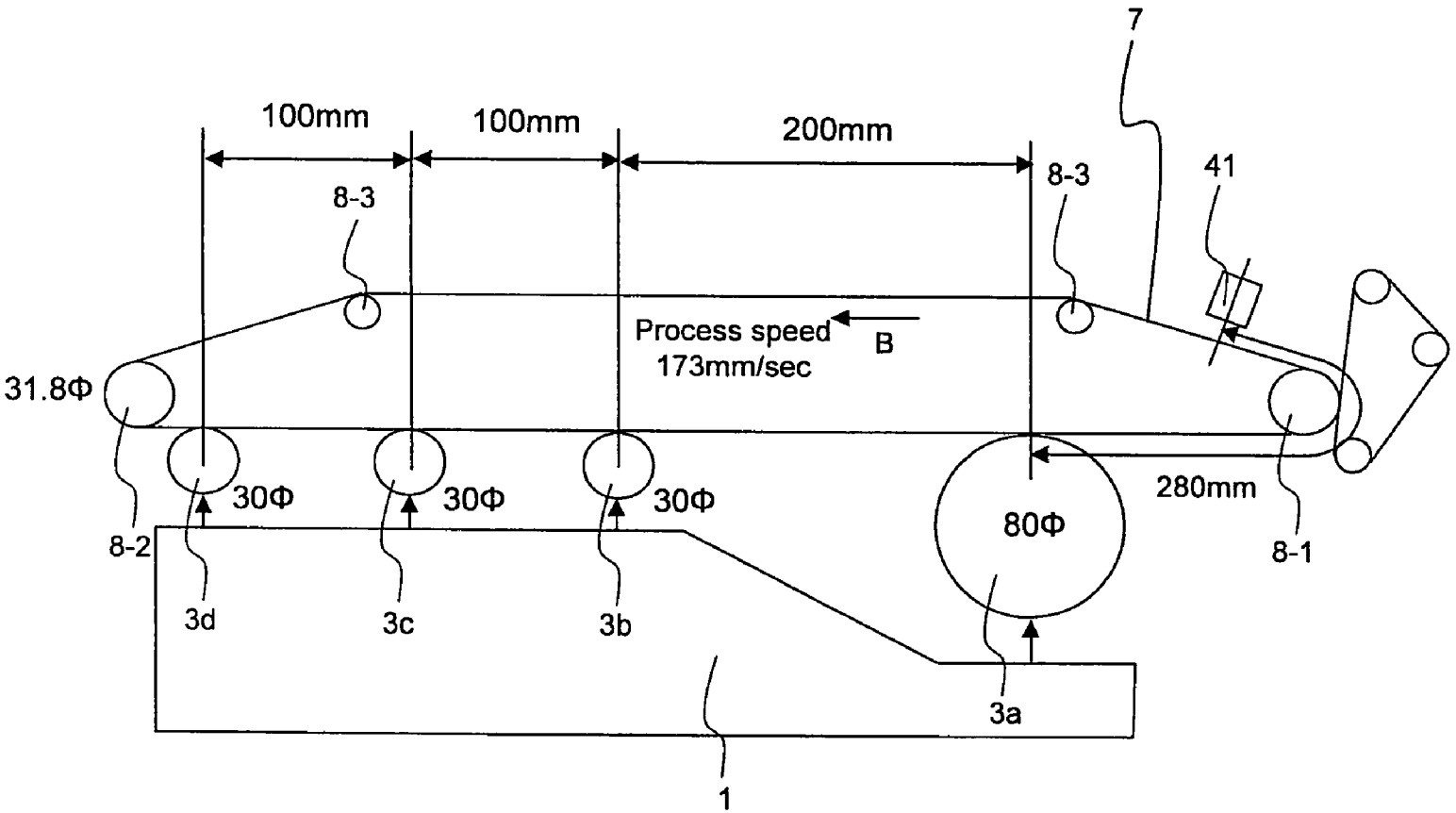
FIG. 3 is an explanatory view in which the portion relating to the color registration is calculated from the image forming apparatus shown in FIG. 2.

FIG. 3 is an explanatory view in which the portions relating to the explanation for the color registration is calculated from the image forming apparatus shown in FIG. 2. As described above, the intermediate belt 7 is driven by the transfer belt drive roller 8-1 to move in the direction of the arrow B. In the present embodiment, the diameter of the transfer belt drive roller 8-1 is 31.8 mm. A Y photoconductor drum 3*d*, an M photoconductor drum 3*c*, a C photoconductor drum 3*b*, and a K photoconductor drum 3*a* are arranged along the moving direction of the intermediate transfer belt 7. Each of Y, M, and C photoconductor drums has a transfer position that is in contact with the intermediate transfer belt 7.

The diameter of each of Y, M, and C photoconductor drums is 30 mm, and the diameter of the K photoconductor drum 3*a* is 80 mm. The difference in the diameter depends upon the design conditions such as a service life of the photoconductor, a processing speed (the moving speed of the surface of the photoconductor and the intermediate transfer belt 7 upon the image formation), and the like. The processing speed upon the color image formation in which the color misregistration becomes a significant problem is 173 mm/sec. The distance between the transfer point of the Y photoconductor drum 3*d* and the transfer point of the M photoconductor drum 3*c*, and the distance between the transfer point of the Y photoconductor drum 3*d* and the transfer point of the C photoconductor drum 3*b* are respectively 100 mm. The distance between the transfer point of the C photoconductor drum 3*b* and the transfer point of the K photoconductor drum 3*a* is 200 mm.

A color registration sensor 41 for measuring the color misregistration is arranged at a 280 mm downstream side of the transfer position of the K photoconductor drum 3*a*. The color registration sensor 41 is a color CCD sensor. However, such a sensor is not limited thereto, and an optical sensor for detecting a reflection light from the surface of the intermediate transfer belt 7 can be applied. The color registration toner pattern transferred to the intermediate transfer belt 7 is read. The read signal is inputted to the input circuit of the control substrate and processed by the control section.

(Explanation 2 of Color Registration—Suppression of Misregistration Amount by Speed Correction)

FIG. 1 is an explanatory view showing a block configuration for correcting a pitch fluctuation component in this embodiment. The image forming apparatus corrects the driving speed of each photoconductor based on the measurement result of a misregistration amount and suppresses the influence of its eccentricity. As shown in FIG. 1, each photoconductor drive motor 45 is controlled by drive control circuits 53 provided in each of the drive motors 45. Each drive control circuit 53 drives each photoconductor drive motor 45 at a driving speed corresponding to the diameter of each photoconductor. Further, in order to suppress the fluctuation of the peripheral speed corresponding to a rotational cycle of each photoconductor, a modulation signal from a modulation signal generating circuit 51 is inputted. Each drive control circuit 53 corresponds to a drive control section specified in the claims. Each modulation signal generating circuit 51 corresponds to a correction signal generating section specified in the claims. In addition, in the configuration of FIG. 1, a correction signal output section specified in the claims is composed of the correction signal generating section. Each modulation signal corresponds to a speed correction signal specified in the claims.

Figure 35:
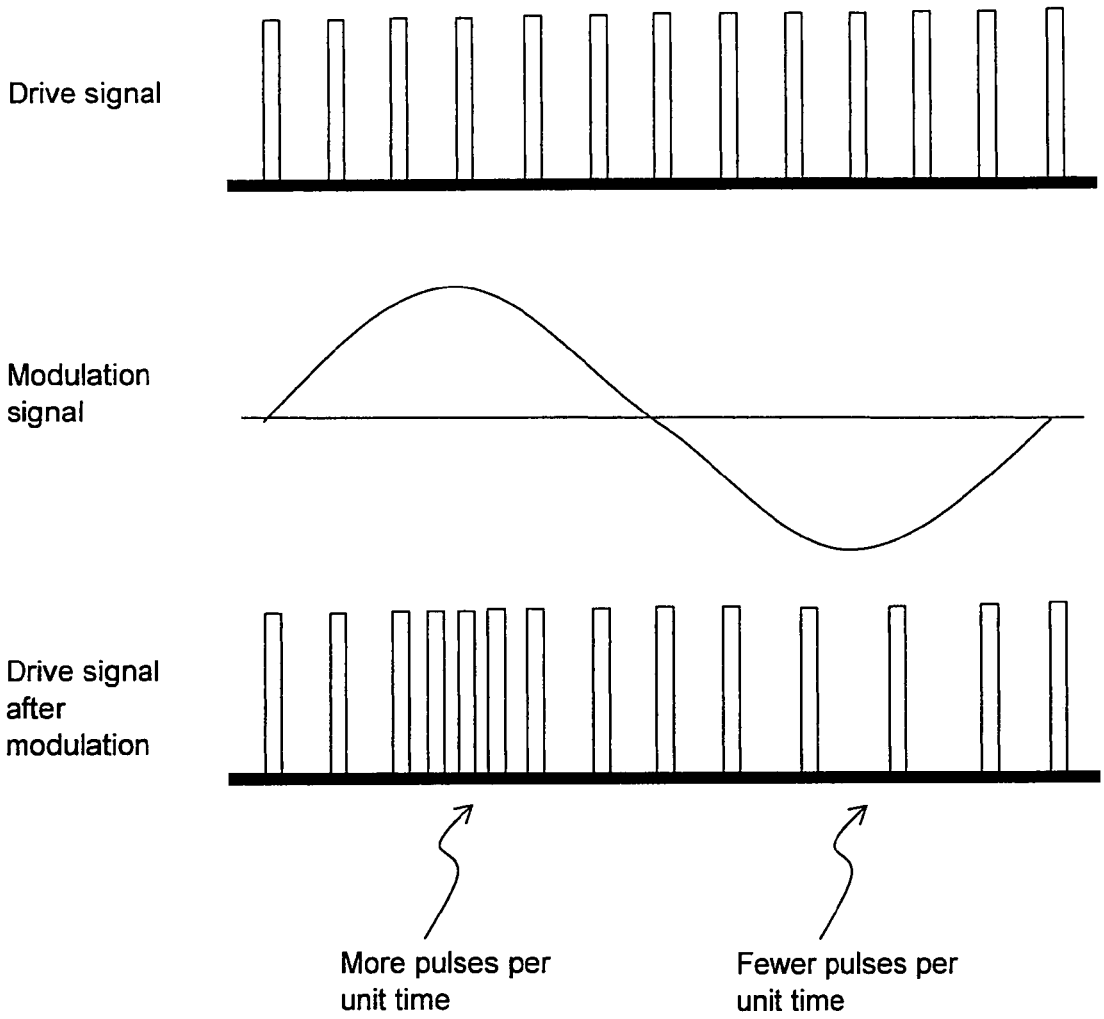
FIG. 35 is a waveform chart showing a waveform of a signal for driving each photoconductor drive motor 45 by each drive control circuit 53, in this embodiment.

In addition, FIG. 35 shows the state in which each drive control circuit 53 generates the driving signal obtained by modulating the driving signal at a constant speed based on the modulation signal, and drives each photoconductor drive motor 45 using the modulated driving signal. Each photoconductor drive motor 45 is a stepping motor. The driving signal shows a waveform of a drive pulse corresponding to a phase switching of the stepping motor.

The control section 40*a* is a block whose function is mainly realized by executing a control program by the microcomputer mounted on the control substrate 40 shown in FIG. 2. The control section 40*a* controls the movement of each section of the image forming apparatus. For example, the control section 40*a* outputs a drive ON/OFF control signal to the drive control circuit 53 of each photoconductor for indicating a start/stop of the photoconductor. Further, the control section 40*a* controls the phase and the amplitude of the modulation signal outputted by each modulation signal generating circuit 51. The signal from the color registration sensor 41 and the signal from the phase sensor 43 of each photoconductor are inputted in the control section 40*a*. Based on the information obtained from these signals, the control section 40*a* acquires the pitch fluctuation component of each photoconductor and the rotational phase of each photoconductor, and controls the phase and the amplitude of the modulation signal.

(Explanation 3 of Color Registration—Acquisition of the Phase and Amplitude of Main Fluctuation Component)

Figure 4A:
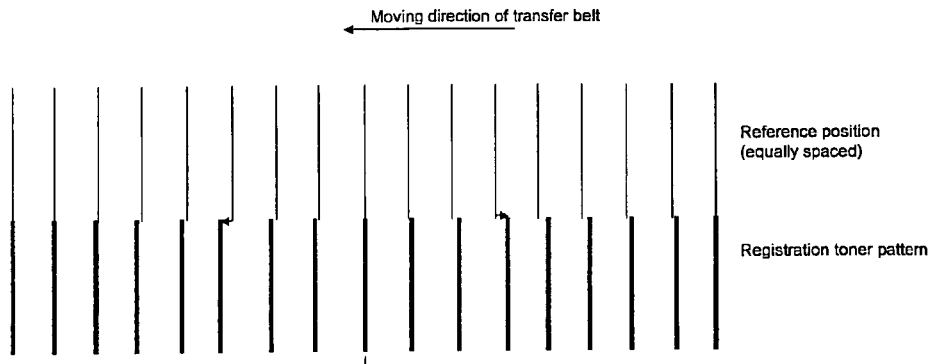
FIGS. 4A to 4C are explanatory views showing one example of a toner pattern for color registration in this embodiment.
Figure 4B:
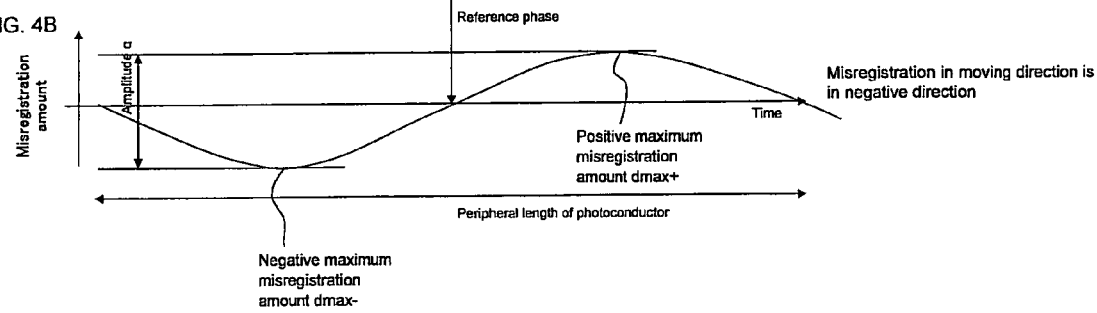
Figure 4C:
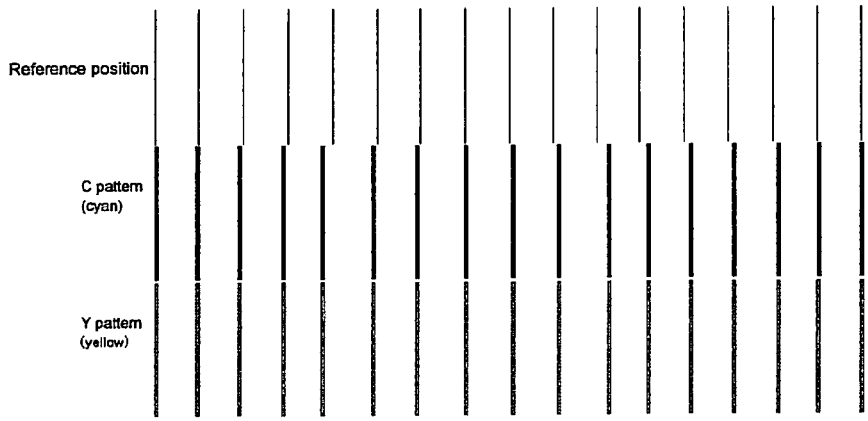

FIGS. 4A to 4C are explanatory views showing one example of the toner pattern for color registration in this embodiment. FIG. 4A is an explanatory view for explaining the toner pattern of one color and a concept of the measurement using this pattern. FIG. 4B is a graph showing the misregistration amount of each straight line, constituting the toner pattern, from the reference position with the read time by the color registration sensor 41 taken as an axis of abscissa. FIG. 4C shows patterns of two colors, i.e., C and Y. When mutual pitch fluctuation components on the toner pattern of each color have the same cycle and when the phases of them match to each other, the color misregistration is unnoticeable. Namely, when they have the same diameter of the photoconductor, the color misregistration can be made unnoticeable by adjusting the rotational phase of each photoconductor. However, in the case of a color in which diameters of the photoconductors are mutually different, it is impossible to apply the method of making the color registration unnoticeable by adjusting the rotational phase.

A plurality of (seventeen in FIG. 4A) parallel lines illustrated as a "registration toner pattern" are actually formed on the intermediate transfer belt 7 in FIG. 4A. Each straight line extends in the direction orthogonal to the moving direction of the intermediate transfer belt 7. It is preferable that the distance from the straight line at the head of the seventeen straight lines to the last straight line corresponds to the peripheral length of the photoconductor drum 3, i.e., the distance corresponding to one rotation of the photoconductor drum 3.

When the pattern shown in FIG. 4A passes through the reading point of the color registration sensor 41, the control section samples the timing when each straight line is read. Then, the control section obtains the misregistration amount from a reference clock at the read timing of each sampled straight line. The reference clock is a clock corresponding to the reference position shown in FIG. 4A. The reference clock has an equal pitch. (Generation timing of the reference clock will be described later.) As described above, FIG. 4B shows a graph in which the axis of abscissa represents the reading time and the axis of ordinate represents the misregistration amount.

The control section obtains the periodic fluctuation phase and amplitude corresponding to the peripheral length of the photoconductor drum 3, on which the toner pattern is formed, from the misregistration amount obtained for each straight line.

FIG. 4B is a graph in which an axis of ordinate represents the misregistration amount of each straight line. In FIG. 4B, the positive maximum misregistration amount is $d_{max+}$, and the negative maximum misregistration amount is $d_{max-}$. The control section obtains the amplitude and phase of the periodic fluctuation corresponding to the peripheral length of the photoconductor drum 3 from the change of the misregistration amount. The example of obtaining the amplitude and phase is as follows. In order to obtain the amplitude, first, the maximum value $d_{max+}$ and the minimum value $d_{max-}$ of each misregistration amount are obtained. The difference between the obtained positive maximum misregistration amount $d_{max+}$ and the negative maximum misregistration amount $d_{max-}$ becomes an amplitude value $\alpha$. The phase is obtained such that the intermediate position of the positive maximum misregistration amount $d_{max+}$ and the negative maximum misregistration amount $d_{max-}$ is defined as the reference phase. The reference phase is defined at the point where the difference becomes zero during the change of the misregistration amount from negative to positive. In FIG. 4B, the ninth straight line from the head of the test pattern is obtained as the reference phase.

Note that in this embodiment, the "misregistration amount" refers to a numeric value corresponding to the measurement result of each straight line of the toner pattern. Namely, each misregistration amount is a value indicating the misregistration from the reference position. The "pitch fluctuation component" corresponds to the time-sequential set of the misregistration amount. Although each misregistration amount is simply one numeric value, the pitch fluctuation component, being its time-sequential set, has a periodic change. Accordingly, the pitch fluctuation component has the phase and the amplitude.

A quantitative relationship between the pitch fluctuation and the misintegration amount will be explained. As shown in FIGS. 10A to 10E, when the peripheral speed at the exposure position is faster than the reference speed, the misintegration amount is generated in a positive direction in FIG. 4B as the pitch fluctuation component. Thereafter, the peripheral speed is decreased to the reference speed. However, the misintegration amount generated by then in the positive direction is not decreased, unless the peripheral speed is more decreased than the reference speed. Accordingly, when the peripheral speed is decreased to the reference speed, positive misintegration amount is still continued. Thereafter, when the photoconductor speed is more decreased than the reference speed, the misintegration amount in a negative direction is generated. Then, the misintegration amount in the positive direction is canceled out.

Figure 34A:
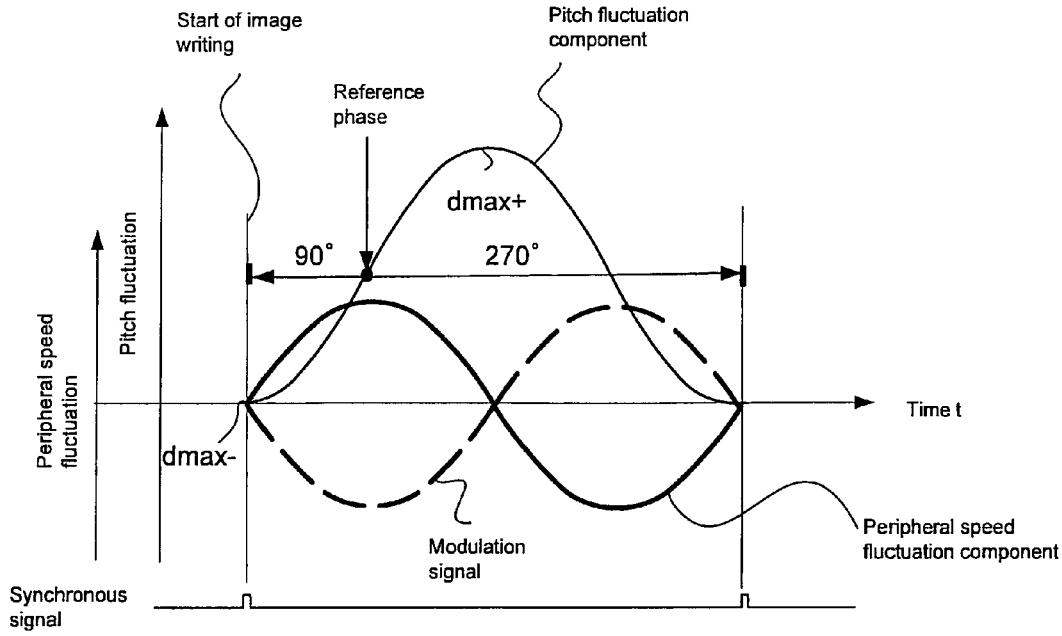
FIGS. 34A and 34B are waveform charts showing the peripheral speed fluctuation component and the pitch fluctuation component of the photoconductor, in this embodiment.
Figure 34B:
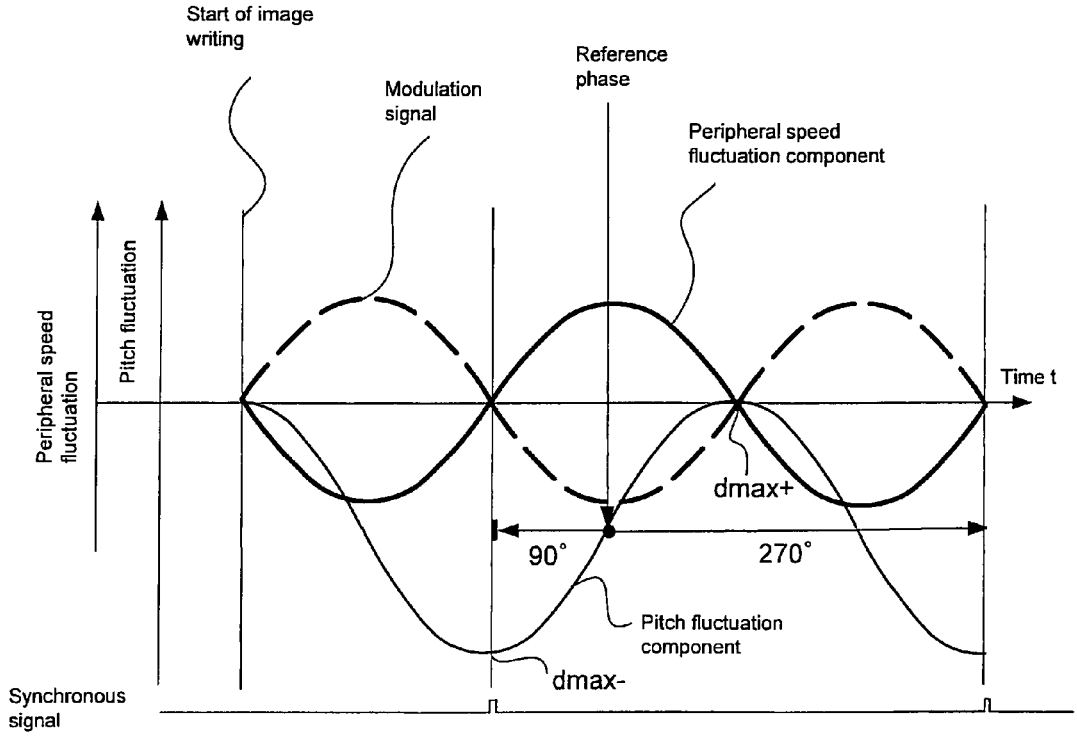

This relationship is shown in waveform charts of FIGS. 34A and 34B. The phase of the peripheral speed fluctuation component of the photoconductor is recorded as an image during exposure. For detecting this peripheral speed fluctuation component as the misintegration amount, there is a time difference of moving time, such as the exposure position to the transfer position, and then to the color registration sensor 41, namely the time corresponding to (½ of the peripheral length of the photoconductor+distance from the transfer position to the color registration sensor)÷process speed. When a BK photoconductor is taken as an example, $(80\times\pi/2+280)\div173=2.34$ (sec) is established. Note that as shown in FIG. 2, this time difference is different in each photoconductor. In FIGS. 34A and 34B, the graph of the pitch fluctuation component is traced back and moved by the aforementioned time difference and is overlapped on the graph of the peripheral speed fluctuation component. The abscissa axes of FIGS. 34A and 34B indicate time "t". The peripheral speed fluctuation component at each time and the fluctuation of the misintegration amount (pitch fluctuation component) by this peripheral speed fluctuation component are taken on the ordinate axis.

FIG. 34A shows a case that the photoconductor speed from an image writing start time is increased and is decreased thereafter. FIG. 34B shows a case that the photoconductor speed is decreased from the image writing start time and is increased thereafter.

The control section obtains the amplitude and the phase of the pitch fluctuation component of each photoconductor drum 3 when the toner pattern of each color is formed by performing the aforementioned measurement for each color.

Figure 36A:
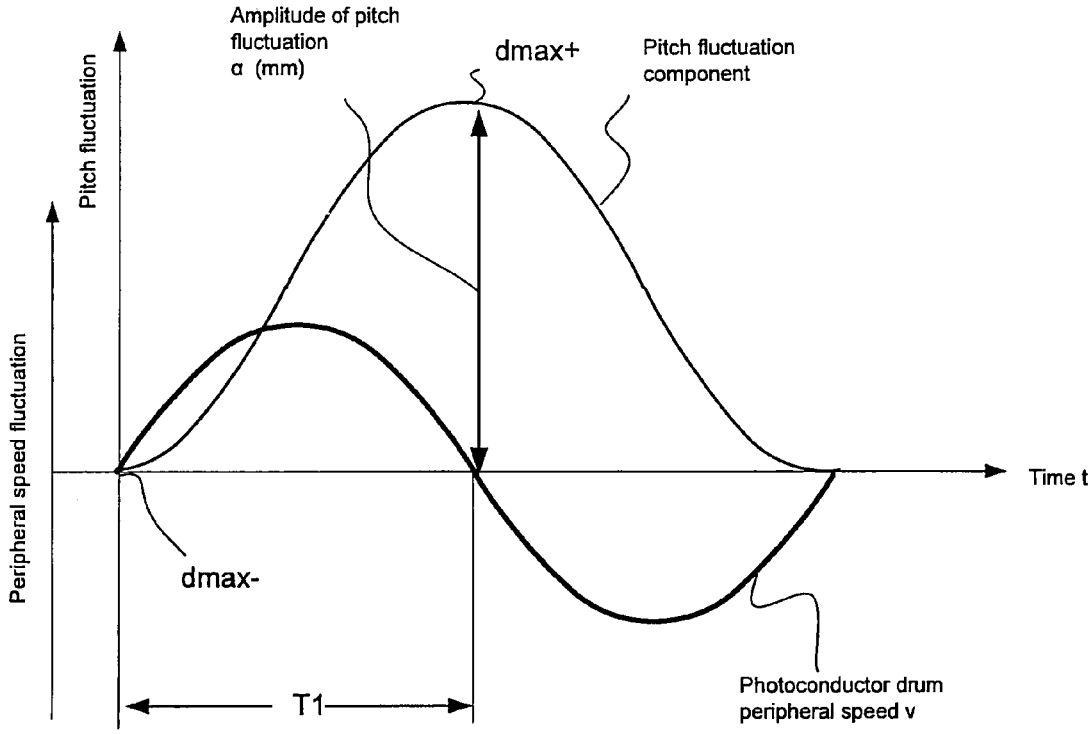
FIGS. 36A and 36B are waveform charts showing a relationship of an amplitude value $\alpha$ of the pitch fluctuation component, and an amplitude ratio $A_V$ of a speed correction signal for correcting its peripheral fluctuation, in this embodiment.
Figure 36B:
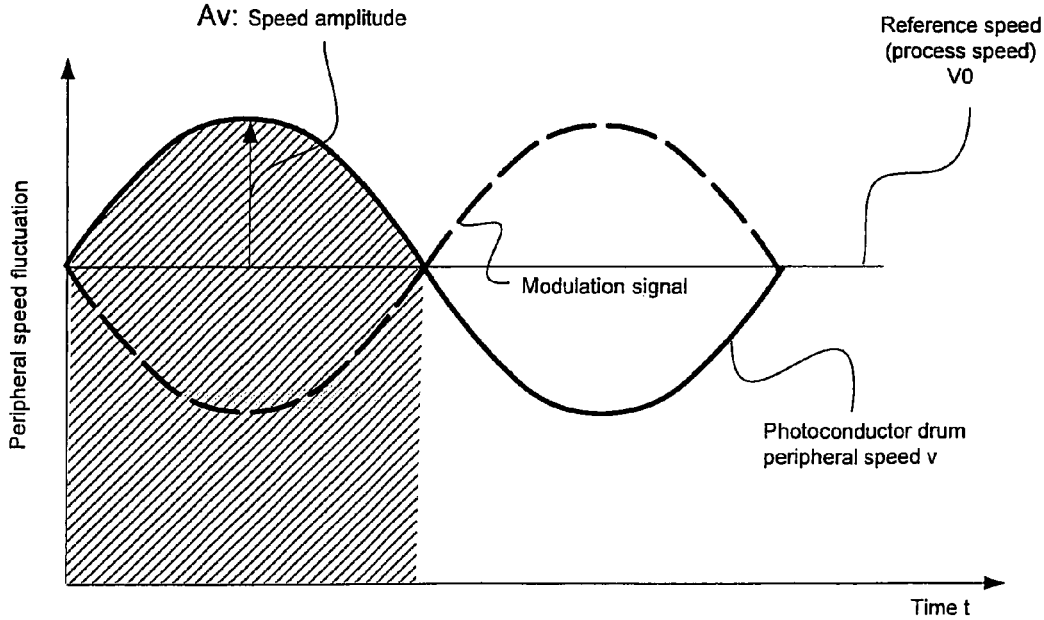

FIGS. 36A and 36B are waveform charts showing a relationship of the aforementioned amplitude value α, an amplitude component in the peripheral speed of the photoconductor when driven by the driving signal modulated by the modulation signal for correcting the peripheral fluctuation, and a speed amplitude ratio $A_v$ being the ratio to a reference speed $V_0$. FIGS. 36A and 36B correspond to FIG. 34A. The relationship between the amplitude value α and the amplitude ratio $A_v$ is as follows.

With respect to the time, the peripheral speed (mm/sec) of the photoconductor drum including the peripheral fluctuation is expressed as:

$$v=V_0+(A_v\cdot V_0)\sin \omega t \quad \text{(Formula 1)}$$

$V_0$: Reference speed (process speed) (mm/sec)

$A_v$: Speed amplitude ratio (ratio of amplitude of peripheral speed fluctuation with respect to $V_0$)

ω: Each speed of photoconductor drum (rad/sec)

t: Time (sec).

At this time, as a half cycle of the peripheral speed fluctuation, the formula is established as:

$$\int_0^{t1} v\,dt-v_0\cdot t_1=\alpha \quad \text{(Formula 2)}$$

Figure 37:
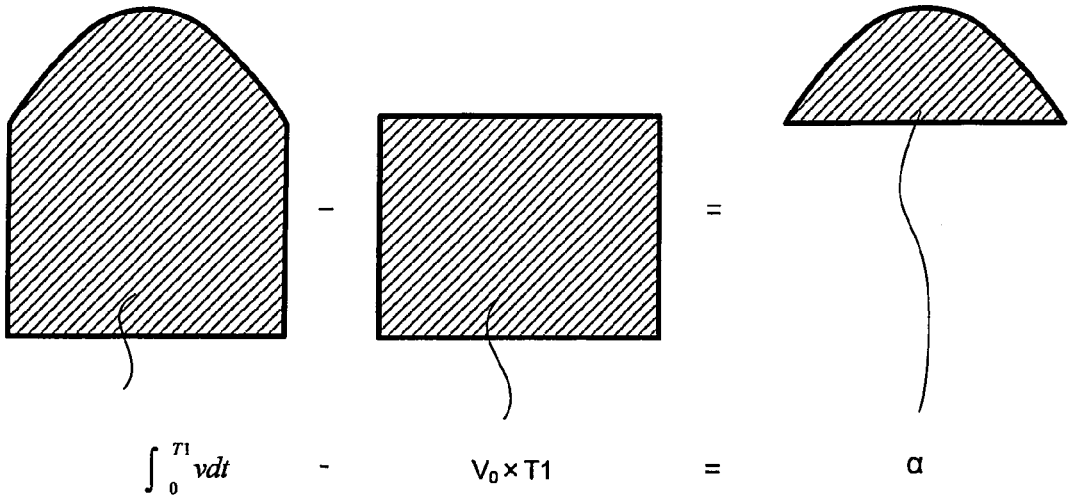
FIG. 37 is an explanatory view schematically showing a relationship between a relation formula of the amplitude value $\alpha$ of the pitch fluctuation component and the amplitude ratio $A_V$, and a waveform shown in FIG. 36B, in this embodiment.

T1: Time required for carrying out half-round rotation by the photoconductor drum π/ω (sec).

α is defined as ½ for the reason as follows. As shown in FIGS. 10A to 10E, the pitch fluctuation is generated during laser writing by the peripheral speed fluctuation of the photoconductor, and the pitch fluctuation is generated again during transferring the registration toner pattern on the transfer belt. This is because the pitch fluctuation is corrected, because twice the value of an actual pitch fluctuation is detected as an amplitude value α by the color registration sensor. FIG. 37 is an explanatory view schematically showing a relationship between a waveform of a part sown by oblique lines in FIG. 36B and the aforementioned formulas.

$$\int_0^{t1} V_0(1+A_v\cdot\sin \omega t)dt-V_0\cdot T_1=\alpha/2 \quad \text{(formula 3)}$$

Namely, when $A_V$ is obtained from the following formula, $$A_V=\omega\cdot\alpha/4V_0 \quad \text{(Formula 4)}$$

is established. For example, when a diameter $D_P$ of the photoconductor drum is set at 30 (mm), and a process speed $V_0$ is set at 173 (mm/sec), an angular speed ω of the photoconductor drum is expressed as:

$$\omega=2\pi/\pi\cdot D_p/V_0=2V_0/D_p=3.7\pi(\text{rad/sec}). \quad \text{(Formula 5)}$$

When the amplitude value α of the obtained misintegration amount is expressed by α=2(dot)=84(μm), $$A_v=0.0014=0.14\ (\%)$$

is established.

Figure 6:
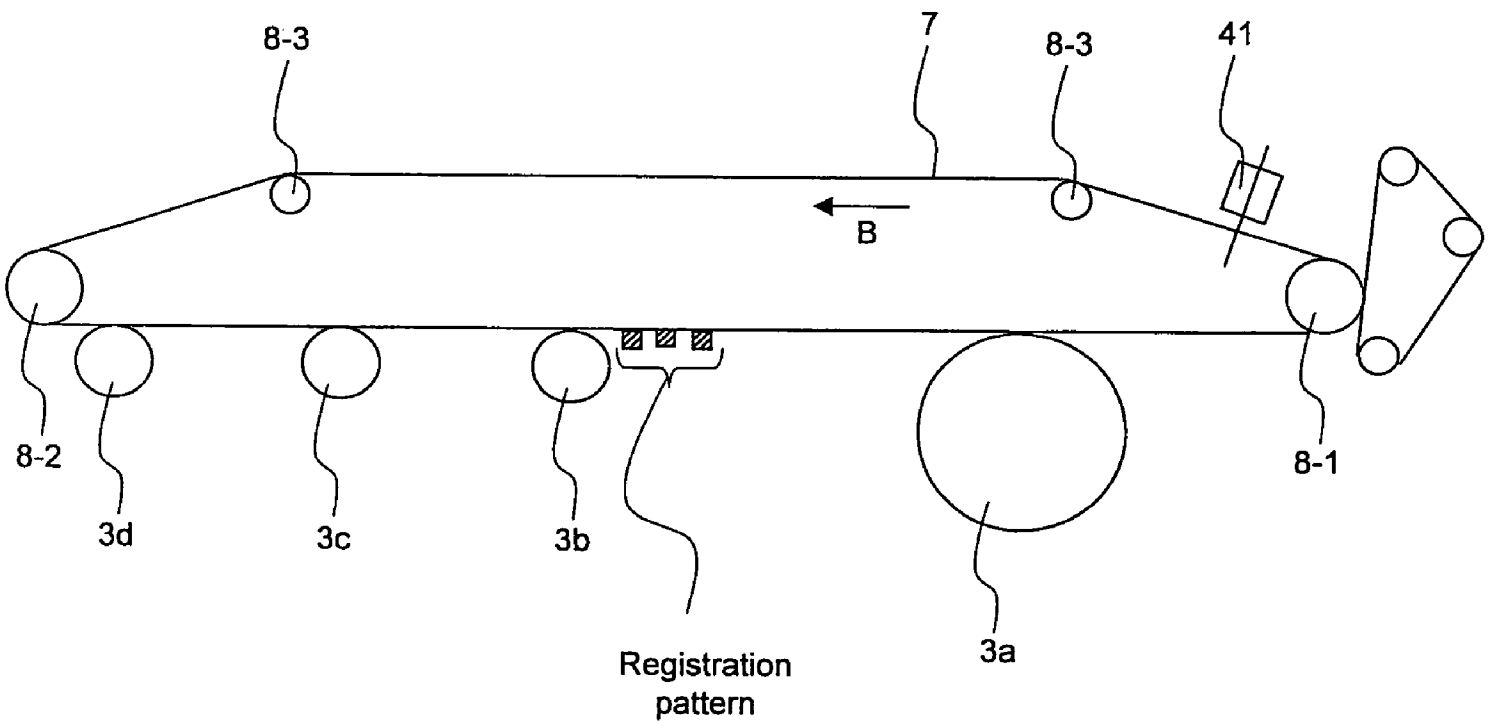
FIG. 6 is an explanatory view showing the state in which a color registration toner pattern is formed and measured by a color registration sensor 41, in this embodiment.
Figure 7:
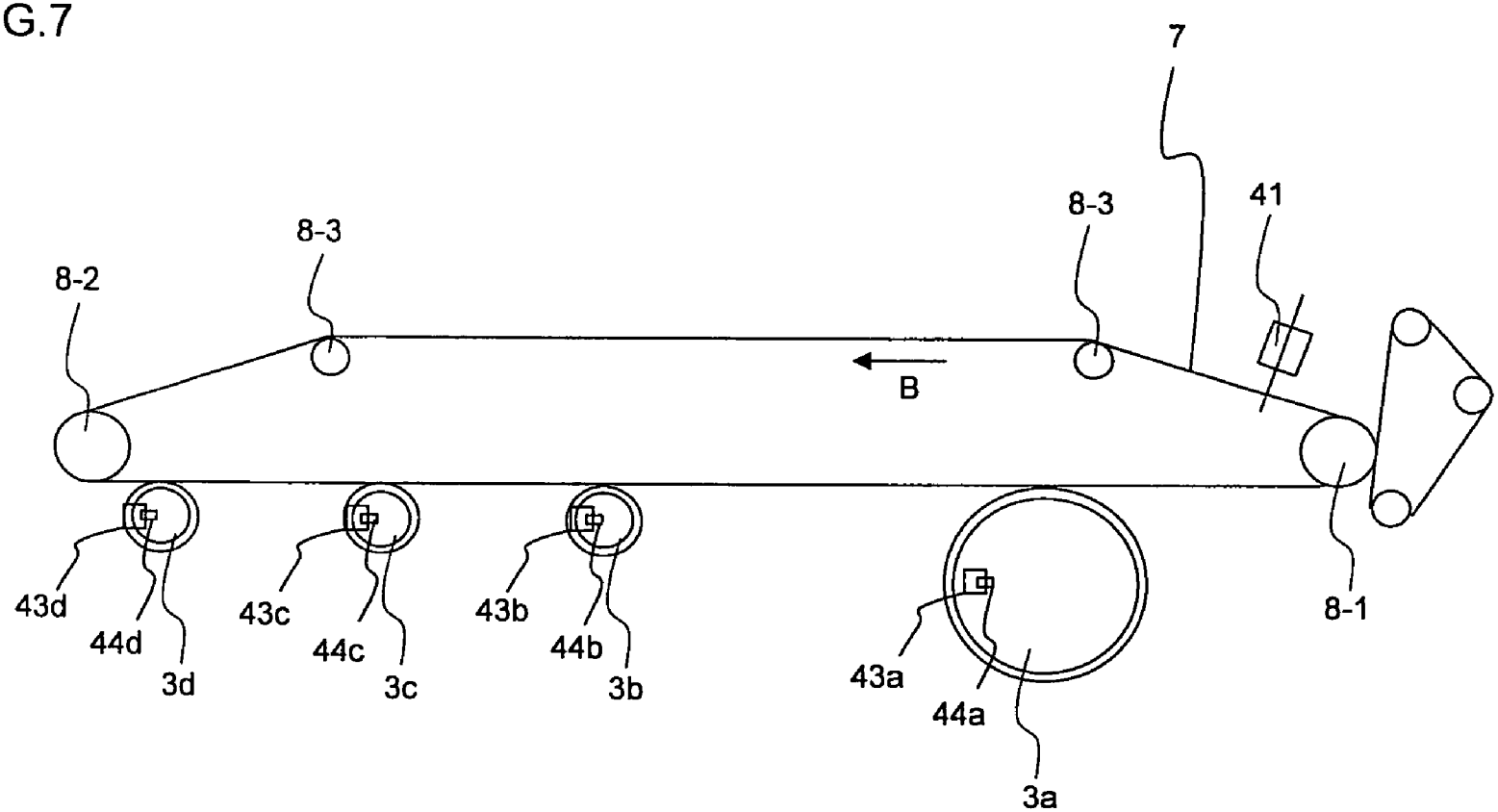
FIG. 7 is an explanatory view showing the state in which projections 44 and phase sensors 43 are provided so as to correspond to each photoconductor drum 3 shown in FIG. 3.

FIG. 6 is an explanatory view corresponding to FIG. 3, showing the state in which a color registration toner pattern is respectively formed on the photoconductor corresponding to each color, and the pitch of the registration toner pattern is measured by the color registration sensor 41. As shown in FIGS. 4A to 4C, each registration toner pattern is composed of seventeen straight lines.

(Explanation 4 of Color Registration—Adjustment of Rotational Phase of Photoconductor Drum)

As described above, in the case of photoconductors having the same diameter, the color misregistration can be made unnoticeable by matching the phases of the pitch fluctuation components of each color on the image, even if an absolute value of the eccentricity is not changed. FIG. 4C shows this concept. The misregistration amounts of the toner pattern of C (C pattern) and the toner pattern of Y (Y pattern) with respect to the reference position are equal to each other. However, if the phases of both of them are matched, the relative misregistration amount between each color is reduced. It has experientially been known that the human eye is sensitive more to the misregistration between each color than to the fluctuation of the absolute amount of the pixel pitch. Accordingly, as for the color in which the photoconductor drum 3 has the same diameter, the color misregistration becomes unnoticeable by adjusting the rotational phase of each photoconductor.

What must be taken notice here is that the position, where a point of each color overlapped one another as an output image is formed on each photoconductor, has a different angle with respect to the reference phase of each photoconductor. This is because the moving time required for the process of each photoconductor, such an exposure position to the transfer position, then to the color registration sensor is different. Only when the interval of each transfer position equals to the integral multiple of the peripheral length of the photoconductor, the point of each color is formed at a position having a matched angle to the reference phase of each color. Accordingly, rotational phases of the respective photoconductors are not necessarily matched, when a registration image is measured and the phases of the pitch fluctuation component included in this image are matched. However, in this embodiment, a common modulation signal is used for each photoconductor of Y, M and C. Therefore, correction is performed to match the rotational phases of the respective photoconductors.

Figure 8:
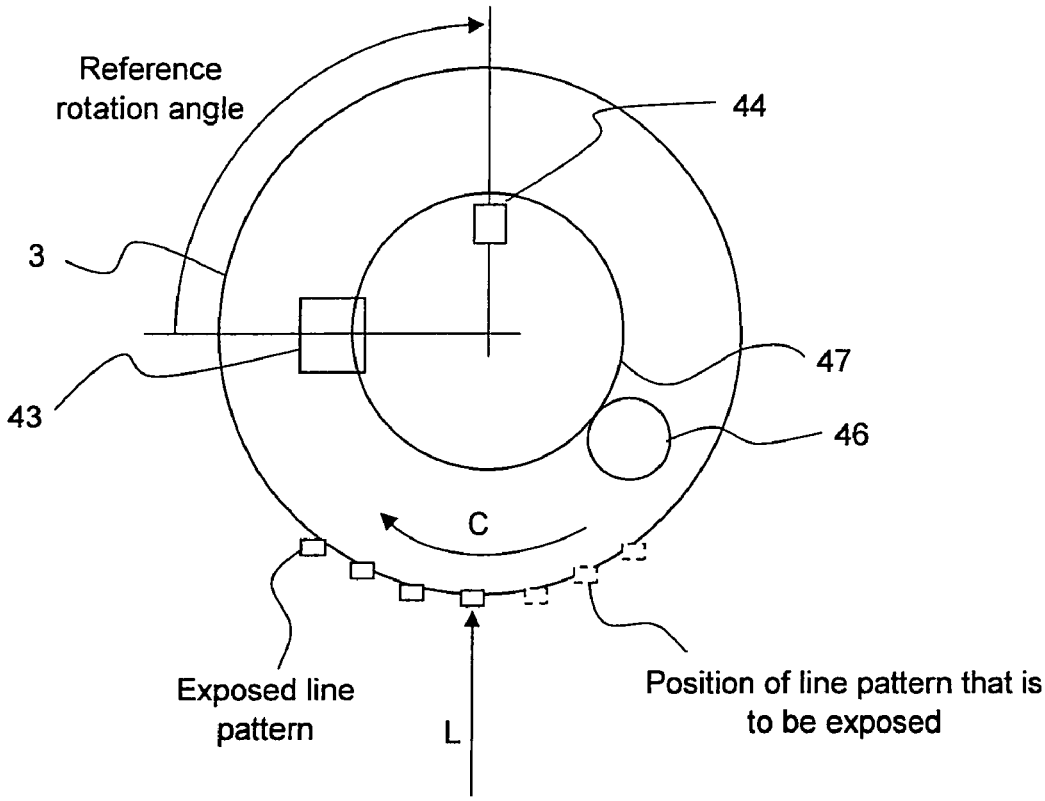
FIG. 8 is an explanatory view showing the state in which the registration toner pattern is formed on the photoconductor drum 3 shown in FIG. 3.

Prior to the explanation of the adjustment of the rotational phase, first, a reference rotation angle will be explained. FIG. 8 is an explanatory view showing the state in which the registration toner pattern is formed on the photoconductor drum 3. The electrostatic latent image is formed at the position of the photoconductor drum 3 where the laser beam L scans to expose the photoconductor. It is supposed here that, in FIG. 8, the position of the photoconductor drum 3 that is exposed at that moment is the reference phase obtained by the later-performed measurement. In this case, the angle made by the projection 44 and the phase sensor 43 is referred to as a "reference rotation angle". The rotation angle of the photoconductor drum 3 is an angle after the projection 44 passes the phase sensor 43. The reference rotation angle corresponds to the rotation angle from the time when the phase sensor 43 outputs the reference signal immediately before to the time when the toner pattern, which is the reference phase, is exposed.

FIGS. 9A and 9B are explanatory views for explaining the relationship between the reference rotation angle and the reference phase in association with FIG. 8. In FIG. 9, a lateral direction shows an elapse of time. A laser light emission signal is a signal for driving a laser irradiation section so as to emit the laser beam L for writing the registration toner pattern in the photoconductor. The aforementioned reference clock is generated from a generation time of each laser light emission signal and after the (moving time from exposure position to the transfer position, then to the color registration sensor). As shown in FIG. 9A, at time t1, the projection 44 passes through the phase sensor 43 and the reference signal is outputted. Thereafter, at time t2, a position being the reference phase is exposed, and the electrostatic image of the registration toner pattern is formed at this position. The time from the time t1 to the time t2 is defined as Δt. A pattern of a part corresponding to the reference phase is developed together with the rotation of the photoconductor drum 3 and thereafter reaches the transfer position. The toner image is transferred to the intermediate transfer belt 7 at the transfer position. The transferred toner image is read by the color registration sensor 41 at time t3. As described above, the control section obtains the reference phase from the misintegration amount of the read toner pattern. As a result, the pattern read by the color registration sensor at time t3 is positioned at the position corresponding to the reference phase. The Δt is obtained as follows.

$\Delta t$=(time from $t1$ to $t3$)−(moving time from exposure position to the transfer position, then to the color registration sensor)

As described above, there is a phase difference between the phase of the pitch fluctuation component and the phase of the peripheral speed fluctuation component, which corresponds to a photoconductor rotation angle of 90°. Accordingly, as shown in FIG. 9B, when a synchronous signal is prepared, correction of Δt is added to the reference signal, and a correction time dt (90°)(sec) corresponding to a rotating time of a rotation angle 90° of a photoconductor is subtracted. Alternately, a correction time dt (270°)(sec) corresponding to the rotating time of a rotation angle 270° of a photoconductor is added (see FIG. 9B). Here, dt(x) is calculated as follows.

$$dt(x)=R\times\pi\div V_0\times x\div 360(°)$$

R: Photoconductor diameter

V0: Photoconductor peripheral speed

As described above, the control section determines the reference rotation angle of each photoconductor drum on the basis of the reference phase of the measured toner pattern.

Further, the control section adjusts the rotational phase of the photoconductor drum of Y, M and C, so that mutual reference phases are matched, from the misintegration amount of the reference phase of the measured toner pattern.

Then, for example, what is necessary is to start the exposure so that the leading end portion of the print image is exposed at the reference rotation angle of each photoconductor drum at the time of the image formation of the print image based on the image data generated by reading a manuscript or generated by an external computer. Alternately, the leading end portion of the image may be exposed to be delayed by a predetermined angle from the reference phase. This amount of delay is made to be the same amount among Y, M and C. By doing so, since the phases of the respective images of Y, M and C match, the color misregistration is unnoticeable.

The control section executes the adjustment of the rotational phase of each photoconductor drum, for example, when formation of the toner pattern is finished and each photoconductor drum is stopped. At the time of stoppage, the rotation of each photoconductor drive motor 45 is controlled so that the rotation angle, with each photoconductor drum 3 stopped, has a predetermined relationship. Namely, the rotation angle of the photoconductor at the time of stoppage is controlled so that the synchronous signal of Y, M and C has a predetermined phase relationship as shown in FIG. 11.

Figure 11:
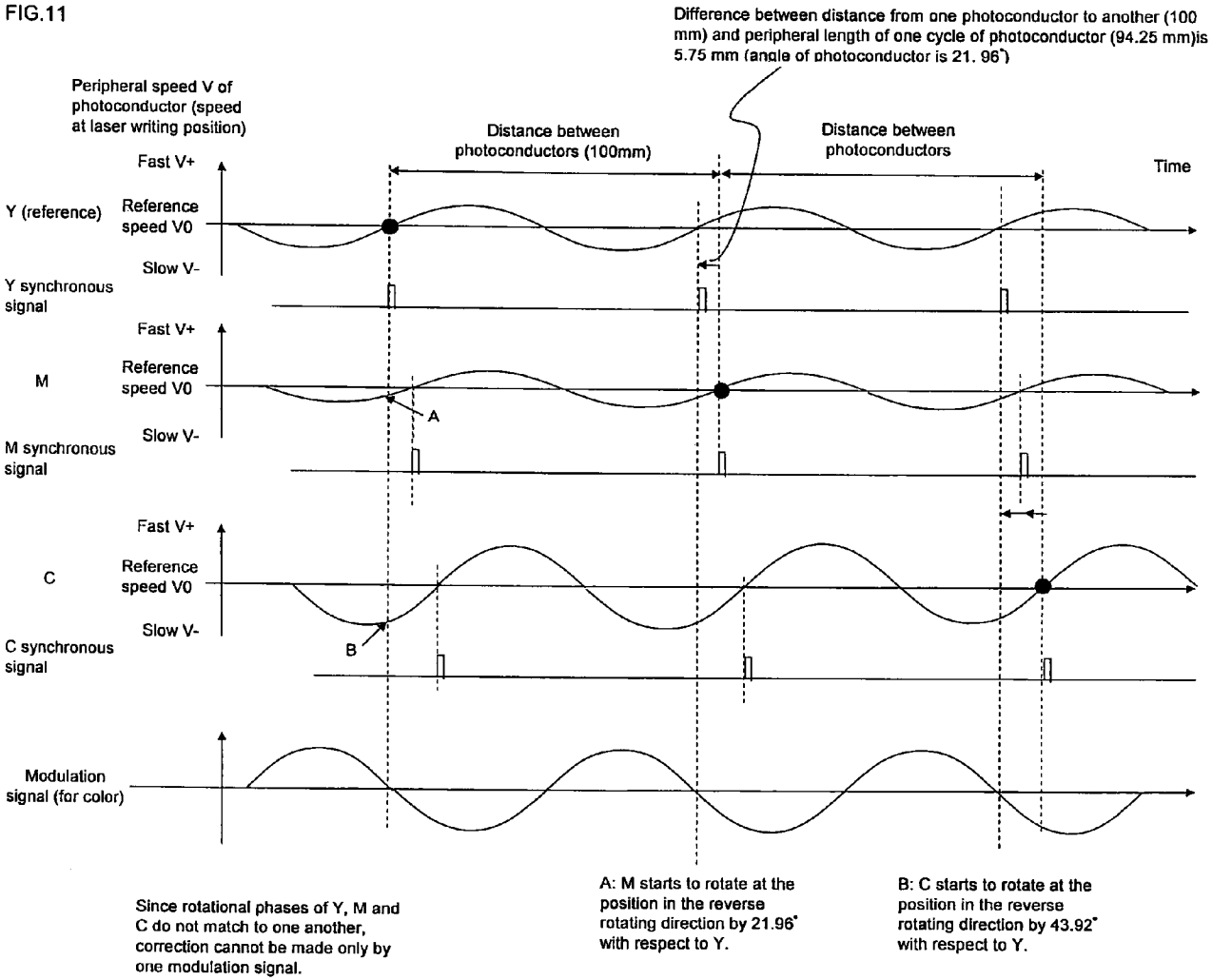
FIG. 11 is an explanatory view showing a peripheral speed fluctuation component of the photoconductor in the state in which the rotational phase of the photoconductor is adjusted, in this embodiment.

FIG. 11 is an explanatory view showing the peripheral speed fluctuation component, with the rotational phase of each photoconductor adjusted, so as to match the phases of the pitch fluctuation components on the image, in this embodiment. A black circle in FIG. 11 indicates the position of each of Y, M and C images that should be transferred to the same position on the recording medium. In this case, the reference phases of each of Y, M and C photoconductor drums 3 are deviated. The distance between the transfer position of the Y photoconductor drum 3*d* and the transfer position of the M photoconductor drum 3*c* is 100 mm. On the other hand, the peripheral length of the photoconductor 3 is 92.25 mm. Therefore, the deviation that is 5.75 mm in terms of distance and 21.96° in terms of rotation angle of the photoconductor is present between both of them. The same is true for the relationship between the M photoconductor drum 3*c* and the C photoconductor drum 3*b*, wherein the deviation that is 5.75 mm in terms of distance and 21.96° in terms of rotation angle of the photoconductor is present between both of them.

Accordingly, in the state after adjustment, the rotational phase of the M photoconductor drum 3*c* is delayed by 21.96° from the rotational phase of the Y photoconductor drum 3*d*. Similarly, the rotational phase of the C photoconductor drum 3*b* is delayed by 21.96° from the rotational phase of the M photoconductor drum 3*c*. Specifically, the rotational phase of the C photoconductor drum 3*b* is delayed by 43.92° from the rotational phase of the Y photoconductor drum 3*d*.

If the distance between each transfer position is agreed with the peripheral length of the photoconductor, the rotational phases of each photoconductor are matched to each other. However, this imposes a limitation on a layout space around each photoconductor or the size of the image forming apparatus.

In view of this, the phase of the color modulation signal is controlled with any one of Y, M and C defined as a reference. In the embodiment shown in FIG. 11, Y is defined as the reference. In this case, the phase of the modulation signal (for color) is controlled on the basis of the Y synchronous signal outputted after Δt from the reference signal outputted from the Y phase sensor 43*d*. In the case of FIG. 11, the phase of the modulation signal (for color) is controlled such that the reference phase of the modulation signal (for color) is synchronized with the Y synchronous signal. Specifically, the phase of the modulation signal is controlled such that the modulation signal (for color) increasing in the negative direction from zero is outputted at the timing when the Y synchronous signal is outputted.

Figure 12:
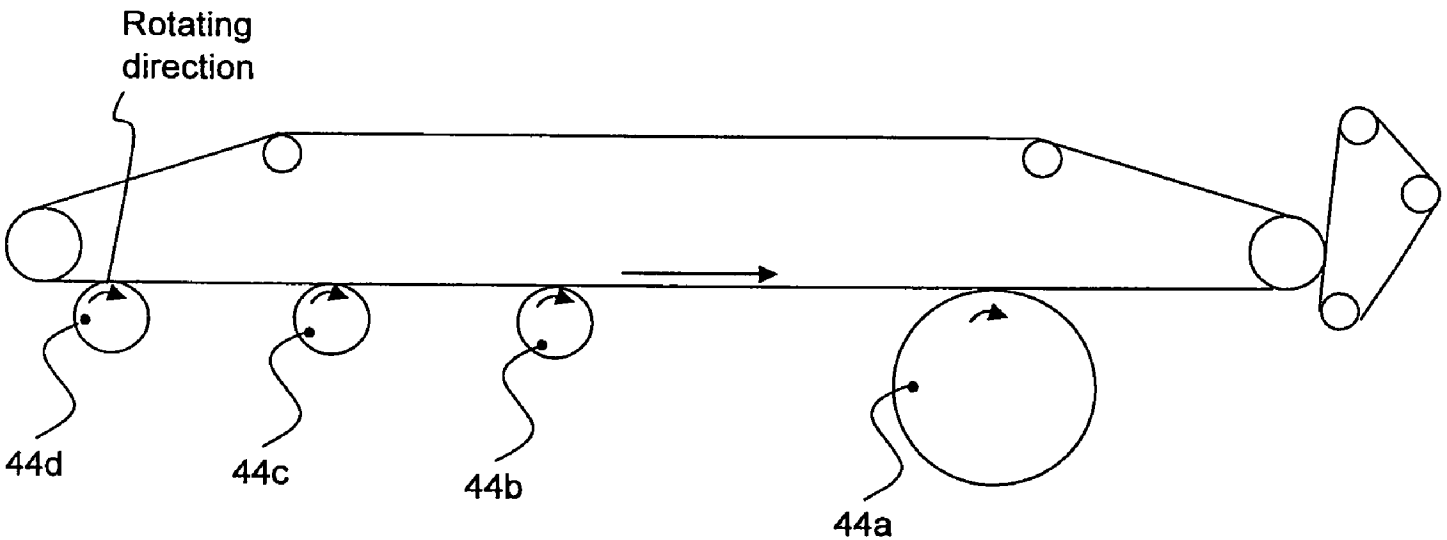
FIG. 12 is an explanatory view showing an example of the position of each projection 44 in the state in which the rotational phase of each photoconductor is adjusted, in this embodiment.

FIG. 12 is an explanatory view for showing an example of the position of each projection 44 in the present embodiment in the state in which the rotational phase of each photoconductor is adjusted. Since there is no correlation between the direction of each projection and the direction of the eccentricity of the photoconductor, the direction of the projection 44 of each photoconductor is random. FIG. 12 is for showing the correspondence to the later-described FIG. 15.

When the modulation signal from the modulation signal generating circuit 51*b* is inputted to each drive control circuit 51*b*, 51*c*, and 51*d* with the state in which the rotational phase of each of Y, M and C photoconductor drums 3 is adjusted, a deviation is produced between the peripheral speed fluctuation component of the photoconductor and the phase of the modulation signal.

For example, it is supposed that the amplitude of the peripheral speed fluctuation component of the C photoconductor drum 3*b* is the greatest, and the modulation signal generating circuit 51*b* generates the modulation signal having the phase reverse to that. In this case, the modulation signal is also inputted to the Y and M drive control circuits 51*d* and 51*c* from the modulation signal generating circuit 51*b*. As for the C photoconductor drum 3*b*, the phase is corrected, so that the peripheral speed fluctuation component is well suppressed, but the phase of the modulation signal to the peripheral speed fluctuation component is deviated for the Y and M photoconductor drums 3*d* and 3*c*.

Therefore, the control section corrects the rotational phase of each photoconductor from the state in which the rotational phase of each of Y M and C photoconductor drums 3 is adjusted, in order that the phases of the pitch fluctuation component on the image match to each other. This makes it possible to adjust the rotational phase of each of Y, M and C photoconductors and to match the phases of the peripheral speed fluctuation component to the common modulation signal. Specifically, the rotational phase of the M photoconductor drum 3*c* is advanced in its rotating direction by 21.96°. Further, the rotational phase of the C photoconductor drum 3*b* is advanced in its rotating direction by 43.92°. Specifically, the rotational phase of the stopped photoconductors is controlled to match the M and C synchronous signals with the Y synchronous signal with the Y synchronous signal as a reference.

This adjustment amount is a value previously obtained from the difference between the transfer positions and the peripheral length of the respective photoconductors.

The adjustment of this rotational phase is obtained by measuring the registration toner pattern. In other words, the rotational phase of each photoconductor is not previously known. However, an adjustment amount (predetermined misintegration amount) for matching the phases of periodic speed fluctuations of the respective photoconductor drums is previously known from a state that the phases of the pitch fluctuation components on the image are matched. The control section further adjusts the rotational phase of each photoconductor drum 3 after the phases of the pitch fluctuation components on the image are matched by the measurement of the toner pattern. Thus, the adjustment amount of the rotational phase of each photoconductor drum 3 is derived by two stages.

It is to be noted that the process for physically deviating the rotational phase of each photoconductor drum may be executed at one time at the stage where the final adjustment amount is derived. Alternately, by measuring the toner pattern and calculating a relative misintegration amount of the rotational phase of each photoconductor, the rotational phase of each photoconductor may be adjusted so that the obtained misintegration amount is moved to the aforementioned predetermined misintegration amount.

Figure 13:
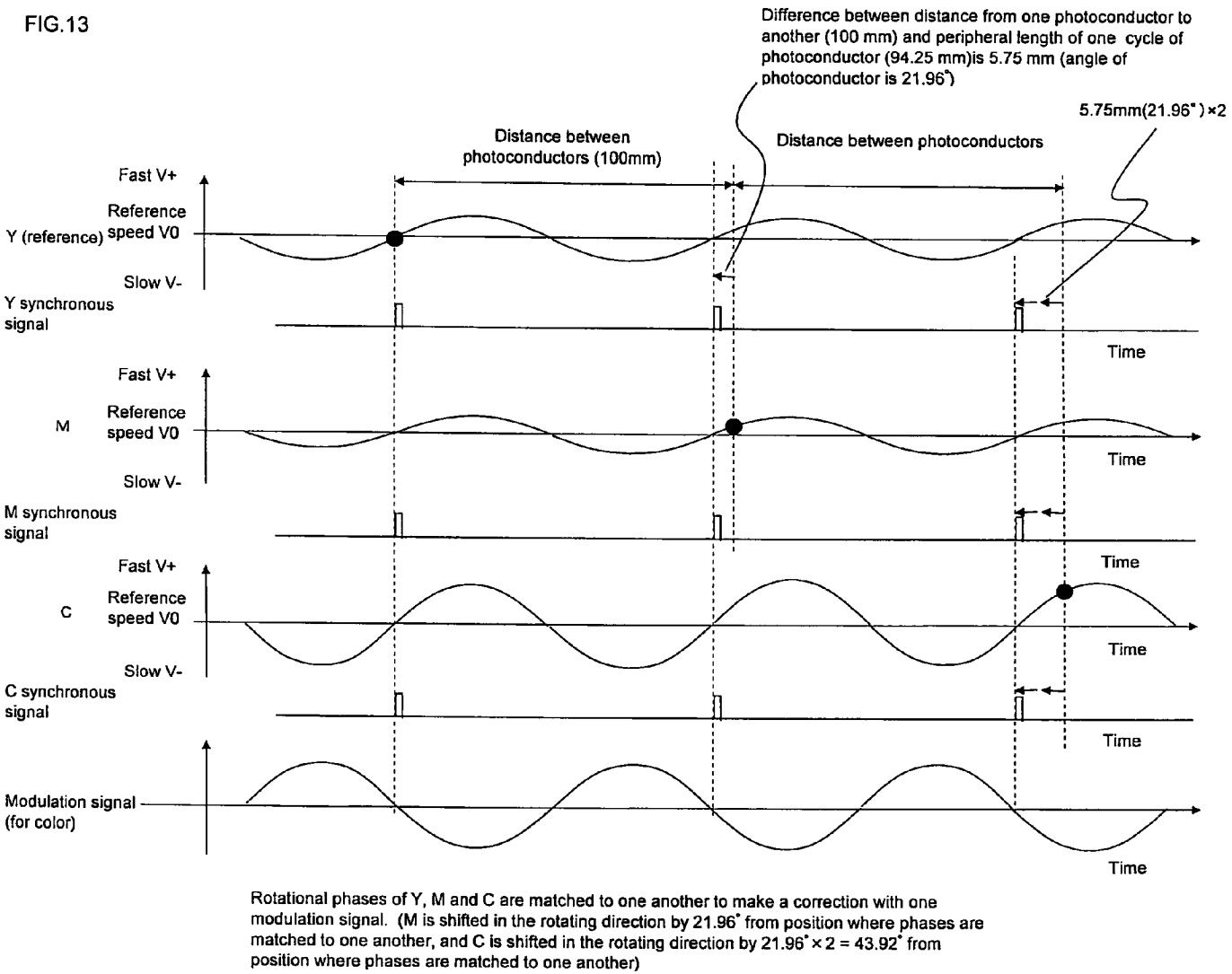
FIG. 13 is an explanatory view showing the peripheral speed fluctuation component of the photoconductor in the state in which the rotational phase of each photoconductor drum matches to each other, in this embodiment.

FIG. 13 is an explanatory view showing the state of the peripheral speed fluctuation component in the state in which the rotational phase of each photoconductor drum 3 matches to each other. With this state, the modulation signal generating circuit 51*b* generates the modulation signal having a reverse phase to each of Y, M and C photoconductor drums 3*d*, 3*c* and 3*b*. Each of Y, M and C drive control circuits 53*d*, 53*c* and 53*b* corrects the drive speed with the modulation signal. Thus, the peripheral speed fluctuation component of each photoconductor is corrected.

A black circle in FIG. 13 indicates the position of each of Y, M and C images that should be transferred onto the same position on the recording medium. Supposing that the position of the black circle is defined as the leading end portion of the printed image, the position of the leading end portion of the Y, M and C printed images matches to the synchronous signal in FIG. 11. On the other hand, with the state after the rotational phase is adjusted, the position of the leading end portion of the Y printed image matches to the Y synchronous signal, but the position of the leading end portion of the M printed image is delayed from the M synchronous signal by 21.96° and the leading end portion of the C printed image is delayed from the C synchronous signal by 43.92° as shown in FIG. 13. The control section controls the exposure timing at the leading end portion of each printed image for the synchronous signal one before the present synchronous signal as shown in FIG. 13.

Here, the amplitude of each modulation signal is adjustable. As the amplitude of the color modulation signal, the amplitude of the pitch fluctuation component of each color photoconductor drum is detected, and a maximum amplitude and a minimum amplitude are selected out of the amplitudes calculated from the pitch fluctuation component of each photoconductor drum of Y, M and C. Then, based on an intermediate value of the maximum amplitude and the minimum amplitude, the amplitude of the modulation signal (for color) is determined.

Figure 14:
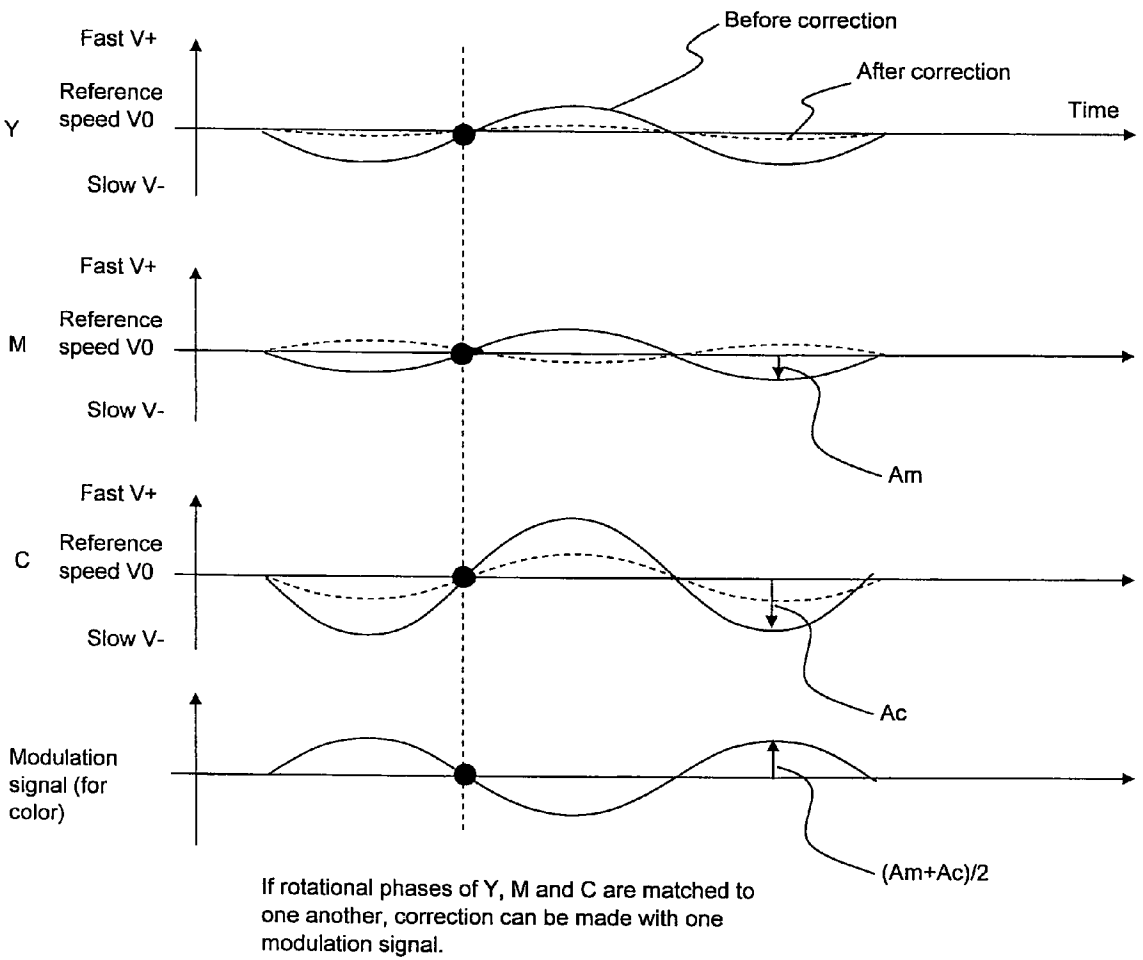
FIG. 14 is an explanatory view showing the state in which each drive control circuit 53 cancels the peripheral speed fluctuation component, in this embodiment.

FIG. 14 is an explanatory view showing the state in which each drive control circuit 53 cancels the peripheral speed fluctuation component by using the modulation signal. It is supposed that the speed variation amplitude of the C photoconductor having the greatest variation amount of the rotation speed is defined as Ac, and the speed variation amplitude of the M photoconductor having the smallest variation amount of the rotation speed is defined as Am. In this case, the control section employs the intermediate value of Ac and Am, i.e., (Ac+Am)/2, as the amplitude of the modulation signal. The reason is as follows. If the amplitude of the modulation signal (for color) is determined to completely cancel the pitch fluctuation component of the photoconductor drum having the greatest amplitude, the correction amount becomes too great to the photoconductor drum having the smallest amplitude. When an average of the amplitude of the maximum amplitude and the minimum amplitude is taken out of the pitch fluctuation components of the respective photoconductors of Y, M and C, an appropriate correction amount can be obtained for each color of Y, M and C.

Figure 22:
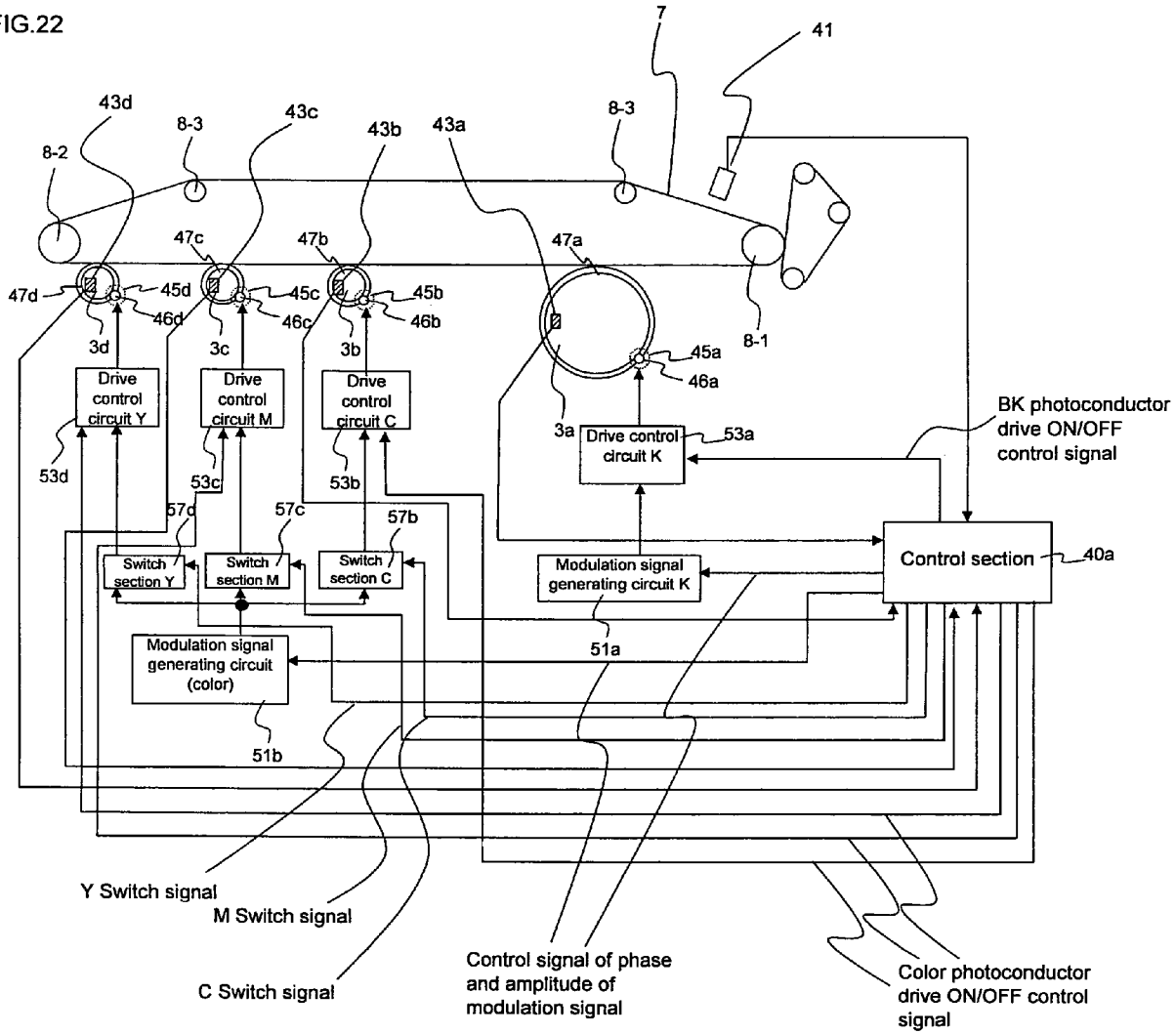
FIG. 22 is an explanatory view showing a further different block configuration for correcting the pitch fluctuation component, in this embodiment.

However, when the pitch fluctuation component of any one of the colors is minute to the extent not requiring correction, the modulation signal may be applied by excluding this color. In this case, as shown in FIG. 22 as will be described later, it may be so constituted that the image forming apparatus has a switch section 57, and the control section 40*a* switches the condition of the switch section 57 so as to prevent the modulation signal which is out of a correction object from being inputted in the drive control circuit. For example, when the pitch fluctuation component of Y is minute to the extent not requiring correction, a switch of a switch section Y57*d* is set OFF. A switch section C57*b* and a switch section M57*c* are set ON. The amplitude of the modulation signal applied to each color of M and C may be set to an average value of the maximum amplitude and the minimum amplitude of each color to which the modulation signal is applied, and in this example, may be set to the average amplitude of the pitch fluctuation components of M and C. The switch section 57 corresponds to the switch section specified in the claims. In the configuration of FIG. 22, a correction signal output section specified in the claims is composed of the modulation signal generating circuit 51 and the switch section 57.

Figure 28:
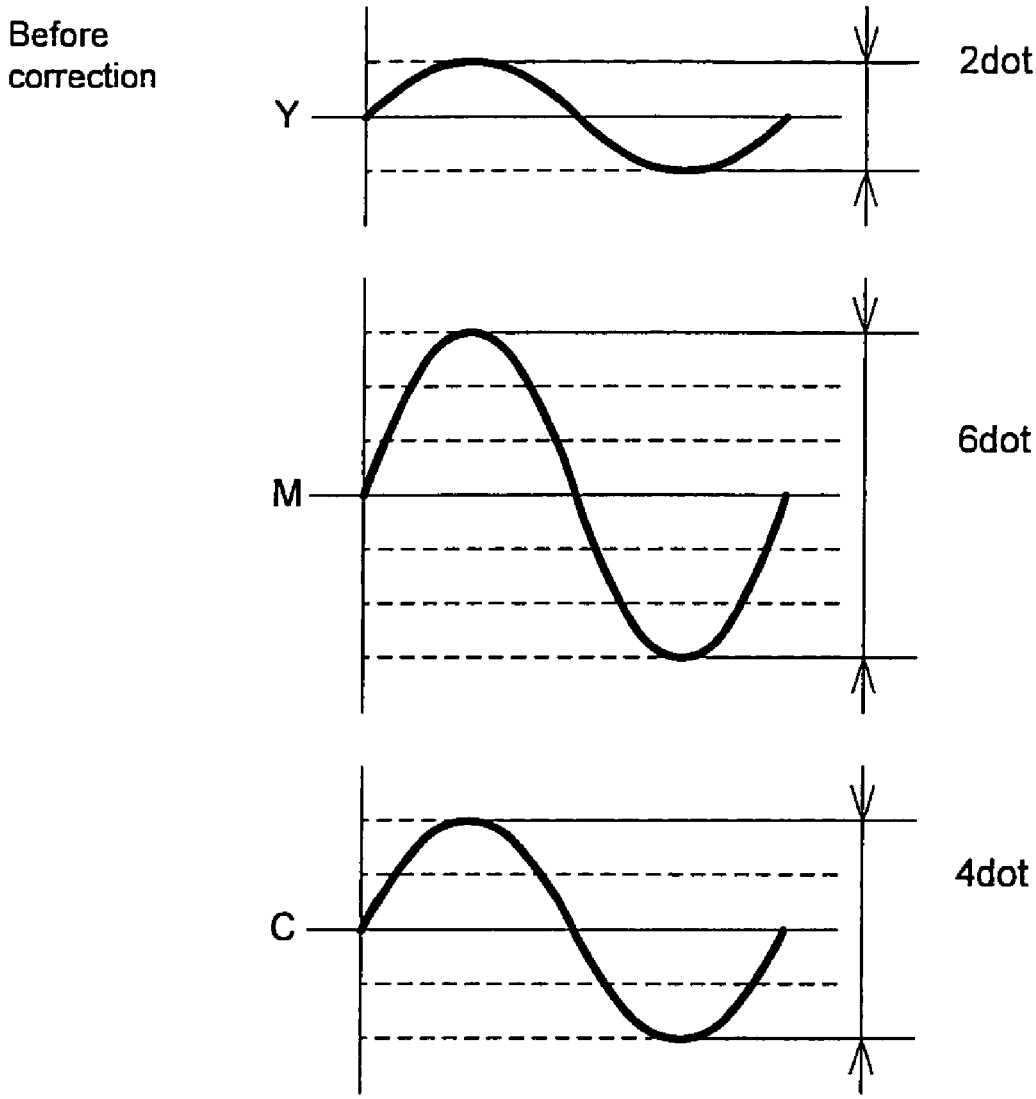
FIG. 28 is a first explanatory view showing an effect of a method of excluding a minute pitch fluctuation component from a correction object, in this embodiment.

FIGS. 28 to 31 are explanatory views showing an advantage of a method of excluding a minute pitch fluctuation component from the correction object. FIG. 28 shows an example of the pitch fluctuation component of the photoconductor drum of each color of Y, M and C before correction, namely, when the modulation signal is not applied. The amplitude of the pitch fluctuation component is taken on the ordinate axis by the unit of a pixel (dot). Note that one pixel (1 dot) is 42 μm. The time is taken on the abscissa axis. The cycle of the pitch fluctuation component corresponds to the rotational cycle of the photoconductor drum. In the example shown in FIG. 28, the amplitude of the pitch fluctuation of Y is two pixels. In addition, the amplitude of M is six pixels, and the amplitude of C is four pixels.

Figure 29A:
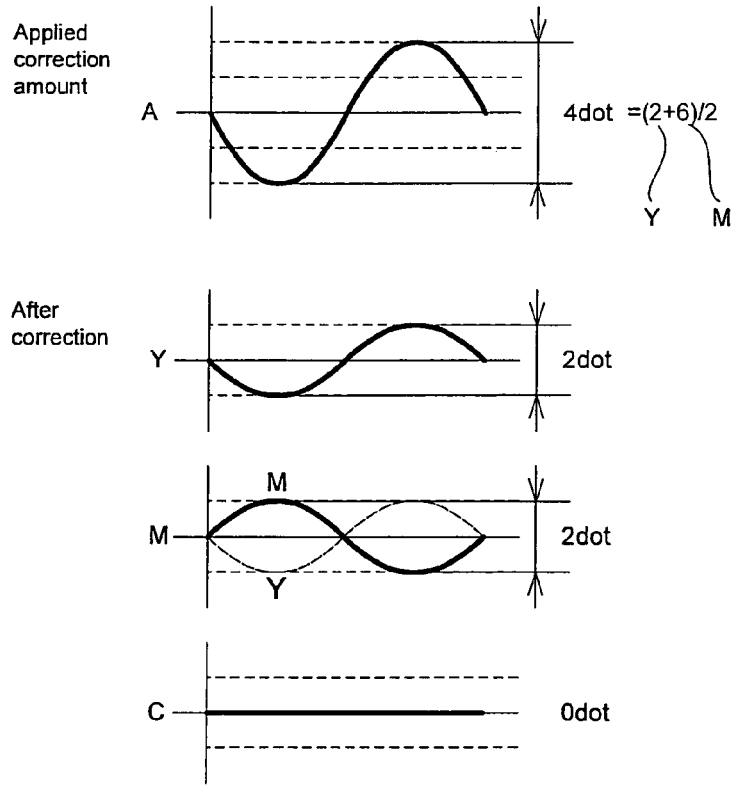
FIGS. 29A and 29B are second explanatory views showing the effect of the method of excluding the minute pitch fluctuation component from the correction object, in this embodiment.

FIG. 29A shows the pitch fluctuation component after correction by using the Y, M and C common modulation signal to the pitch fluctuation component of FIG. 28 and the modulation signal for all colors. An applied correction amount A of FIG. 29A is calculated from the average of the minimum amplitude and the maximum amplitude of the Y, M and C. The minimum amplitude is two pixels of Y, and the maximum amplitude is six pixels of M. Accordingly, the calculated average value is four pixels. A result of applying the correction amount A to each color of Y, M and C is shown in a waveform of "after correction". Y shows an excessive correction, and the amplitude is two pixels. The amplitude of M is two pixels. C is 0 pixel. The largest width of the relative color misregistration among Y, M and C is two pixels of Y and M, being mutually reverse phases.

Figure 29B:
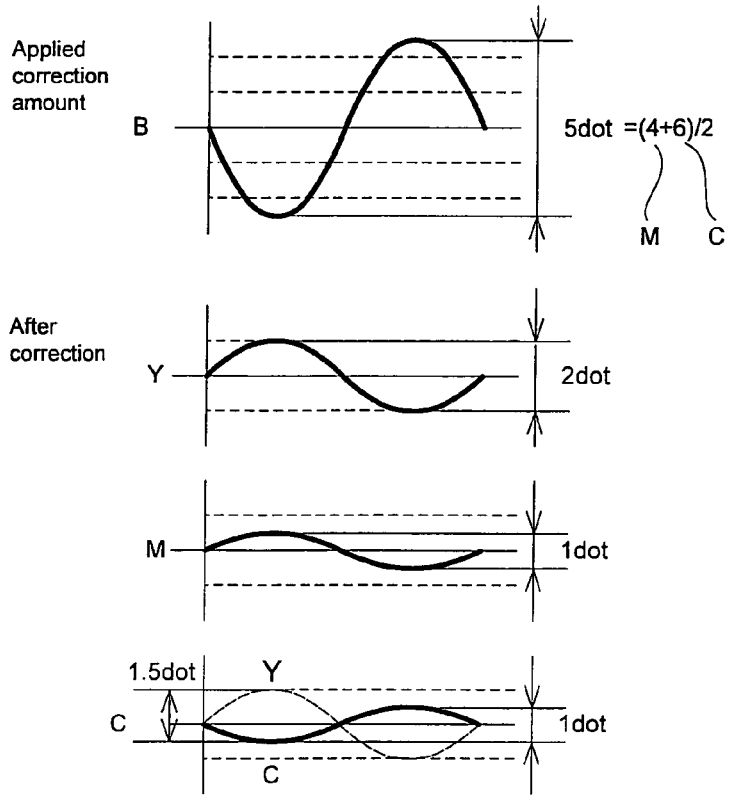

FIG. 29B shows the modulation signal when the minute pitch fluctuation component is excluded from the correction object and the pitch fluctuation component after correction. A threshold value of the pitch fluctuation component for determining an excluding object may be suitably set by a designer based on an actually outputted image. In this example, the threshold value is converted into a pixel pitch and two pixels are taken as the threshold value. Accordingly, Y, with the pitch component equal to two pixels, is excluded from the correction object. An applied correction amount B is calculated as an average value of M and C, and its result is five pixels. The calculated modulation signal is applied to M and C, and is not applied to Y. The obtained result is shown as the waveform of the "after correction". The amplitude of Y is the same two pixels as that before correction. The amplitude of M is one pixel. C becomes excessive correction, and the amplitude thereof is one pixel. The maximum width of the relative color misregistration among Y, M and C is 1.5 pixels of Y and C, being mutually reverse phases. When compared with FIG. 29A, the pitch fluctuation component is fewer by 0.5 pixels. By excluding the minute pitch fluctuation component from the correction object, a more preferable result can be obtained.

Figure 30:
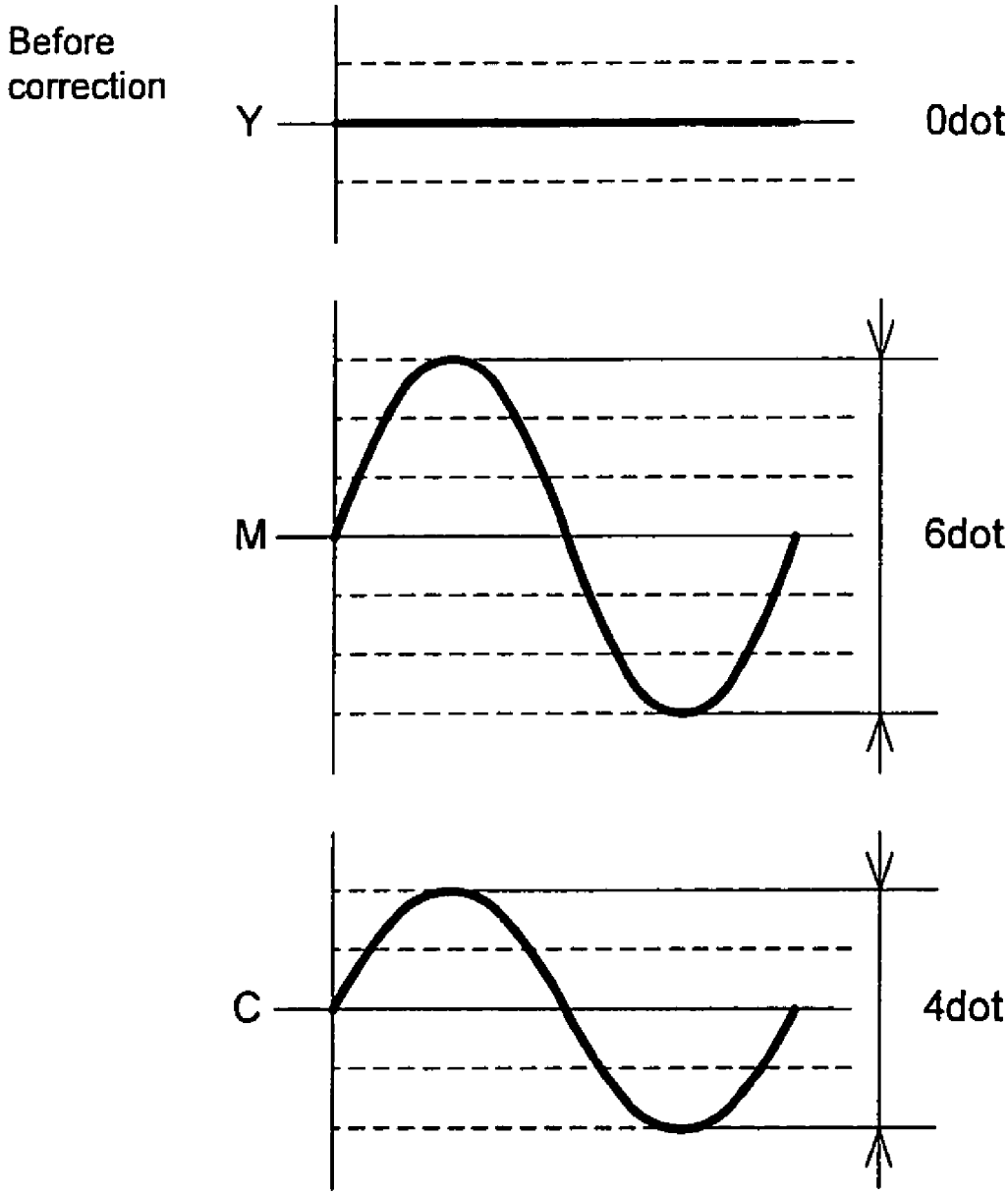
FIG. 30 is a third explanatory view showing the effect of the method of excluding the minute pitch fluctuation component from the correction object, in this embodiment.
Figure 31A:
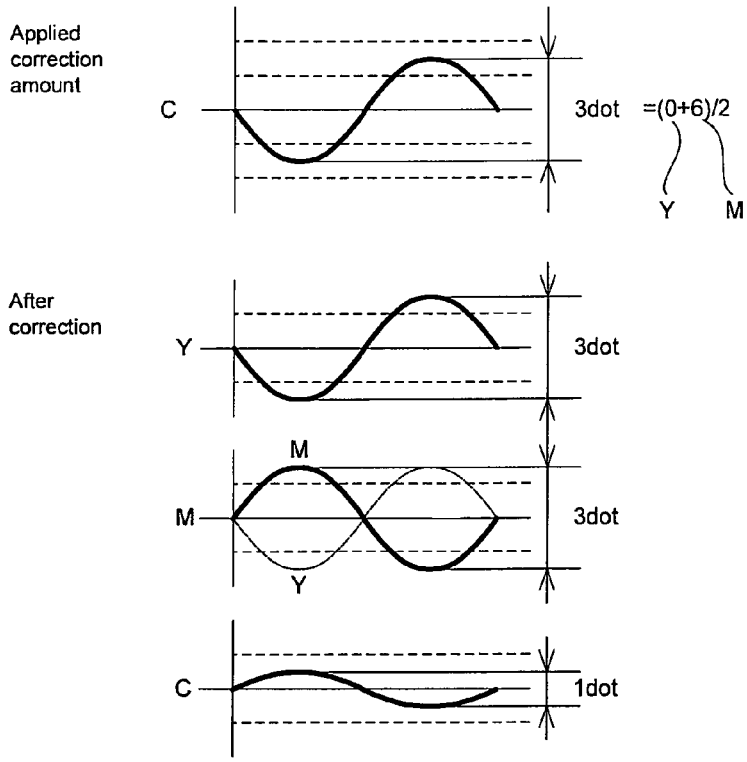
FIGS. 31A and 31B are fourth explanatory views showing the effect of the method of excluding the minute pitch fluctuation component from the correction object, in this embodiment.

FIG. 30 shows an example different from FIG. 28 of the pitch fluctuation component of the photoconductor drum for each color of Y, M and C. In the example shown in FIG. 30, the amplitude of Y is 0 pixel (under 0.5 pixels), the amplitude of M is six pixels, and the amplitude of C is four pixels. FIG. 31A shows the Y, M and C common modulation signal to the pitch fluctuation component of FIG. 30 and the pitch modulation component after correction by using the modulation signal for all colors. An applied correction amount C of FIG. 31A is calculated from the average of the minimum amplitude and the maximum amplitude of the Y, M and C. The minimum amplitude is 0 pixel of Y, and the maximum amplitude is six pixels of M. Accordingly, the calculated average value is three pixels. The result of applying the correction amount A to each color of Y, M and C is shown in the waveform of "after correction". Y is excessive correction, and the amplitude thereof is three pixels. The amplitude of M is three pixels. The amplitude of C is one pixel. The largest width of the relative color misregistration among Y, M and C is two pixels of Y and M, being mutually reverse phases.

Figure 31B:
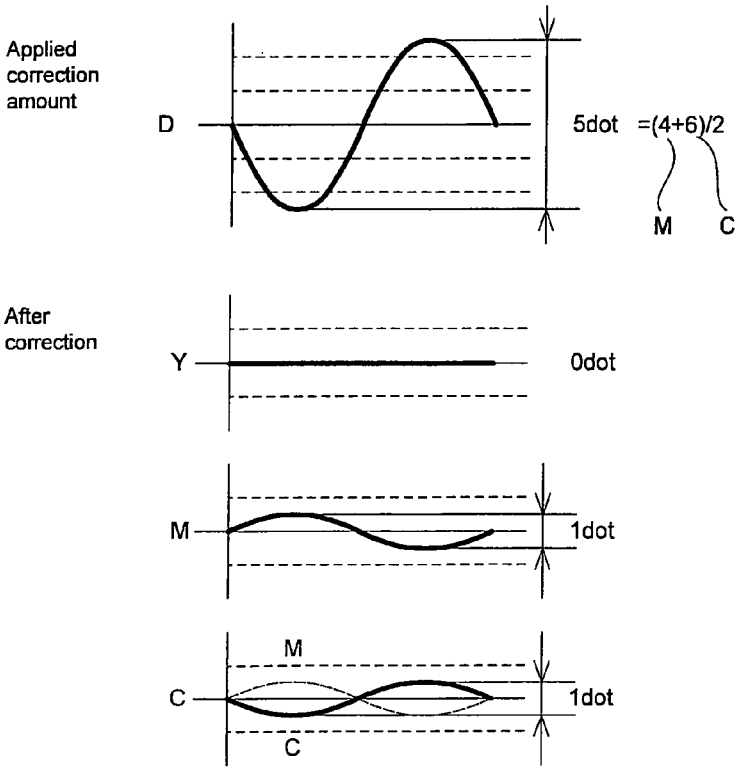

FIG. 31B shows the modulation signal when the pitch fluctuation component excludes the color of two pixels or less from the correction object and the pitch fluctuation component after correction. In this example, Y is excluded from the correction object. An applied correction amount D is calculated as the average value of M and C, and the result thereof is five pixels. The calculated modulation signal is applied to M and C, and is not applied to Y, and the obtained result is shown as the waveform of "after correction". The amplitude of Y is the same 0 pixel as that before correction. The amplitude of M is one pixel. C becomes excessive correction, and the amplitude thereof is one pixel. The largest width of the relative color misregistration among Y, M and C is one pixel of M and C, being mutually reverse phases. When compared with FIG. 29A, the pitch fluctuation component is fewer by two pixels. By excluding the minute pitch fluctuation component from the correction object, a preferable result can be obtained.

Figure 15:
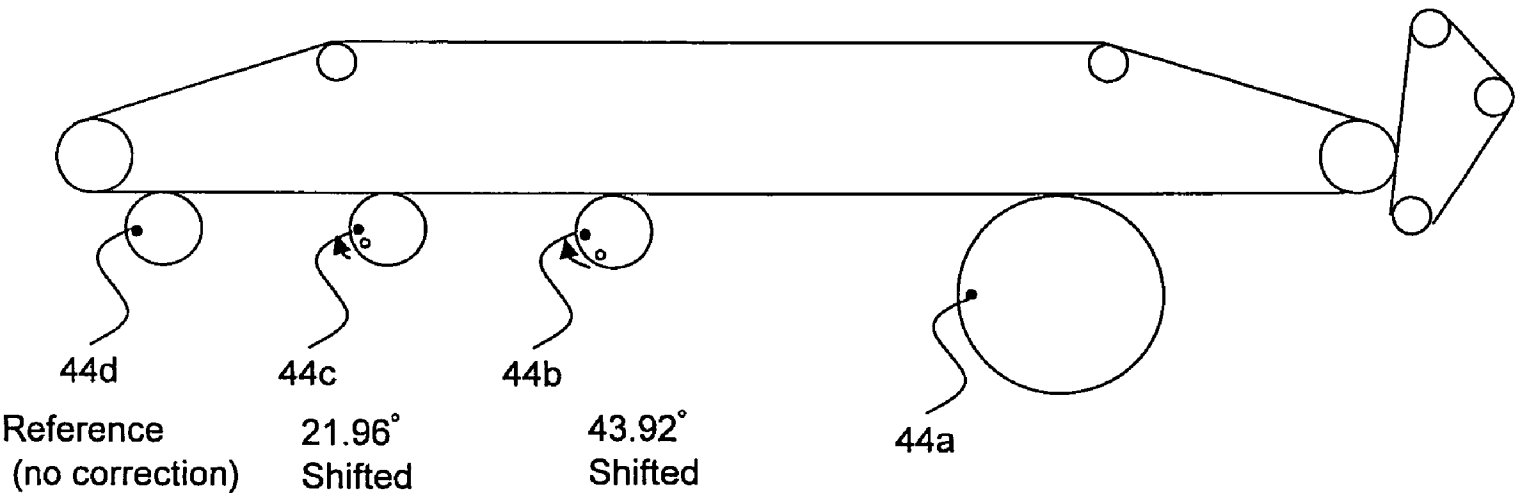
FIG. 15 is an explanatory view showing an example of the position of each projection in the state in which the rotational phase of each photoconductor is matched to each other, in this embodiment.

FIG. 15 corresponds to FIG. 12 and is an explanatory view showing an example of the position of each projection 44 in a state to match the rotational phases of each photoconductor.

Figure 26:
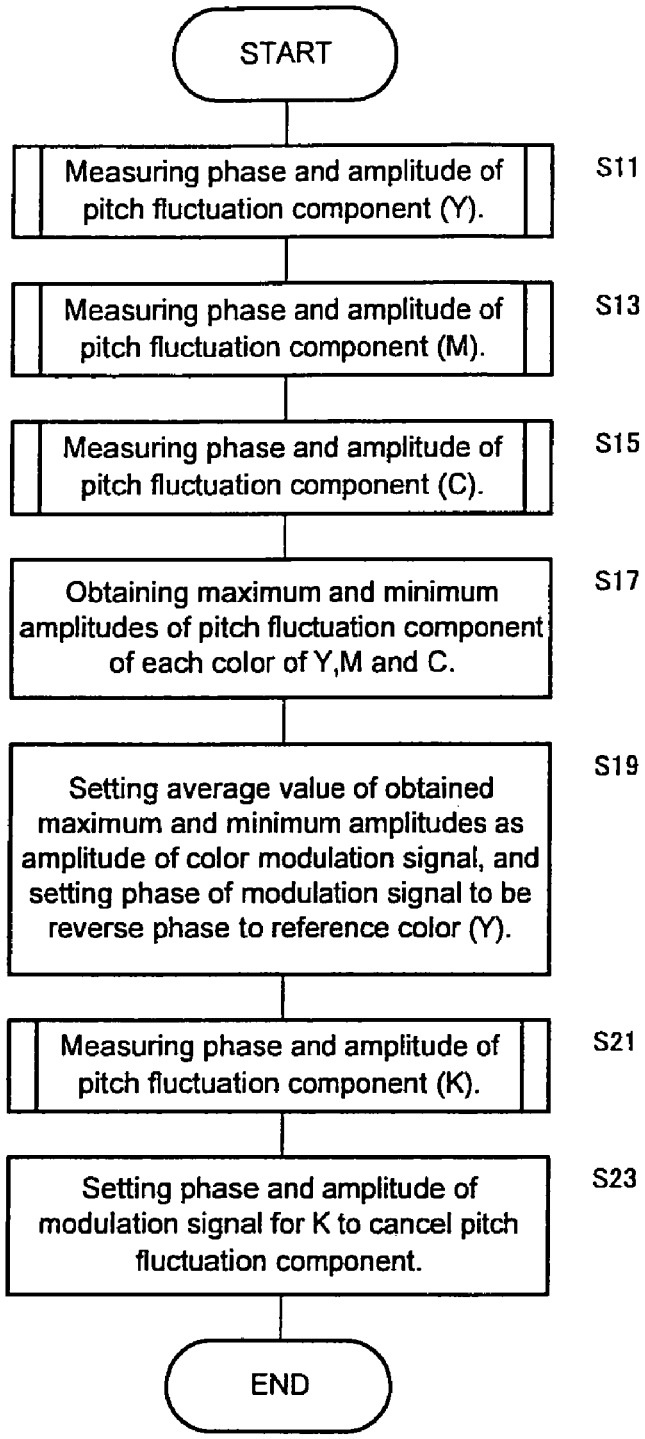
FIG. 26 is a flowchart showing a procedure that the control section 40*a* measures the pitch fluctuation component of the photoconductor drum of each color, and sets an amplitude and a phase of the modulation signal based on a measurement result, in this embodiment.
Figure 27:
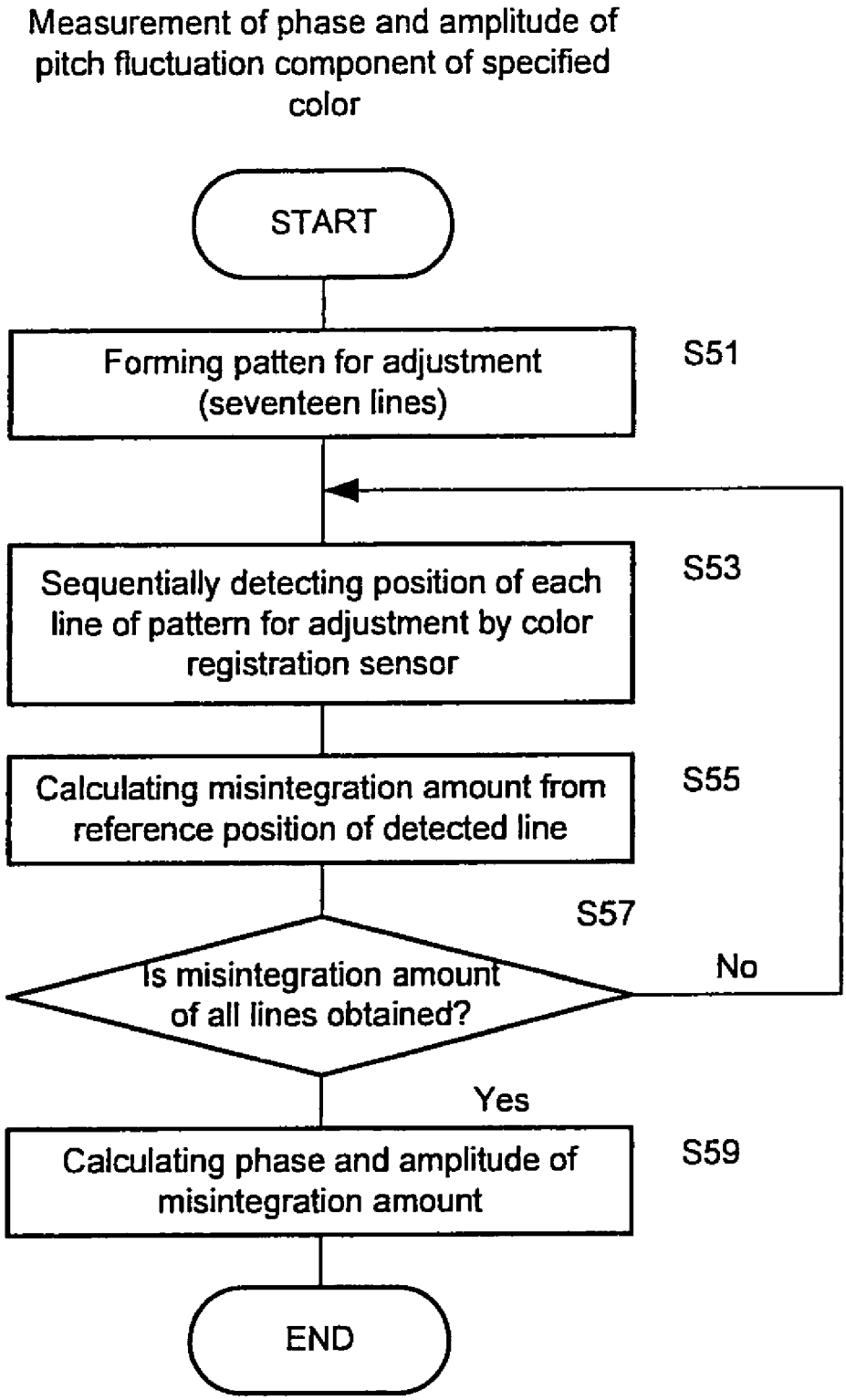
FIG. 27 is a flowchart showing a detail of the procedure that the control section 40*a* measures the pitch fluctuation component of the photoconductor drum of each color, in this embodiment.

FIG. 26 and FIG. 27 are flowcharts in which the control section 40*a* measures the pitch fluctuation component of the photoconductor drum of each color and shows a procedure of setting the amplitude and the phase of the modulation signal based on a measurement result. The procedure will be explained along the flowchart.

First, as shown in FIG. 26, the control section 40*a* measures the phase and the amplitude of the pitch fluctuation component of the Y photoconductor 3*d* (step S11). A detailed procedure of the measurement is shown in the flowchart of FIG. 27. Here, the explanation for FIG. 26 is continued. Next, the control section 40*a* measures the phase and the amplitude of the pitch fluctuation component of the M photoconductor 3*c* (step S13). Further, the control section 40*a* measures the phase and the amplitude of the pitch fluctuation component of the C photoconductor 3*b* (step S15).

Thereafter, the control section 40*a* obtains the maximum amplitude and the minimum amplitude out of the pitch fluctuation components of each color of Y, M and C (step S17). This processing corresponds to FIG. 14. Namely, the control section 40*a* defines the intermediate value (Ac+Am)/2 of the largest speed variation amplitude Ac and the smallest speed variation amplitude Am, as the amplitude of the modulation signal. Then, the average value thereof is set as the amplitude of the modulation signal for a color signal. In addition, the phase reverse to the phase of the periodic speed fluctuation of a previously defined reference color Y, is set as the phase of the modulation signal for the color signal (step S19).

In addition, the control section 40*a* obtains the phase and the amplitude of the pitch fluctuation component of K (step S21). Then, the control section 40*a* sets the phase and the amplitude of the modulation signal for K so as to cancel the pitch fluctuation component of K obtained (step S21). Here, the processing of K as shown in steps S19 and S21 is not necessarily performed after the processing of each color of Y, M and C as shown in steps S1 to S19. The processing for K may be performed before the processing for each color of Y, Mand C.

FIG. 27 is a flowchart showing a procedure of obtaining the phase and the amplitude of the pitch fluctuation component of a specified color. This routine can be referenced in the aforementioned steps S11, S13, S15, and S39. As shown in FIG. 27, the control section 40*a* controls an operation of each part of the image forming apparatus, so that seventeen line patterns shown in FIGS. 4A to 4C are formed on the photoconductor drum of the specified color (step S51). Then, the position of the formed pattern for adjustment is sequentially detected by the color registration sensor 41 (step S53). Further, the control section 40*a* compares the position of each detected pattern with the reference position and calculates the misintegration amount (step S55). Calculation of the misintegration amount for all of the line patterns is performed (step S57). Thereafter, the control section 40*a* calculates the phase and the amplitude of the calculated misintegration amount (step S59).

Figure 32:
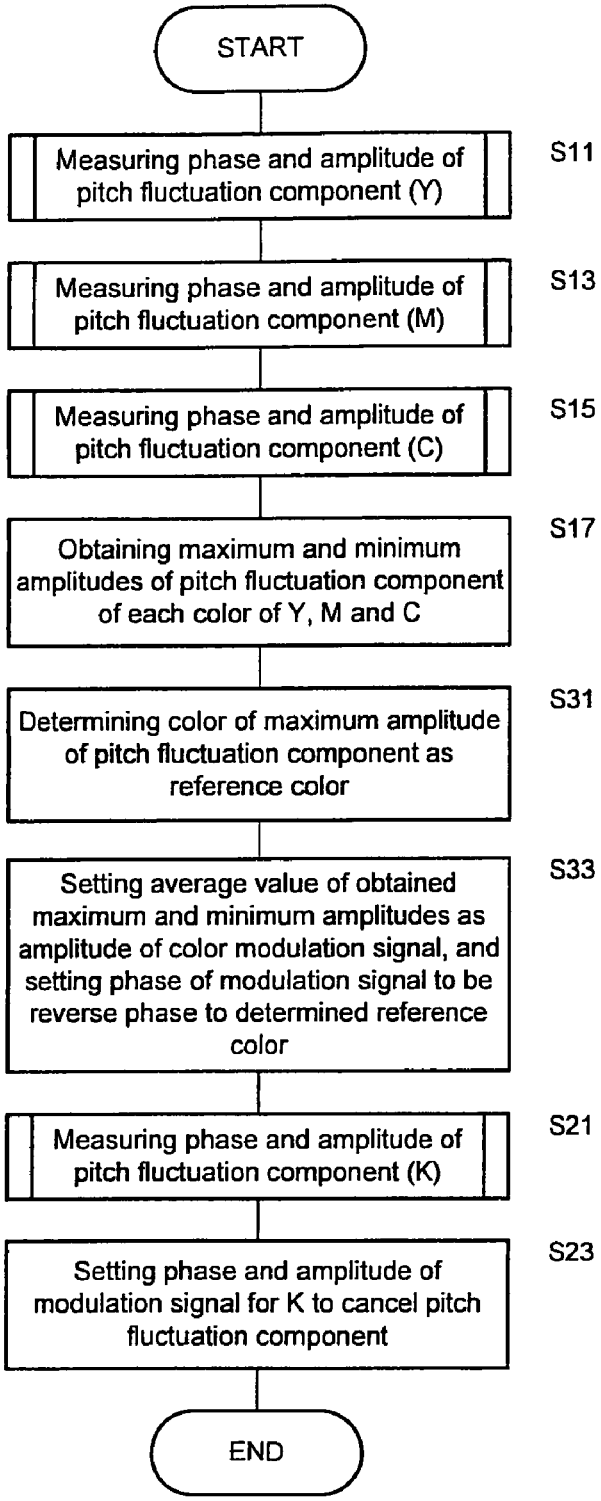
FIG. 32 is a flowchart showing a different procedure from the procedure shown in FIG. 26 wherein the control section 40*a* measures the pitch fluctuation component of the photoconductor drum of each color and sets the amplitude and the phase of the modulation signal based on the measurement result, in this embodiment.

FIG. 32 is a flowchart showing a procedure different from FIG. 26. In FIG. 26, the reference color is defined as Y in advance. However, in the flowchart of FIG. 32, any one of the colors of Y, M and C is selected as the reference color in accordance with the measurement result of the pitch fluctuation component. In FIG. 32, the same signs and numerals are assigned to the processing corresponding to FIG. 26. Namely, the processing of the steps S11 to S17, S21, and S23 corresponds to the processing of the same signs and numerals of FIG. 26. The processing of steps S31 and S33 is different from the processing of FIG. 26. Therefore, each step of the processing different from FIG. 26 will be explained. In step S31, the control section 40*a* determines the color with the maximum amplitude of the pitch fluctuation component as the reference color, and determines the phase reverse to the phase of the periodic speed fluctuation of the determined reference color as the phase of the modulation signal for the color signal (step S33).

Figure 33:
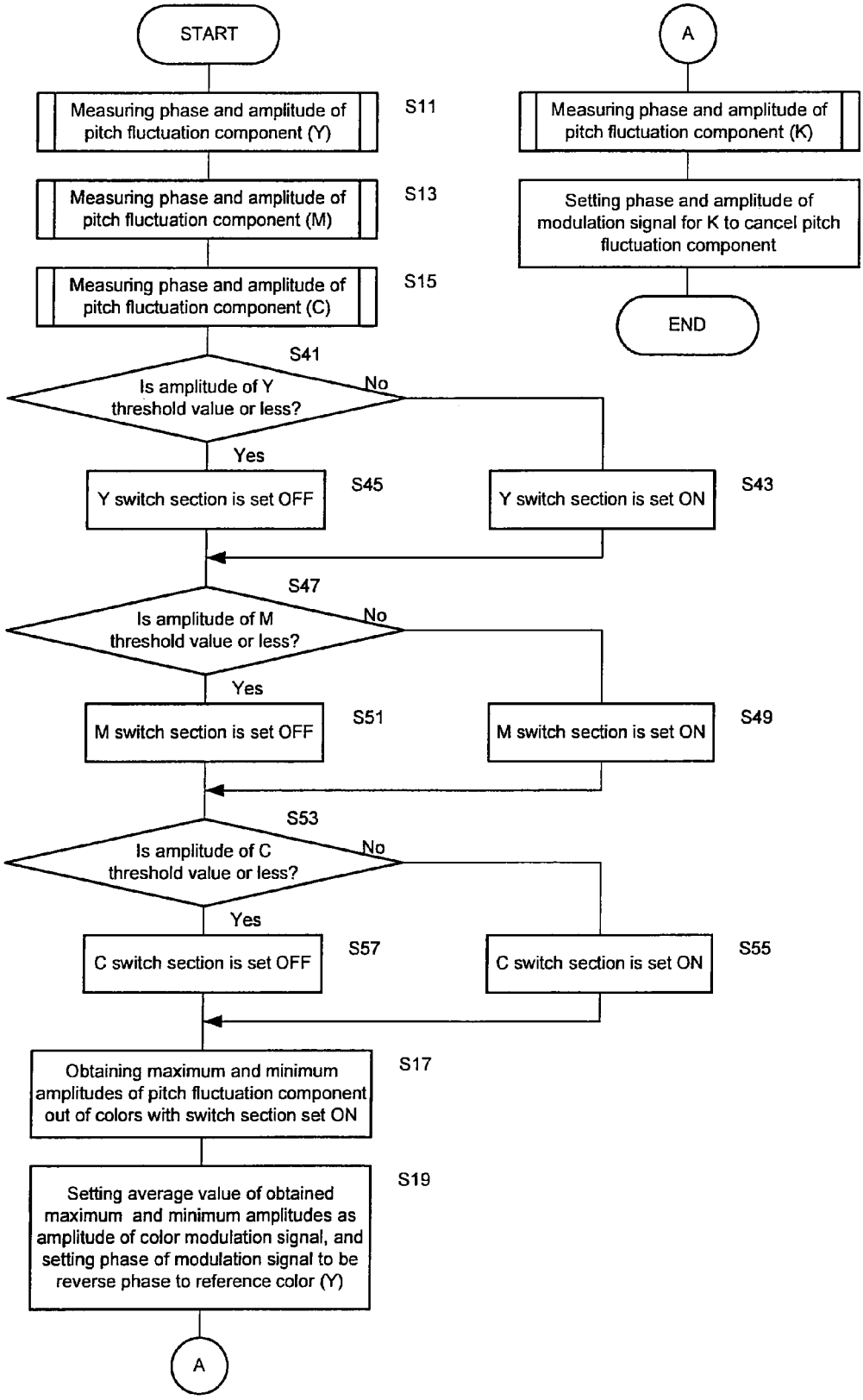
FIG. 33 is a flowchart showing a further different procedure from the procedure shown in FIG. 26 wherein the control section 40*a* measures the pitch fluctuation component of the photoconductor drum of each color and sets the amplitude and the phase of the modulation signal based on the measurement result, in this embodiment.

FIG. 33 is a flowchart showing a procedure further different from the processing of FIG. 26. In the flowchart of FIG. 33, the processing is performed to exclude the color with the pitch fluctuation component having a predetermined amplitude or less, from the correction object. In FIG. 33, the same signs and numerals are assigned to the processing corresponding to FIG. 26. The processing of steps S41 to S57 is different from the processing of FIG. 26. Each step of the processing different from FIG. 26 will be explained.

The control section 40*a* determines whether or not the amplitude of the measurement result of the pitch fluctuation component of Y is equal to the threshold value or less (step S41). As a result of the determination, when the amplitude exceeds the threshold value, the Y switch section is set ON (step S43), and when the amplitude is equal to the threshold value or less, the Y switch section is set OFF (step S45). Subsequently, the control section 40*a* determines whether or not the amplitude of the pitch fluctuation component of M is equal to the threshold value or less (step S47). When the amplitude exceeds the threshold value, the M switch section is set ON (step S49), and when the amplitude is equal to the threshold value or less, the M switch section is set OFF (step S51). Further, the control section 40*a* determines whether or not the amplitude of the pitch fluctuation component of C is equal to the threshold value or less (step S53). When the amplitude exceeds the threshold value, the C switch section is set ON (step S55), and when the amplitude is equal to the threshold value or less, the C switch section is set OFF (step S57).

Note that in the procedure described above, an order of the processing of Y, M and C is not necessarily as shown in the flowchart, and may be replaced. In addition, as to each color, the determination of the threshold value may be performed immediately after the phase and the amplitude are measured.

(Adjustment of Rotational Phase of Photoconductor Drum)

The technique for adjusting the rotational phase of each photoconductor drum will be explained in detail.

As described above, the rotational phase is adjusted by the control for realizing that the eccentric direction of each photoconductor drum 3 after being stopped becomes the predetermined direction, when the control section 40*a* stops each photoconductor drum 3. The control section 40*a* obtains the pitch fluctuation component caused by the eccentricity of each photoconductor drum 3 by measuring the registration toner pattern, and outputs the synchronous signal at the timing when the position of the reference phase of the obtained pitch fluctuation component is exposed by the laser beam L. As shown in FIG. 13, the output timing of each of Y, M and C synchronous signals matches to one another with the state in which the rotational phase of each Y, M and C photoconductors is adjusted. Hereunder, this state is called a state that the rotational phases of the photoconductor drums are matched.

Figure 25:
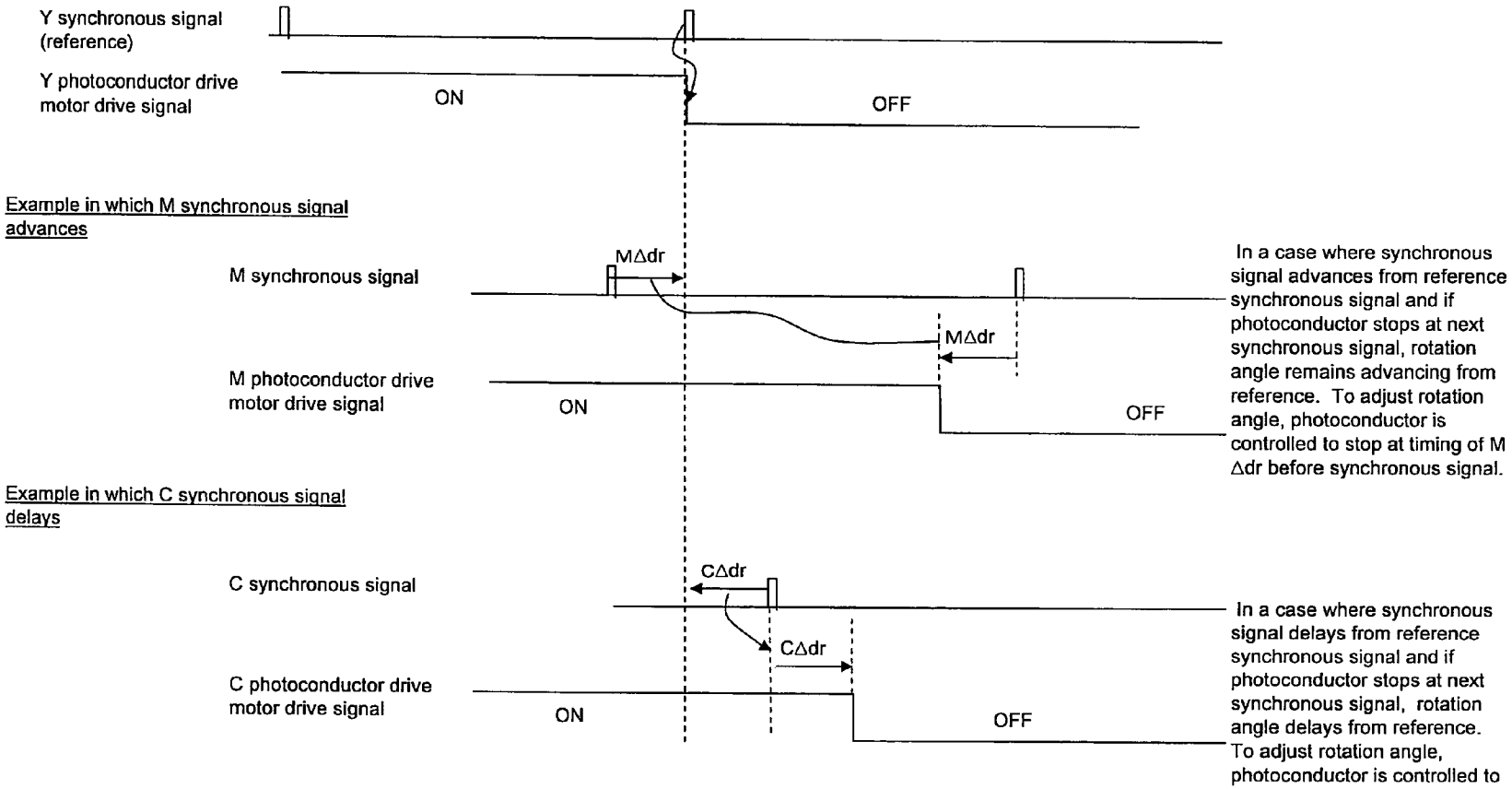
FIG. 25 is an explanatory view showing the state in which the control section 40*a* adjusts the stopping positions of M and C photoconductor drums in such a manner that these photoconductor drums are stopped with each of the rotational phases of these photoconductor drums matched to that of a Y photoconductor drum.

FIG. 25 is an explanatory view showing the state in which the stopping positions of the M photoconductor drum 3*c* and the C photoconductor drum 3*b* are adjusted to stop the M photoconductor drum 3*c* and the C photoconductor drum 3*b* with their rotational phases matched to that of the Y photoconductor drum 3*d*. In FIG. 25, the output of the M synchronous signal advances from the Y synchronous signal that is the reference, and the output of the C synchronous signal is delayed from the Y synchronous signal. The control section 40*a* monitors the advance and delay of the M and C synchronous signals with respect to the Y synchronous signal before the stoppage. Specifically, the control section 40*a* obtains the advancing amount MΔdr of the M synchronous signal and the delay amount CΔdr of the C synchronous signal.

Thereafter, the control section 40*a* stops the Y photoconductor drum 3*d*, which is the reference, at the predetermined position. In FIG. 25, the control section 40*a* stops the Y photoconductor drum 3*d* with the Y synchronous signal used as a trigger. The M photoconductor drum 3*c* that advances from the Y synchronous signal, which is the reference for stoppage, is stopped earlier than the M synchronous signal, which is to be outputted afterward, by MΔdr. Namely, after the time (photoconductor peripheral length÷peripheral speed) required for one rotation of the photoconductor from detecting the synchronous signal, the next synchronous signal is outputted. Therefore, after detecting the synchronous signal {(the time required for one rotation of the photoconductor)−MΔdr}, the photoconductor may be stopped. Thus, the advance of the phase with respect to the Y photoconductor drum 3*d* is corrected. On the other hand, the C photoconductor drum 3*b* is stopped with the delay of CΔdr from the C synchronous signal that is outputted with the delay of CΔdr from the Y synchronous signal, which is the reference for stoppage. Thus, the delay of the phase with respect to the Y photoconductor drum 3*d* is corrected.

When the output of the M synchronous signal is delayed with respect to the Y synchronous signal, the M photoconductor drum 3*c* may be stopped with the delay of the delay amount MΔdr from the M synchronous signal that is outputted with delay from the Y synchronous signal that is the reference for stoppage. FIG. 24 is an explanatory view showing the state in which the control section 40*a* adjusts the rotational phase in case where the M synchronous signal advances or is delayed with respect to the reference signal tref (corresponding to the Y synchronous signal in FIG. 25). The adjustment same as that of the M synchronous signal shown in FIG. 24 may be executed for the C synchronous signal.

It is preferable that the adjustment of the rotational phase is executed every time each photoconductor drum 3 is stopped. There may be a case in which the rotational phase of each photoconductor is gradually deviated unintentionally during the process of continuously printing many pages. This is considered to be caused by the slight error in the diameter of each photoconductor drum or a disturbance factor of the dive control system. The effect of suppressing the color misregistration can be maintained by matching the rotational phases when the photoconductor drum 3 is stopped.

(Different Correction Method for Adjusting Color Misregistration)

Figure 16:
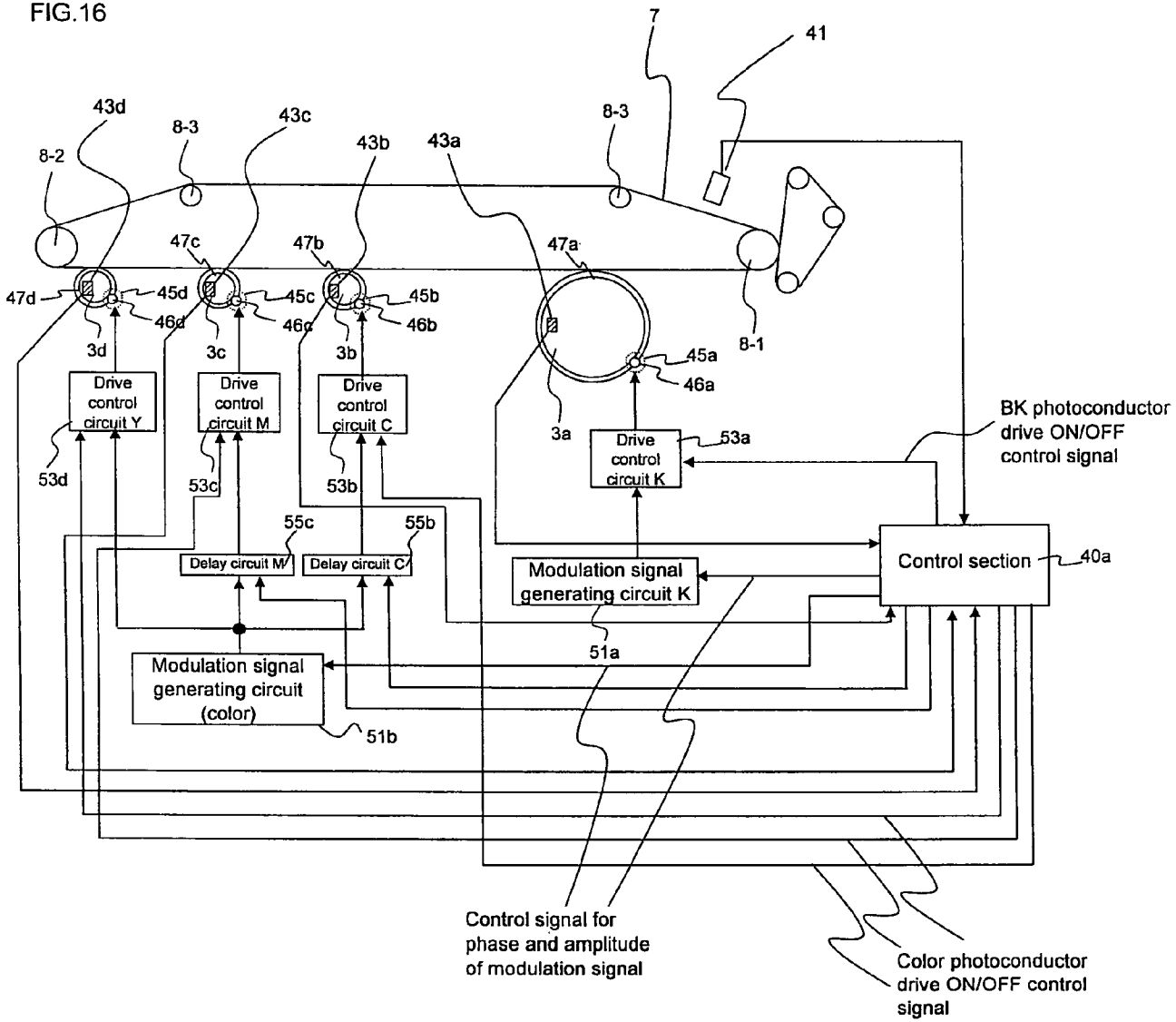
FIG. 16 is an explanatory view showing a different block configuration for correcting the pitch fluctuation component, in this embodiment.

FIG. 16 is an explanatory view showing a different block configuration for correcting the pitch fluctuation component in this embodiment. An M delay circuit 55*c* is provided in a process before the modulation signal from the modulation signal generating circuit 51*b* is inputted in the M drive control circuit 53*c* in the image forming apparatus shown in FIG. 16. Further, a C delay circuit 55*b* is provided in a process before the modulation signal from the modulation signal generating circuit 51*b* is inputted in the C drive control circuit 53*b*. A delay circuit 55 corresponds to a delay amount adjustment section specified in the claims. Each delay circuit can be realized by using a FIFO memory element, for example. In the configuration of FIG. 16, a correction signal output section specified in the claims is composed of the modulation signal generating circuit 51 and the delay circuit 55.

Each delay circuit 55 delays the modulation signal by a predetermined time. Thus, modulation signals having different phases respectively are inputted in each of the Y, M and C drive control circuits 53*b*, 53*c* and 53*b*.

Figure 17:
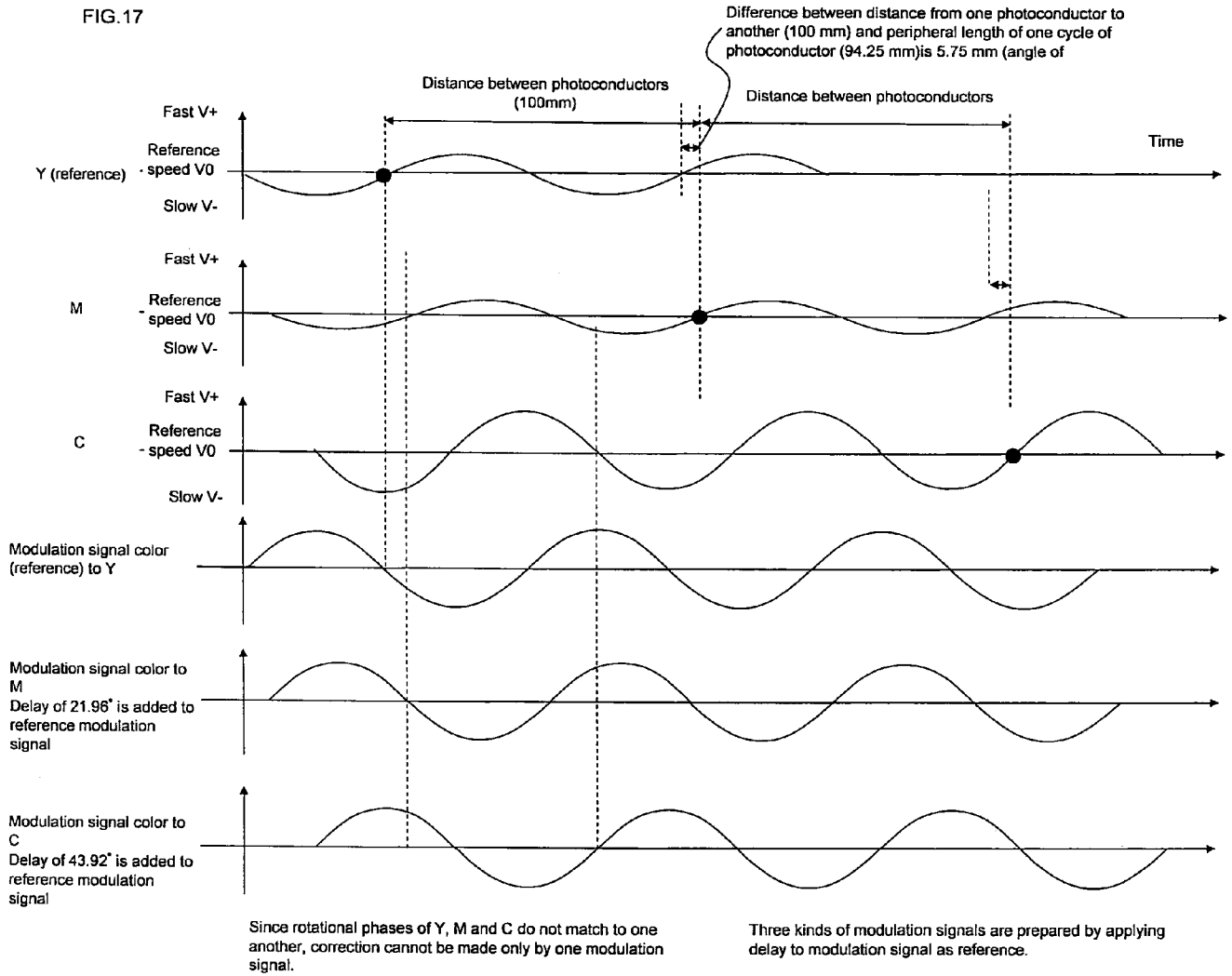
FIG. 17 is an explanatory view showing the state of the peripheral speed fluctuation component of each photoconductor drum 3 in the embodiment shown in FIG. 16.

FIG. 17 corresponds to FIG. 13, and is an explanatory view showing the state of the peripheral speed fluctuation component of each photoconductor drum 3 in the embodiment of FIG. 16.

In the image forming apparatus of FIG. 16, the control section adjusts the rotational phase of each Y, M and C photoconductor 3 so as to match the phases of the pitch fluctuation components included in each image. However, unlike the image forming apparatus of FIG. 1, further rotational phase adjustment for matching the rotational phases of the respective photoconductors is not performed. Instead, each delay circuit 55 outputs the modulation signal of the reverse phase to the peripheral speed fluctuation component of each photoconductor drum 3. First, the modulation signal generating circuit 51*b* generates the modulation signal of the reverse phase to the peripheral speed fluctuation component of the Y photoconductor drum 3*d*, being the reference. The generated modulation signal is directly inputted in the Y drive control circuit 53*d*, and is inputted in the M delay circuit 55*c* and the C delay circuit 55*b*.

The M delay circuit 55*c* delays the inputted modulation signal by the time corresponding to the rotation angle 21.96° of the M photoconductor drum 3*c* and inputs it in the M drive control circuit 53*c*. Thus, the modulation signal of the reverse phase to the peripheral speed fluctuation component of the M photoconductor drum 3*c* is inputted in the M drive control circuit 53*c*.

The C delay circuit 55*b* delays the inputted modulation signal by the time corresponding to the rotation angle 43.92° of the C photoconductor drum 3*b* and inputs it in the C drive control circuit 53*b*. Thus, the modulation signal of the reverse phase to the peripheral speed fluctuation component of the C photoconductor drum 3*b* is inputted in the C drive control circuit 53*b*.

In addition, FIG. 22 is an explanatory view showing a further different block configuration for correcting the pitch fluctuation component. In the image forming apparatus as shown in FIG. 22, switch sections 57*b*, 57*c* and 57*b* are respectively disposed in each process of inputting the modulation signal outputted from the modulation signal generating circuit 51*b* for color, in the drive control circuits 53*b*, 53*c* and 53*d*. The switch sections 57*b*, 57*c* and 57*b* function as switches for switching to input or not to input the modulation signal generated in the modulation signal generating circuit 51*b* in each of the drive control circuits 53*b*, 53*c* and 53*d*.

The control section 40*a* switches ON/OFF of each switch. The switch sections 57*b*, 57*c* and 57*b* are switch sections specified in the claims, and the control section 40*a* includes a function as a switch control section specified in the claims. When the pitch modulation component of each of the photoconductors Y, M and C is smaller than the previously defined amplitude, the control section 40 sets the switch OFF. If the switch is thus set OFF, although the pitch fluctuation component is sufficiently small, it is possible to prevent a situation that a drive of a drum is excessively corrected by the modulation signal from the modulation signal generating circuit 51*b*.

Figure 23:
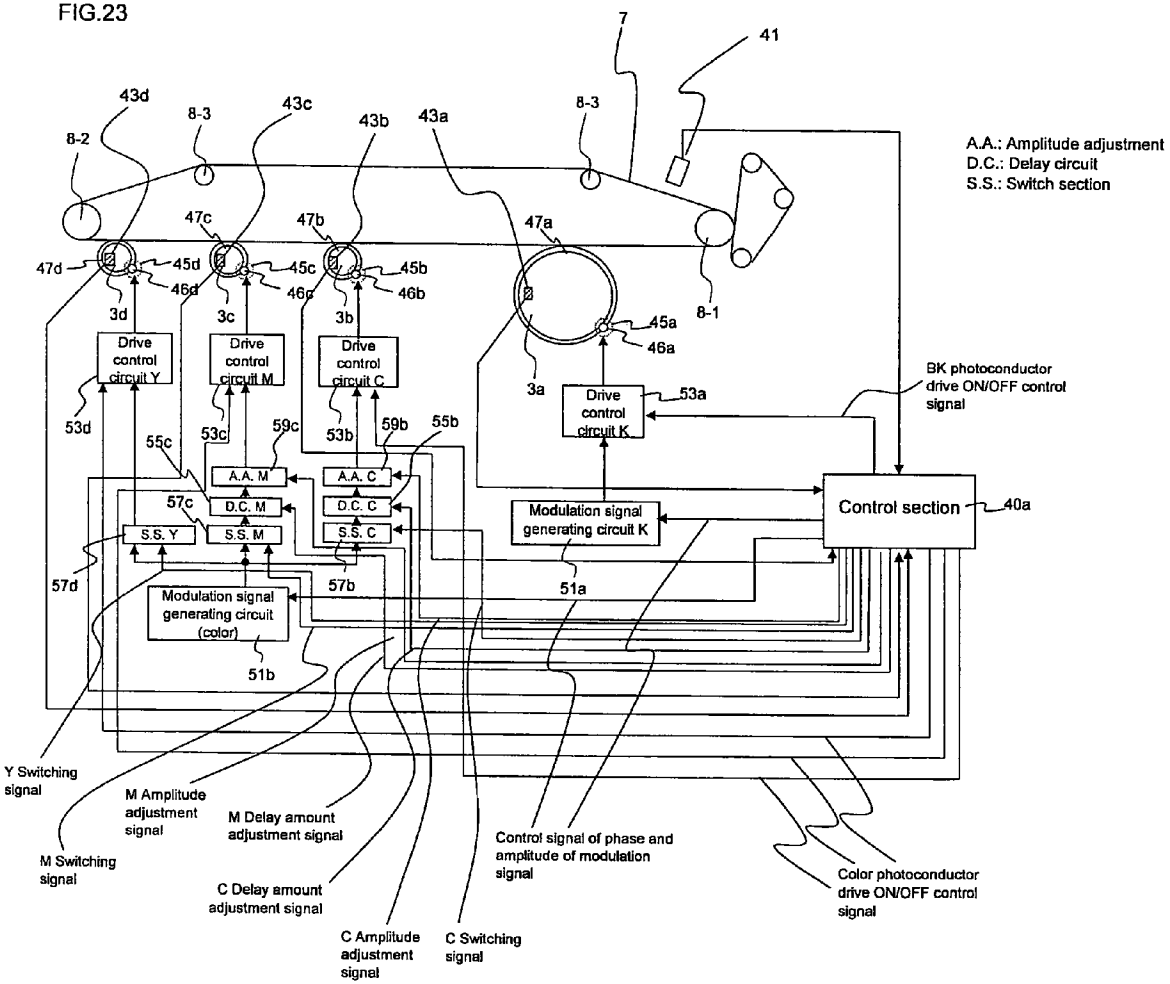
FIG. 23 is an explanatory view showing a further different block configuration for correcting the pitch fluctuation component, in this embodiment.

FIG. 23 is an explanatory view showing a further different block configuration for correcting the pitch fluctuation component. The image forming apparatus of FIG. 23 is the image forming apparatus wherein the aforementioned switch section 57 is applied in the configuration of FIG. 16, and an amplitude adjustment circuit 59 for adjusting the amplitude of the modulation signal outputted from each delay circuit 55 is further added.

The amplitude adjustment circuits 59*b* and 59*c* of FIG. 23 adjust the amplitude of the modulation signal by an instruction from the control section 40*a*. The amplitude adjustment circuit 59 can be realized, for example, by a multiplier. The control section 40*a* sets the modulation signal generated by the modulation signal generating circuit 51*b* to suppress the pitch fluctuation of Y, and adjusts the amplitude of the modulation signal respectively to suppress the pitch fluctuation of each color by the amplitude adjustment circuit 59*b* for C, and by the amplitude adjustment circuit 59*c* for M. Thus, the amplitude and the phase in accordance with the pitch fluctuation component of each color are inputted in each drive control circuit 53. The amplitude adjustment circuit 59 corresponds to an amplitude adjustment section specified in the claims. In the configuration of FIG. 23, a correction signal output section specified in the claims is composed of the modulation signal generating circuit 51, the amplitude adjustment circuit 59, the delay circuit 55, and the switch section 57.

A similar function can be realized by having an independent modulation signal generating circuit in the Y, M and C, respectively. However, the phase and the amplitude of the modulation signal set for Y may only be finely adjusted in the delay circuit 55 of M and C and the amplitude adjustment circuit 59 in FIG. 23. A designer may select any one of the aforementioned configurations, in consideration of a cost required for the circuit and the like.

(Manual Color Registration Method)

The image forming apparatus according to the present invention may have the function of printing the registration toner pattern and visually adjusting the fluctuation component of the image pitch. A manual adjustment is effective, for example, when the color registration sensor 41 breaks down and the adjustment result performed by reading the registration toner pattern by the color registration sensor 41 shows a malfunction. In this case, for example, a service engineer has a self diagnosis program for visually adjusting the rotational phase of the photoconductor. The self diagnosis program provides a function of inputting an adjustment value by using an operation part not shown of the image forming apparatus 50 and adjusting the rotational phase of each photoconductor.

Figure 18:
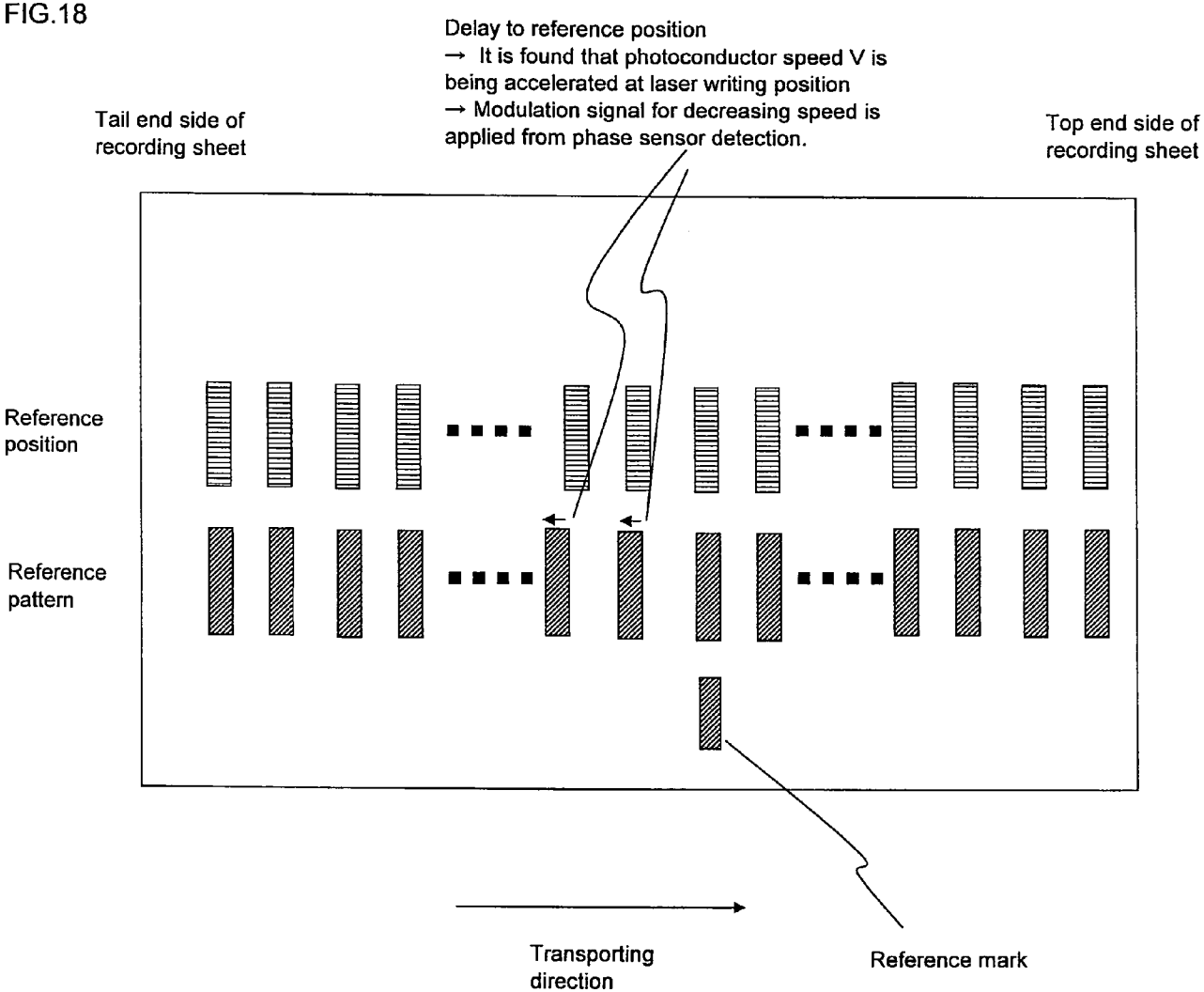
FIG. 18 is an explanatory view showing an example of the registration toner pattern provided for a visual adjustment, in this embodiment.

FIG. 18 is an explanatory view showing a printing example of the registration toner pattern provided for visual adjustment. In FIG. 18, the pattern as the reference position is the pattern of equal pitches formed by the photoconductor drum 3*a* of K. Here, in the K photoconductor drum 3*a*, the driving speed is corrected by an appropriate modulation signal and the fluctuation component of the image pitch is suppressed. Accordingly, the fluctuation of the image pitch is suppressed to such a degree that it can be used as the reference position. A reference pattern is a pattern of any one of the Y, M and C colors. In the lower part of the reference pattern, there is a reference mark obtained by emitting the laser beam of LSU1 of this color corresponding to the reference signal of the phase sensor 43 corresponding to the color of the reference pattern.

Printing of the reference mark may be realized, for example, by providing an exclusive hardware for emitting the LSU1 corresponding to the reference signal. Alternately, the microcomputer of the control section may realize the aforementioned function by performing interrupt processing.

The service engineer obtains the amplitude of the pitch fluctuation component of each color of Y, M and C with respect to the reference position, from the printed registration toner pattern, and in addition, obtains the phase of the pitch fluctuation component with respect to the reference mark. The self-diagnosis program provides the function of inputting the visually obtained amplitude and phase by using the operation part not shown of the image forming apparatus 50. Further, the self-diagnosis program provides the function of determining the amplitude and the phase of each modulation signal to be outputted, from the amplitude and the phase of each color of Y, M and C inputted.

(Further Different Correction Method of Color Registration)

The aforementioned adjustment method adjusts the rotational phase of each photoconductor to match the rotational phases of the photoconductor drums of each color of Y, M and C. Here, for example, the rotational phases of other M and C photoconductor drums 3*c* and 3*b* may be matched to the rotational phase of the Y photoconductor drum 3*d*, with the phase of the Y photoconductor drum 3*d* always as a reference.

However, in this embodiment, a different method is shown. In the different method, with the photoconductor drum 3 corresponding to the color with maximum amplitude of the pitch fluctuation component as a reference, the rotational phases of other photoconductor drums are matched to it. The modulation signal is outputted in accordance with the phase of the photoconductor drum of the largest pitch fluctuation component. The common modulation signal is inputted in each drive control circuit 53 of Y, M and C, and thus the modulation signal becomes completely reverse phase to the color of the largest pitch fluctuation component. Regarding other colors, there is a deviation in phases between the pitch fluctuation component and the modulation signal, along with the correction of the rotational phase. However, in the modulation signal, the largest pitch fluctuation component is effectively suppressed, and therefore an excellent correction result can be obtained as a whole.

Figure 19:
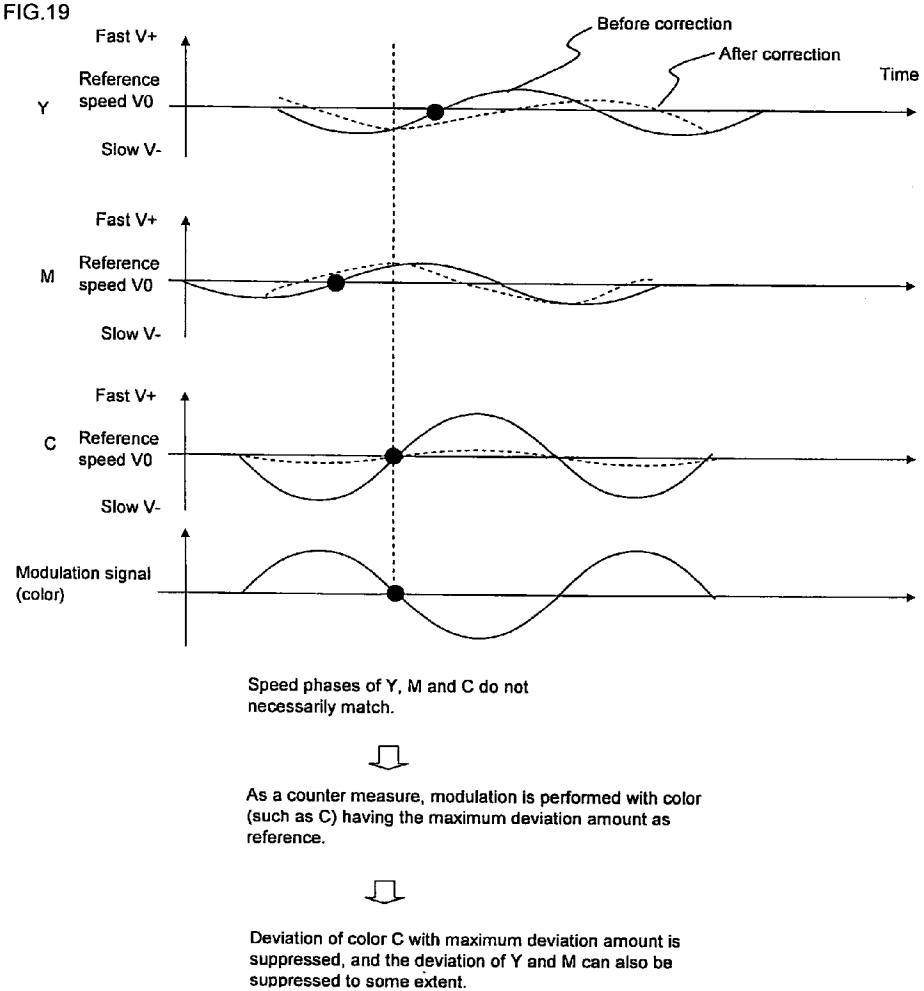
FIG. 19 is an explanatory view showing an effect of suppressing the peripheral speed fluctuation component when a common modulation signal is applied to each photoconductor whose rotational phase is adjusted, in this embodiment.

FIG. 19 is an explanatory view showing an effect of suppressing the peripheral speed fluctuation component, when the common modulation signal is applied to each photoconductor whose rotational phase is adjusted, in this embodiment. In FIG. 19, the peripheral speed fluctuation component of the photoconductor of each color is taken on the ordinate axis, and the time is taken on the abscissa axis. The fluctuation component of C is largest. The phases of the peripheral speed fluctuation components of each color of Y, M and C are mutually deviated. This shows that each photoconductor is in a state to match rotational phases (state of FIG. 15). Namely, it is in a state that the rotation angle of the photoconductor drum at the time of stoppage is controlled, so that the synchronous signals of Y and M are matched to the synchronous signal of C, with the synchronous signal of C having maximum amplitude of the peripheral speed fluctuation component as a reference. The modulation signal is outputted with the phase and the amplitude capable of canceling the peripheral speed fluctuation component of C. Dotted line shows the peripheral speed fluctuation component of each color obtained as a result of the correction by the modulation signal. C still includes a slight fluctuation, and this is due to measurement error, or the like. However, its peripheral speed fluctuation component becomes smallest, compared to the fluctuation components of other Y and M. Thus, by determining the phase of the modulation signal, the peripheral speed fluctuation component can be effectively suppressed.

Figure 20:
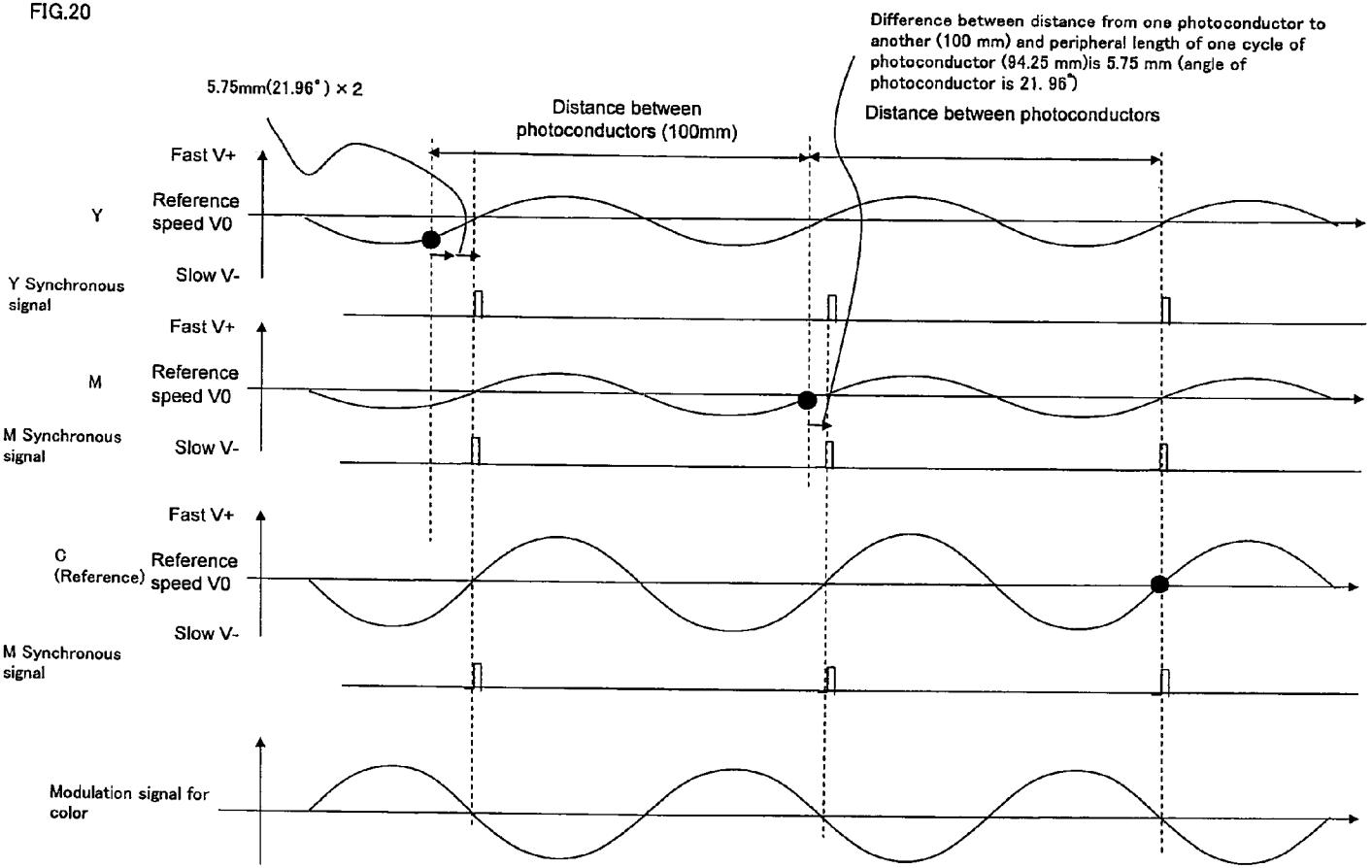
FIG. 20 is an explanatory view showing the peripheral speed fluctuation component in a state in which the rotational phase of each photoconductor is adjusted so that phases of pitch fluctuation components match to each other on an image, in this embodiment.

FIG. 20 is a view corresponding to FIG. 11, and is an explanatory view showing the peripheral speed fluctuation component of the photoconductor drum for each color, with the rotational phase of each photoconductor adjusted so that the phases of the pitch fluctuation components match on the image. In FIG. 11, the modulation signal is outputted with the Y photoconductor drum 3*d* as a reference. Meanwhile, in FIG. 20, the modulation signal is outputted with the C photoconductor drum 3*b* having the largest peripheral speed fluctuation component as a reference.

A black circle in FIG. 20 indicates the position of each of Y, M and C images that should be transferred onto the same position on the recording medium. Supposing that the position of the black circle is defined as the leading end portion of the printed image, the position of the leading end portion of the Y, M and C printed images matches to the synchronous signal in FIG. 11. On the other hand, with the state after the rotational phase is adjusted, the position of the leading end portion of the C printed image matches to the C synchronous signal, but the position of the leading end portion of the Y printed image is advanced from the Y synchronous signal by 21.96° and the leading end portion of the C printed image is advanced from the C synchronous signal by 43.92° as shown in FIG. 20. The control section controls the exposure timing at the leading end portion of each printed image for the synchronous signal one before the present synchronous signal as shown in FIG. 20.

Subsequently, a method of controlling the phase of the modulation signal of black (K) will be explained.

Figure 21:
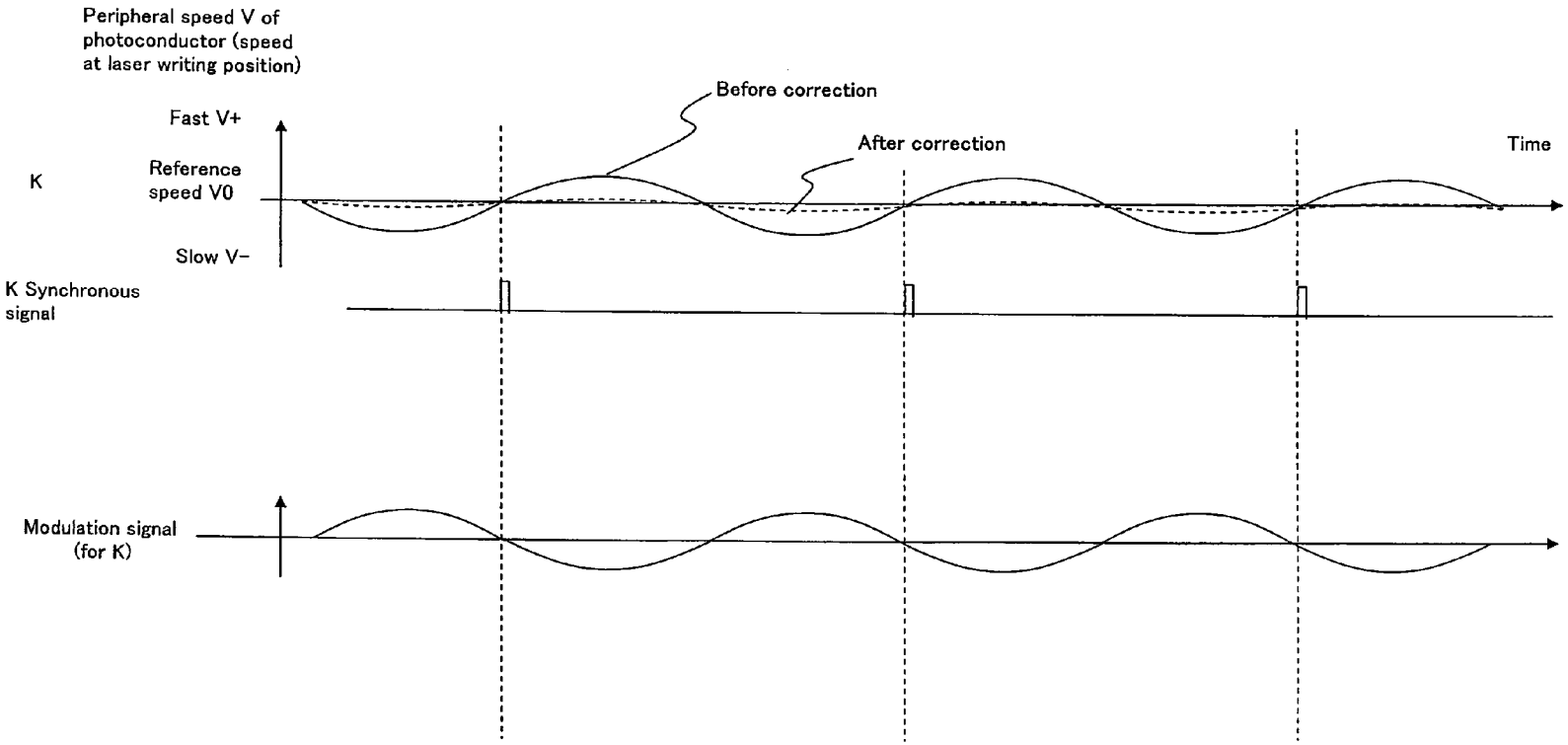
FIG. 21 is an explanatory view showing the state of the modulation signal for suppressing the peripheral speed fluctuation component of a K photoconductor, in this embodiment.

FIG. 21 is an explanatory view showing the state of the modulation signal for suppressing the peripheral speed fluctuation component of the K photoconductor. The modulation signal generating circuit 51*a* adds correction of Δt to the reference signal outputted from the phase sensor 43*a* of K, and further subtracts a correction time dt (90°) (sec) corresponding to the time required for carrying out the rotation of the photoconductor rotation angle 90°, or controls the phase of the modulation signal (for K) based on the K synchronous signal obtained by adding the correction time dt (270°) (sec) corresponding to the time required for carrying out the rotation of the photoconductor rotation angle 270°. In the case of FIG. 21, it is so controlled that the reference phase of the modulation signal (for K) is synchronized with the K synchronous signal. Namely, it is so controlled that the modulation signal (for K) increasing in the negative direction from 0 is outputted at a timing of outputting the K synchronous signal.

It is finally apparent that various modifications are possible within the scope of the present invention, in addition to the aforesaid embodiment. The modifications should not be construed not belonging to the feature and scope of the present invention. It is intended that the scope of the present invention includes all modifications within the meaning and scope equivalent to the claims.

What is claimed is:

1. A color image forming apparatus comprising:

a plurality of drum-type photoconductors for forming an image in a different color on each peripheral surface and the photoconductors having at least two different diameters;

a plurality of driving sections for driving each photoconductor at a driving speed in accordance with the diameter so that each photoconductor rotates at a predetermined peripheral speed;

a correction signal output section for outputting a speed correction signal to correct a periodic pitch fluctuation included in each formed image;

a drive control section for controlling the driving section to correct the driving speed of each photoconductor by the speed correction signal, a registration image forming section for forming a registration image comprising a plurality of patterns on each photoconductor;

a measurement section for measuring a position of each pattern of the formed registration image; and a fluctuation component calculation section for calculating an amplitude and a phase of a pitch fluctuation component corresponding to the rotational cycle of the photoconductor based on a measurement result of each pattern, wherein the speed correction signal is a signal having the same cycle as a rotational cycle of each photoconductor;

wherein the correction signal output section includes a correction signal generating section for generating the speed correction signal for every kind of the diameters based on the calculated amplitude and phase, and wherein the speed correction signal is a common signal of the photoconductors having mutually the same diameter, and the correction signal generating section calculates an average of a maximum amplitude and a minimum amplitude of the amplitude of the pitch fluctuation of each photoconductor to which the speed correction signal is applied and generates the speed correction signal by using the calculated amplitude.

2. The image forming apparatus according to claim 1, wherein the speed correction signal is a common signal of the photoconductors having the same diameter.

3. The image forming apparatus according to claim 1, wherein each photoconductor is composed of a black image forming photoconductor having a diameter of a first size and a plurality of color image forming photoconductors having diameters of a second size.

4. The image forming apparatus according to claim 3, wherein the color image forming photoconductor is composed of a yellow image forming photoconductor, a magenta image forming photoconductor and a cyan image forming photoconductor.

5. The image forming apparatus according to claim 3, wherein the size of the diameter of the black image forming photoconductor is larger than the size of the diameter of the color image forming photoconductor.

6. The image forming apparatus according to claim 1, wherein at least a part of the correction signal output section further comprises:

a switch section for switching a condition that the generated speed correction signal is outputted or not outputted to the drive control section of each photoconductor; and a switch control section for switching the switch section corresponding to the photoconductor in accordance with the size of the amplitude of the pitch fluctuation component of each photoconductor.

7. The image forming apparatus according to claim 1, further comprising:

a transfer member for transferring an image formed by each photoconductor; and a rotational phase adjustment section for adjusting a rotational phase of the photoconductor, wherein each photoconductor is composed of a black image forming photoconductor having a diameter of a first size and a plurality of color image forming photoconductors having diameters of a second size, and each photoconductor is disposed along the transfer member at a predetermined interval;

the rotational phase adjustment section calculates a relative misintegration amount of the phase of the pitch fluctuation component included in the image formed by each color image forming photoconductor and transferred to the transfer member, and adjusts the rotational phase so that periodic phases of the speed fluctuation of each color image forming photoconductor are matched based on the misintegration amount of the calculated phase wherein the correction signal generating section generates a speed correction signal of a reverse phase to the phase of the periodic speed fluctuation of a reference photoconductor, with a photoconductor having a maximum amplitude calculated as a reference photoconductor.

8. The image forming apparatus according to claim 1, further comprising:

a transfer member for transferring an image formed by each photoconductor; and a rotational phase adjustment section for adjusting a rotational phase of each photoconductor, wherein each photoconductor is composed of a black image forming photoconductor having a diameter of a first size and a plurality of color image forming photoconductors having diameters of a second size, and each photoconductor is disposed along the transfer member at a predetermined interval;

at least a part of the correction signal output section further comprises a delay section for delaying the speed correction signal from the correction signal output section for each photoconductor;

the rotational phase adjustment section adjusts the rotational phase of each color image forming photoconductor based on the calculated phase, so that the phases of the pitch fluctuation component included in the image formed by each color image forming photoconductor and transferred to the transfer member are matched; and the delay section delays each speed correction signal so as to have the phase to cancel the pitch fluctuation component in accordance with a previously defined angle in accordance with the interval.

9. The image forming apparatus according to claim 8, wherein each photoconductor further comprises:

a phase sensor for detecting a reference value used in a control of the rotational phase and outputting a reference signal, wherein at least a part of the correction signal output section further comprises a delay amount adjustment section for adjusting a delay amount of the delay section;

the delay amount adjustment section compares phases between the reference signal and the generated speed correction signal in the middle of forming the image, and adjusts the delay amount to suppress a time-sequential change of the phase of the speed correction signal with respect to the reference signal based on a comparison result.

10. The image forming apparatus according to claim 8, wherein at least a part of the correction signal output section further comprises an amplitude adjustment section for adjusting an amplitude of the generated speed correction signal for each photoconductor.

11. The image forming apparatus according to claim 1, wherein each photoconductor further comprises:

a phase sensor for detecting a reference position used in a control of the rotational phase and outputting a reference signal; and a mark adding section for adding a mark to a registration image in accordance with an output of the reference signal.

12. The image forming apparatus according to claim 7, wherein the rotational phase adjustment section determines each rotational phase so that a rotational phase of other color image forming photoconductor is matched to the rotational phase of the reference photoconductor.

13. The image forming apparatus according to claim 7, wherein the interval is an interval between positions of adjacent color image forming photoconductors in contact with the transfer member, respectively, and the interval is a distance different from the integral multiple of a peripheral length of the color image forming photoconductor.

14. The image forming apparatus according to claim 1, wherein the patterns of the registration image include a plurality of straight lines extending orthogonal to a rotating direction of the photoconductor, and the amplitude and the phase of the pitch fluctuation component are calculated by the measurement section by measuring a deviation of a position of each straight line from a reference position.

* * * * *